US011033104B2

(12) United States Patent
Kim

(10) Patent No.: US 11,033,104 B2
(45) Date of Patent: Jun. 15, 2021

(54) REFRIGERATOR

(71) Applicant: LG Electronics Inc., Seoul (KR)

(72) Inventor: Jeonggil Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 16/557,322

(22) Filed: Aug. 30, 2019

(65) Prior Publication Data

US 2020/0069056 A1 Mar. 5, 2020

(30) Foreign Application Priority Data

Aug. 30, 2018 (KR) ..... 10-2018-0103013

(51) Int. Cl.

| | |
|---|---|
| ***A47B 88/473*** | (2017.01) |
| ***F25D 25/02*** | (2006.01) |
| ***A47B 88/423*** | (2017.01) |
| ***A47B 88/453*** | (2017.01) |
| ***A47B 88/437*** | (2017.01) |
| *A47B 88/90* | (2017.01) |

(52) U.S. Cl.

CPC ..... *A47B 88/473* (2017.01); *A47B 88/423* (2017.01); *A47B 88/437* (2017.01); *A47B 88/453* (2017.01); *F25D 25/025* (2013.01); *A47B 2088/901* (2017.01); *A47B 2210/175* (2013.01)

(58) Field of Classification Search

CPC ... A47B 88/473; A47B 88/423; A47B 88/437; A47B 2088/901; A47B 2210/175; F25D 25/025

USPC ..... 312/402

See application file for complete search history.

(56) References Cited

U.S. PATENT DOCUMENTS

| | | | | |
|---|---|---|---|---|
| 1,067,404 A * | 7/1913 | Callaghan | A47B 88/493 312/331 |
| 1,902,795 A * | 3/1933 | Wolters | A47B 88/493 312/331 |
| 8,562,087 B2 * | 10/2013 | Eom | F25D 25/025 312/402 |
| 8,668,289 B2 * | 3/2014 | Lee | E05B 17/0033 312/402 |

(Continued)

FOREIGN PATENT DOCUMENTS

| | | |
|---|---|---|
| EP | 1323364 | 7/2003 |
| EP | 2299215 | 3/2011 |
| KR | 1020090102577 | 9/2009 |

OTHER PUBLICATIONS

Extended European Search Report in European Application No. 19194336.4, dated Jan. 2, 2020, 5 pages.

*Primary Examiner* — Daniel J Troy
*Assistant Examiner* — Timothy M Ayres
(74) *Attorney, Agent, or Firm* — Fish & Richardson P.C.

(57) ABSTRACT

A refrigerator includes a cabinet defining a storage chamber, a drawer door, a motor assembly provided at the storage chamber and configured to provide a driving force that moves the drawer door relative to the storage chamber, and a rack gear assembly provided at the drawer door and having an extendable rack gear. The rack gear includes a fixed rack fixed to the drawer door and a moving rack slidably coupled to the fixed rack. The drawer door includes a drawer part that defines an upwardly open storage space, and a door part that is configured to, based on the drawer door being inserted into the storage chamber, close the storage chamber.

22 Claims, 29 Drawing Sheets

(56) References Cited

U.S. PATENT DOCUMENTS

| | | | | |
|---|---|---|---|---|
| 9,243,662 | B2 * | 1/2016 | Bonat | F16C 29/04 |
| 9,982,937 | B2 * | 5/2018 | Tierney | A47B 88/40 |
| 2006/0250059 | A1 * | 11/2006 | Lemm | A47B 88/467<br>312/331 |
| 2012/0091872 | A1 * | 4/2012 | Matthes | A47B 88/447<br>312/334.8 |
| 2018/0128539 | A1 * | 5/2018 | Staud | F25D 23/067 |
| 2019/0242640 | A1 * | 8/2019 | Minoru | A47B 88/457 |

* cited by examiner

REFRIGERATOR

CROSS-REFERENCE TO RELATED APPLICATIONS

The present application claims priority under 35 U.S.C. 119 and 35 U.S.C. 365 to Korean Patent Application No. 10-2018-0103013 (Aug. 30, 2018), which is hereby incorporated by reference in its entirety.

BACKGROUND

The present disclosure relates to a refrigerator.

In general, refrigerators are electric appliances for storing foods at low temperature in a storage chamber closed by a door. The storage chamber is cooled with cold air that exchanges heat with refrigerant in refrigeration cycles, thereby optimally storing foods.

Such a refrigerator is becoming larger and multifunctioned as dietary changes and user's preferences become more diverse, and thus, a refrigerator having various structures and convenience devices for user's convenience and freshness of stored foods has been introduced.

In general, a refrigerator includes a cabinet defining a storage chamber. Also, a door opening/closing the storage chamber is provided on the cabinet.

A rotational door or drawer door may be applied as the door.

The rotational door may be a door that is rotatably disposed on the cabinet to open and close the storage chamber through the rotation thereof.

The drawer door may be a door that is disposed on the cabinet so as to be insertable and withdrawable forward and backward to open and close the storage chamber through the draw-out thereof.

The drawer door may include a door part covering a front surface of the storage chamber and a drawer part disposed at a rear side of the door part to define a storage space in which foods are stored.

The drawer door may accommodate foodstuffs requiring separation and storage such as vegetables and fruit, and the storage space of the drawer part may be exposed to the outside by a user's drawing operation.

In general, the drawer door is disposed at a lower portion of the cabinet. Thus, to withdraw the drawer door, the user has to roll his/her waist, which makes it difficult to withdraw the drawer door.

Recently, a refrigerator has been developed in which the drawer door is automatically drawn out by driving of a motor.

A refrigerator including a main body in which a storage space is defined and a drawer withdrawably disposed on the main body to accommodate foods is disclosed in Korean Patent Publication No. 10-2009-0102577 that is a prior art document.

A structure in which a rolling portion that rotates by rotation of the driving motor moves along a rack to automatically insert and withdraw the drawer is disclosed in the prior art document.

In detail, according to the prior art document, the driving motor and the rolling portion connected to a shaft of the driving motor are provided in the drawer. Also, the guide rack that is gear-coupled to the rolling portion is lengthily disposed forward and backward in the storage space of the main body into/from which the drawer is inserted and withdrawn.

However, according to the prior art document, since the driving motor is provided in the drawer, the drawer may increase in weight, and also, when the drawer is withdrawn, the refrigerator may be inclined.

Also, according to the prior art document, the length of the rack may be fixed to restrict the withdrawal of the drawer. Thus, even though the drawer is maximally automatically withdrawn, the storage space of the drawer may not be sufficiently exposed and thus may not be efficiently utilized.

Also, according to the prior art document, since the driving motor is provided in the drawer, when the withdrawal distance of the drawer increases, the driving motor may be exposed to the outside. Thus, when the drawer is withdrawn, the outer appearance may be poor.

SUMMARY

Implementations provide a refrigerator in which an automatic withdrawal distance of a drawer door increases.

Implementations also provide a refrigerator including a rack gear that increases in length when a drawer door is automatically withdrawn.

Implementations also provide a refrigerator including a rack gear that decreases in length when a drawer door is automatically inserted.

Implementations also provide a refrigerator in which a rack gear for automatic draw-out of a drawer door is not exposed to the outside.

In one implementation, a refrigerator includes: a cabinet that defines a storage chamber; a drawer door configured to be inserted into and withdrawn out of the storage chamber, the drawer door including a drawer part that defines an upwardly open storage space, and a door part that is configured to, based on the drawer door being inserted into the storage chamber, close the storage chamber; a motor assembly provided at the storage chamber and including a motor and a pinion gear that is rotated by the motor, the motor assembly being configured to provide a driving force that moves the drawer door into and out of the storage chamber; and a rack gear assembly provided at the drawer door and having an extendable rack that is configured to be coupled to the pinion gear, wherein the rack gear assembly further includes: a fixed rack portion that is fixed to the drawer door, and a moving rack portion that is slidably coupled to the fixed rack and configured to extend from the fixed rack portion, wherein the moving rack portion is configured, based on the drawer door and the fixed rack portion moving relative to the storage chamber in a first direction, to extend away from the fixed rack in a second direction opposite the first direction, wherein a length of the rack assembly is configured to change according to a withdrawal position of the drawer door.

Each of the fixed rack portion and the moving rack portion may define a portion of one surface of a rack gear assembly on which the rack gear is disposed, and the rack gear may extend forward and backward from the fixed rack portion, and a portion of the rack gear assembly may be divided into left and right sides so that the one divided side is disposed on the moving rack portion.

The rack gear may include: a first fixed rack disposed on the fixed rack portion, the first fixed rack being gear-coupled to the pinion in an initial withdrawal of the drawer door; a second fixed rack disposed behind the first fixed rack on the fixed rack portion, the second fixed rack being disposed in an extension line of the first fixed rack; and a moving rack disposed on the moving rack portion, the moving rack being disposed behind the first fixed rack in an extension line of the first fixed rack.

The first fixed rack may have a horizontal width corresponding to that of the pinion, and the sum of horizontal widths of the second fixed rack and the moving rack may correspond to the horizontal width of the first fixed rack.

The fixed rack portion may include: a first fixed rack formation surface on which the first fixed rack is disposed; a second fixed rack formation surface which is disposed behind the first fixed rack formation surface on the same plane as the first fixed rack formation surface and on which the second fixed rack is disposed; and a moving rack coupling part which is recessed from the second fixed rack formation surface disposed at one side of the second fixed rack and on which the moving rack portion is mounted to be withdrawable backward.

The moving rack portion may define a moving rack formation surface disposed on the same plane as the second fixed rack formation surface in a state of being mounted on the moving rack coupling part, and the moving rack may be disposed along an end of the moving rack formation surface adjacent to the second fixed rack.

The moving rack may have a length corresponding to that of the moving rack coupling part.

The rack gear assembly may include a fixing assembly configured to selectively fix the moving rack portion to one side of the storage chamber when the drawer door is inserted and withdrawn so that the moving rack portion is inserted into and withdrawn from the fixed rack portion.

The fixing assembly may fix the moving rack portion to the storage chamber in an initial withdrawal of the drawer door so that the moving rack portion is withdrawn from the fixed rack portion, and in a state in which the moving rack portion is maximally withdrawn from the fixed rack portion, the fixed state of the moving rack portion to the storage chamber may be released so that the moving rack portion is withdrawn together with the fixed rack portion.

The fixing assembly may fix the moving rack portion again to the storage chamber when the drawer door is inserted so that the moving rack portion is inserted into the fixed rack portion.

The fixing assembly may fix the moving rack portion to the fixed rack portion when the moving rack portion is maximally withdrawn from the fixed rack portion when the drawer door is withdrawn, and the fixing assembly may release the fixed state of the moving rack portion to the fixed rack portion when the drawer door is inserted.

A protruding guide may be disposed on one side of the storage chamber, and the fixing assembly may be disposed on one side of the moving rack portion to selectively restrict the guide.

The fixing assembly may include: a slider disposed on the moving rack portion so as to be movable forward and backward; a locking protrusion protruding outward from one side of the, the locking protrusion contacting the guide when the drawer door is inserted so that the slider moves forward; and a locking portion disposed on the slider so as to be movable in a direction crossing a moving direction of the slider, the locking portion protruding to the outside of the slider by the forward movement of the slider to restrict the guide between the locking portion and the locking protrusion.

When the moving rack portion is maximally withdrawn from the fixed rack portion when the drawer door is withdrawn, the slider may be pulled by the guide restricted between the locking protrusion and the locking portion to move backward, and the locking portion may be inserted into the slider by the backward movement of the slider to release the restriction of the guide.

The locking portion may be disposed to pass through the slider and the moving rack portion, and the rack gear assembly may include: a moving rack mounting part which is recessed from one side of the fixed rack portion and on which the moving rack portion is mounted to be movable forward and backward; a locking portion insertion groove disposed on a rear portion of the moving rack mounting part, the locking portion insertion groove accommodating an upper portion of the locking portion when the locking portion is inserted into the slider; a locking portion descending guide surface disposed in the locking portion insertion groove, the locking portion descending guide surface being upwardly inclined backward; a fixing assembly mounting part which is disposed on a front portion of the moving rack portion and on which the slider is disposed to be movable forward and backward; a first locking portion through-hole defined in the fixing assembly mounting part, first locking portion through-hole disposed corresponding to the locking portion insertion groove; and a locking portion ascending guide disposed in the first locking portion through-hole, the locking portion ascending guide being upwardly inclined backward.

The locking portion may move backward together with the slider as the slider moves backward and is guided to ascend by the locking portion ascending guide, and when the slider moves forward, and the moving rack portion is inserted into the fixed rack portion, the locking portion may be guided to descend by the locking portion descending guide surface.

The fixing assembly may include a holder selectively passing through the moving rack portion so as to be inserted into one side of the fixed rack portion as the slider moves forward and backward, wherein the holder disposed together with the moving rack portion and the fixed rack portion to fix the fixed rack portion when the slider moves backward, and the holder may be separated from the fixed rack portion when the slider moves forward.

The rack gear assembly may include: a moving rack mounting part which is recessed from one side of the fixed rack portion and on which the moving rack portion is mounted to be movable forward and backward; a first holder insertion groove defined in a rear portion of the moving rack mounting part; a holder descending guide surface disposed in the first holder insertion groove, the holder descending guide surface being upwardly inclined backward; a fixing assembly mounting part which is disposed on a front portion of the moving rack portion and on which the slider is disposed to be movable forward and backward; a holder through-hole defined in the fixing assembly mounting part, the holder through-hole being disposed corresponding to the first holder insertion groove in a state in which the moving rack portion is maximally withdrawn from the fixed rack portion; a second holder insertion groove defined in one surface of the slider facing the fixing assembly mounting part, the second holder insertion groove being disposed corresponding to the holder through-hole in a state in which the slider moves forward; and a holder ascending guide surface disposed in the second holder insertion groove, the holder ascending guide surface being downwardly inclined backward.

The holder may be guided to ascend by the holder ascending guide surface as the slider moves backward in the state in which the moving rack portion is maximally withdrawn from the fixed rack portion, and when the slider moves forward, and the moving rack portion is inserted into the fixed rack portion, the holder may be guided to descend by the holder descending guide surface.

The rack gear assembly may include: a stopper protruding from one side of the fixed rack portion; and a stopper contact part protruding from one side of the moving rack portion, the stopper contact part contacting the stopper when the moving rack portion is maximally withdrawn from the fixed rack portion.

The motor assembly may be disposed on a bottom surface of the storage chamber, and the rack gear assembly may be disposed on a bottom surface of the drawer door.

The pinion gear of the motor assembly may be disposed on a front end of the bottom surface of the storage chamber.

The details of one or more implementations are set forth in the accompanying drawings and the description below. Other features will be apparent from the description and drawings, and from the claims.

DETAILED DESCRIPTION OF THE IMPLEMENTATIONS

Reference will now be made in detail to the implementations of the present disclosure, examples of which are illustrated in the accompanying drawings. The disclosure may, however, be embodied in many different forms and should not be construed as being limited to the implementations set forth herein; rather, that alternate implementations included in other retrogressive disclosures or falling within the spirit and scope of the present disclosure will fully convey the concept of the disclosure to those skilled in the art.

Figure 1:
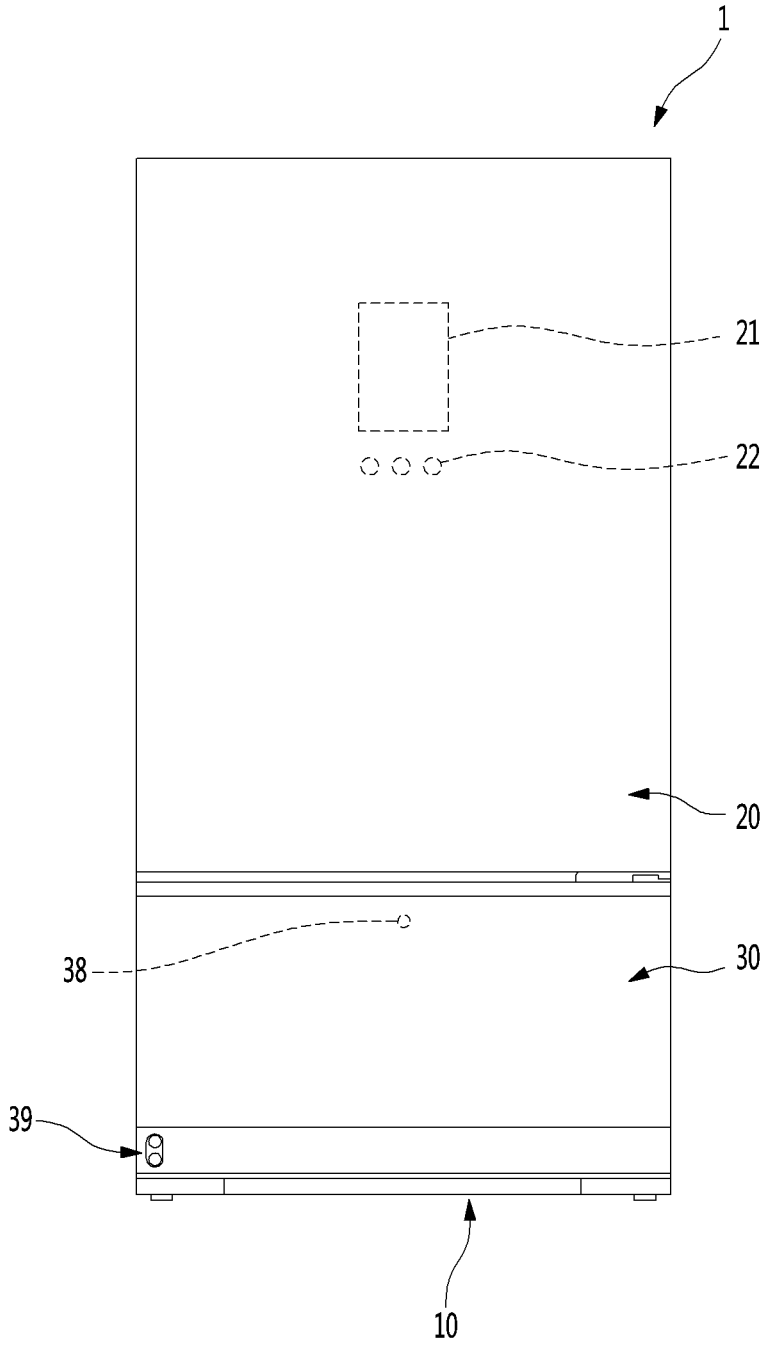
FIG. 1 is a front view of a refrigerator according to an implementation.
Figure 2:
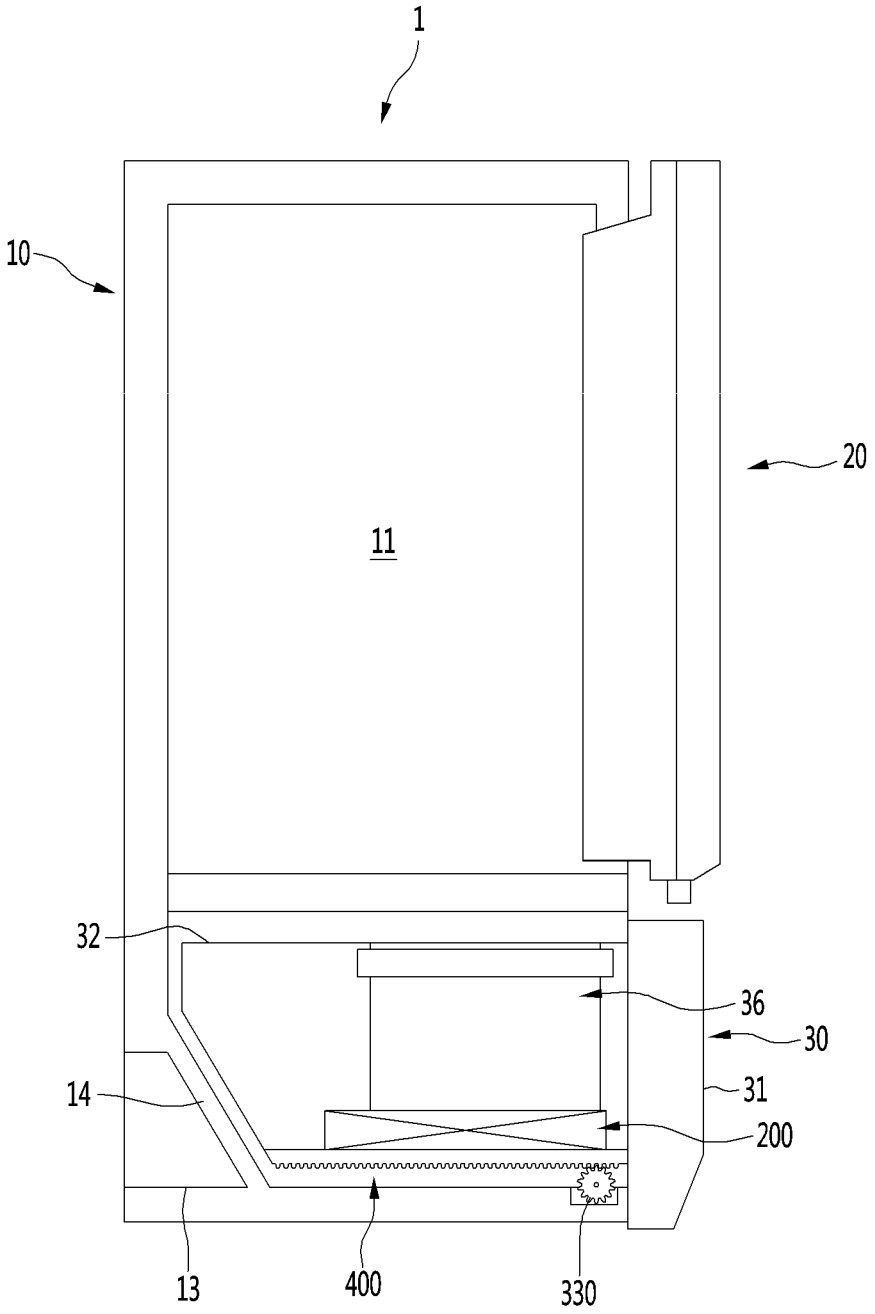
FIG. 2 is a schematic cross-sectional view illustrating an internal configuration of the refrigerator according to an implementation.
Figure 3:
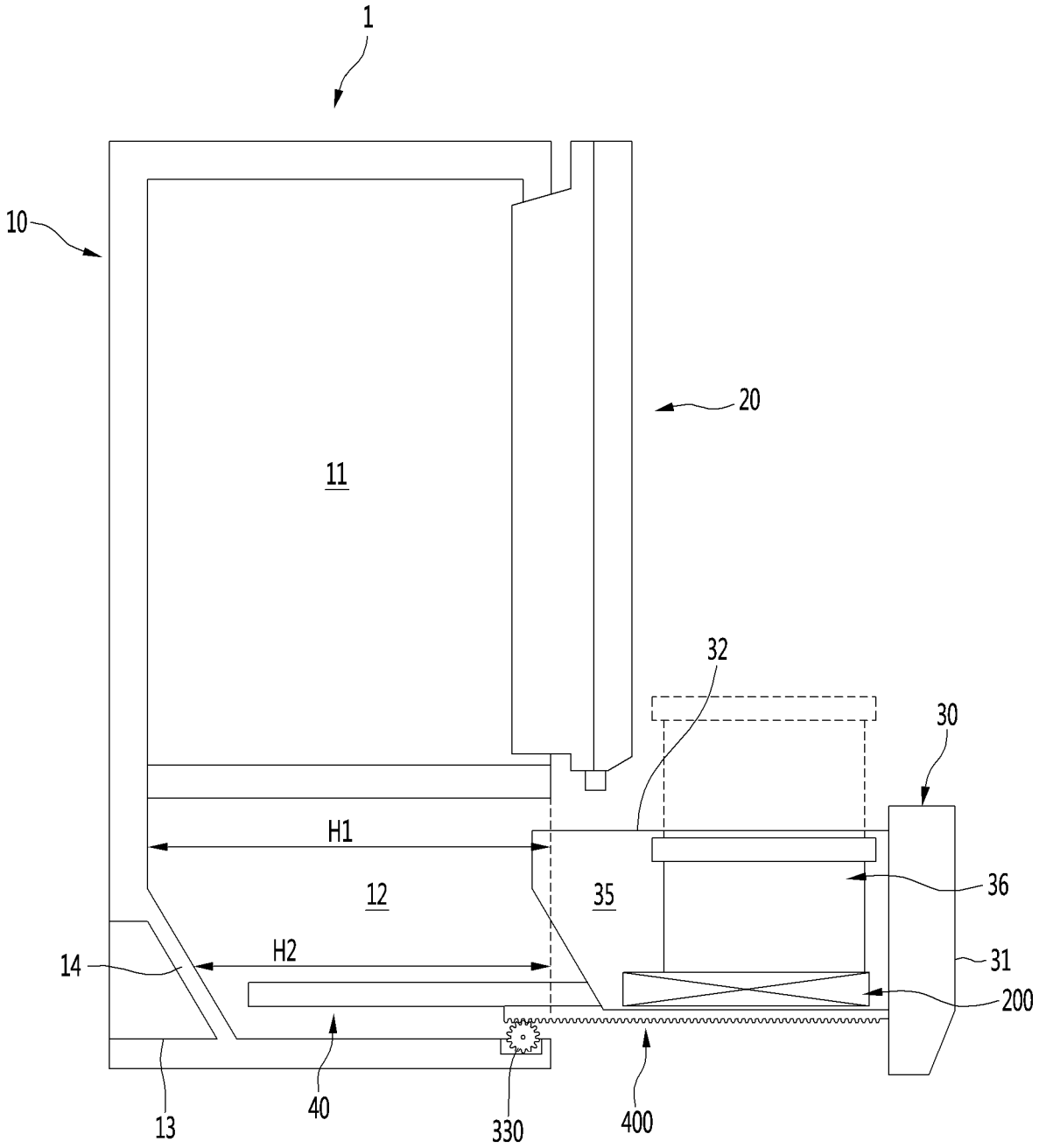
FIG. 3 is a view illustrating a state in which a drawer door is withdrawn in FIG. 2.

FIG. 1 is a front view of a refrigerator according to an implementation. FIG. 2 is a schematic cross-sectional view illustrating an internal configuration of the refrigerator according to an implementation. FIG. 3 is a view illustrating a state in which a drawer door is withdrawn in FIG. 2.

Figure 4:
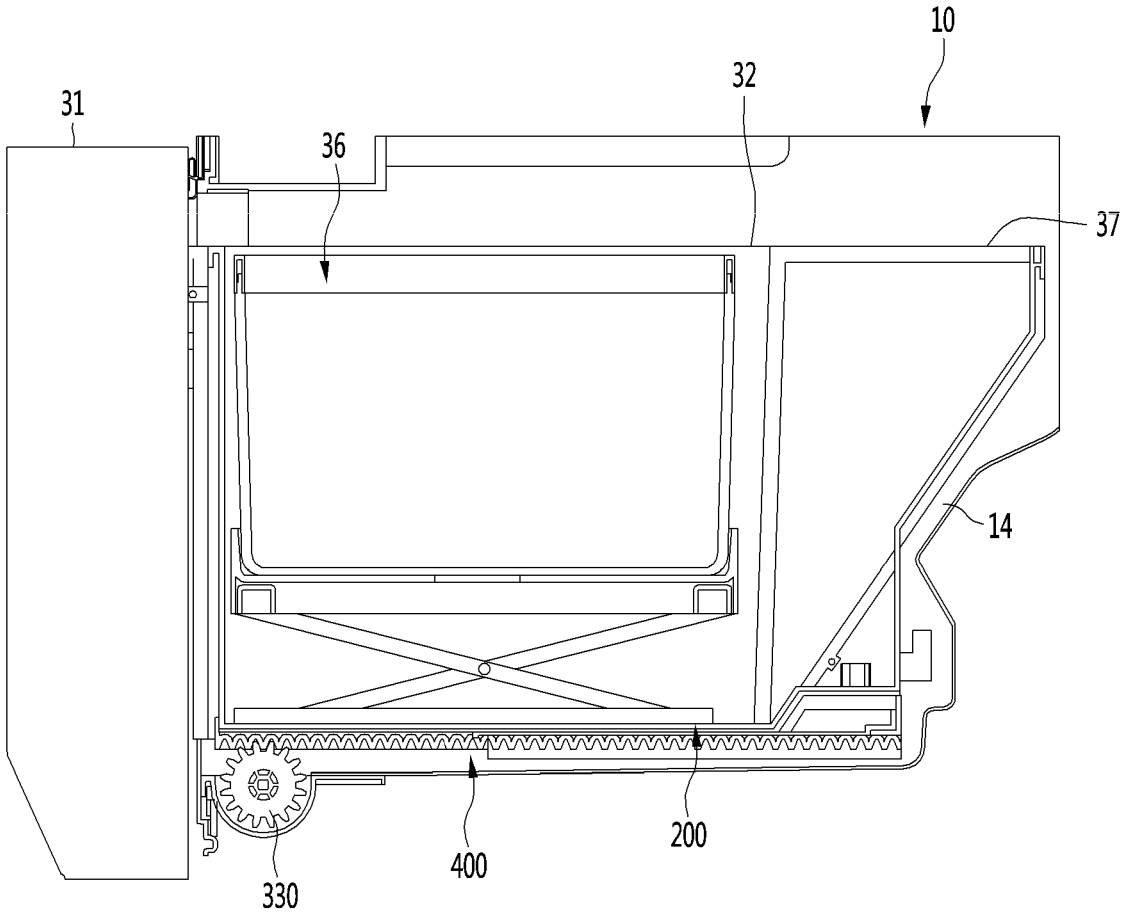
FIG. 4 is a cross-sectional view of a lower storage chamber in a state in which the drawer door is inserted according to an implementation.
Figure 5:
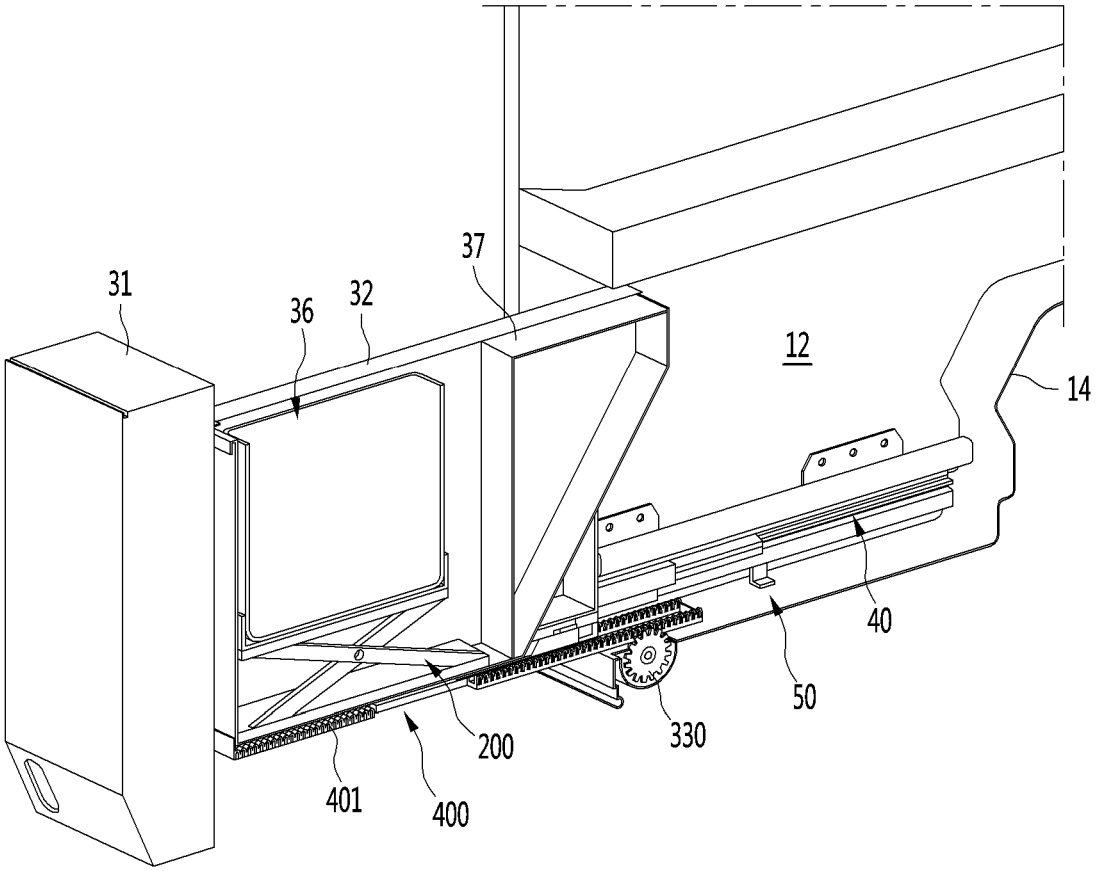
FIG. 5 is a cutaway perspective view of the lower storage chamber in a state in which the drawer door is withdrawn according to an implementation.

Also, FIG. 4 is a cross-sectional view of a lower storage chamber in a state in which the drawer door is inserted according to an implementation. FIG. 5 is a cutaway perspective view of the lower storage chamber in a state in which the drawer door is withdrawn according to an implementation.

Figure 6:
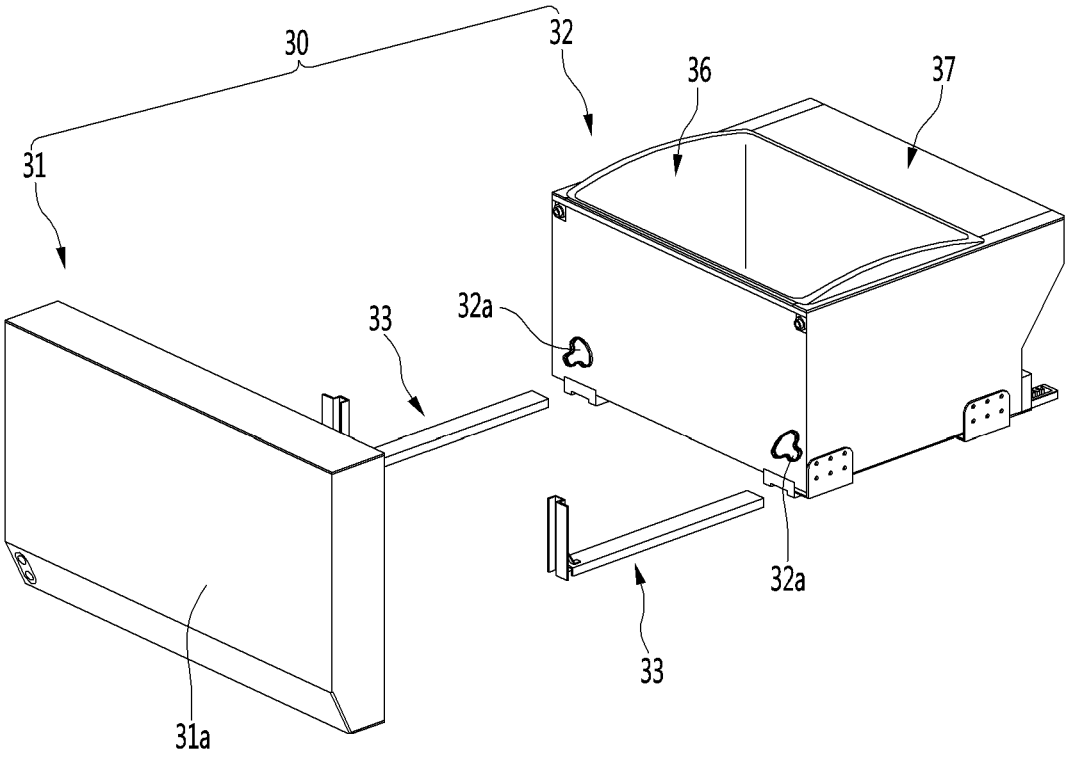
FIG. 6 is a view illustrating a state in which a door part and a drawer part of the drawer door are separated from each other according to an implementation.
Figure 7:
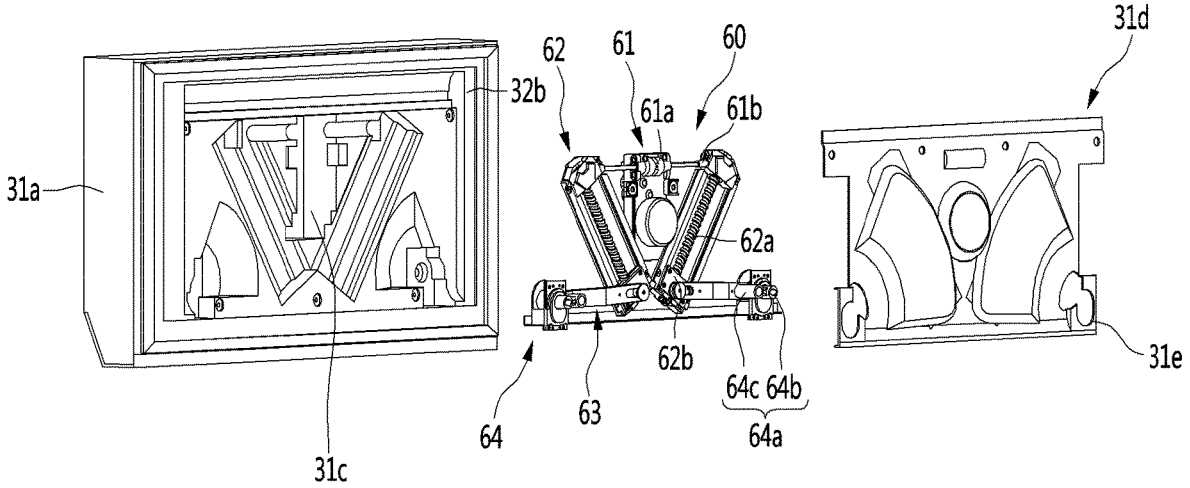
FIG. 7 is an exploded perspective view of the door part according to an implementation.
Figure 8:
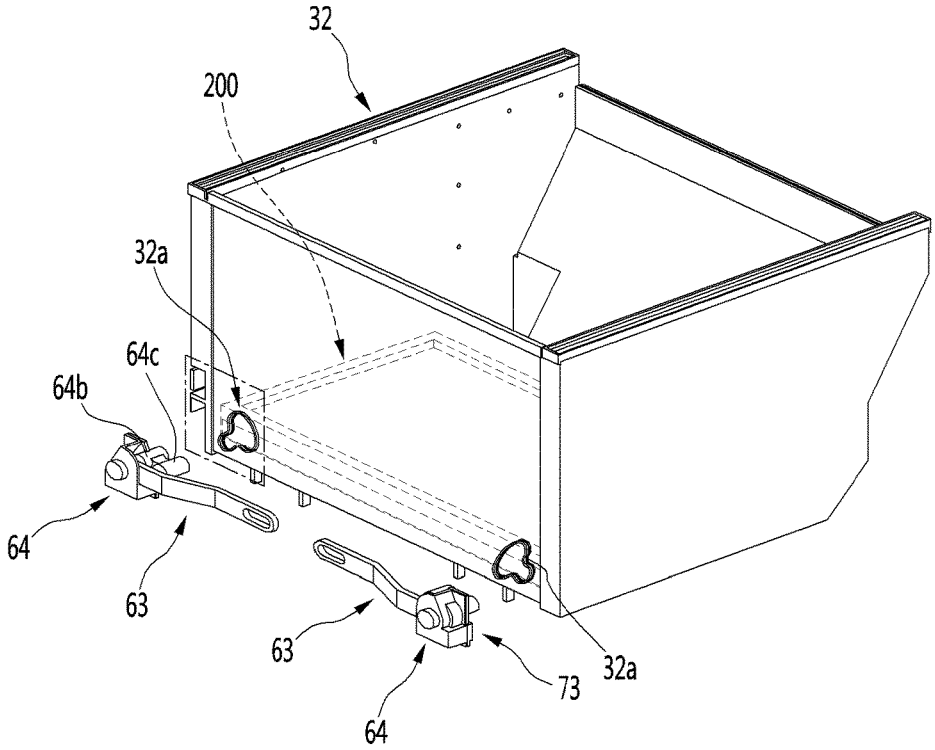
FIG. 8 is a perspective view of the drawer part according to an implementation.

Also, FIG. 6 is a view illustrating a state in which a door part and a drawer part of the drawer door are separated from each other according to an implementation. FIG. 7 is an exploded perspective view of the door part according to an implementation. FIG. 8 is a perspective view of the drawer part according to an implementation.

Figure 9:
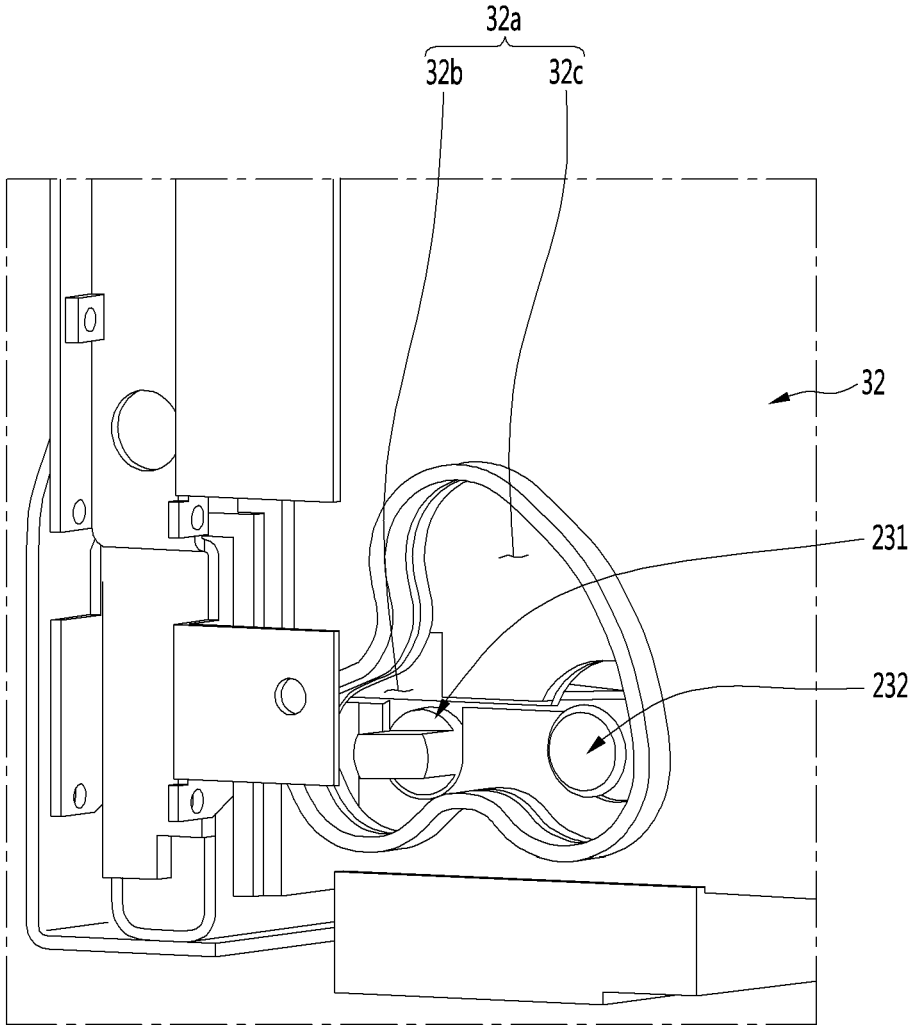
FIG. 9 is a detailed view illustrating a drawer opening of the drawer part according to an implementation.
Figure 10:
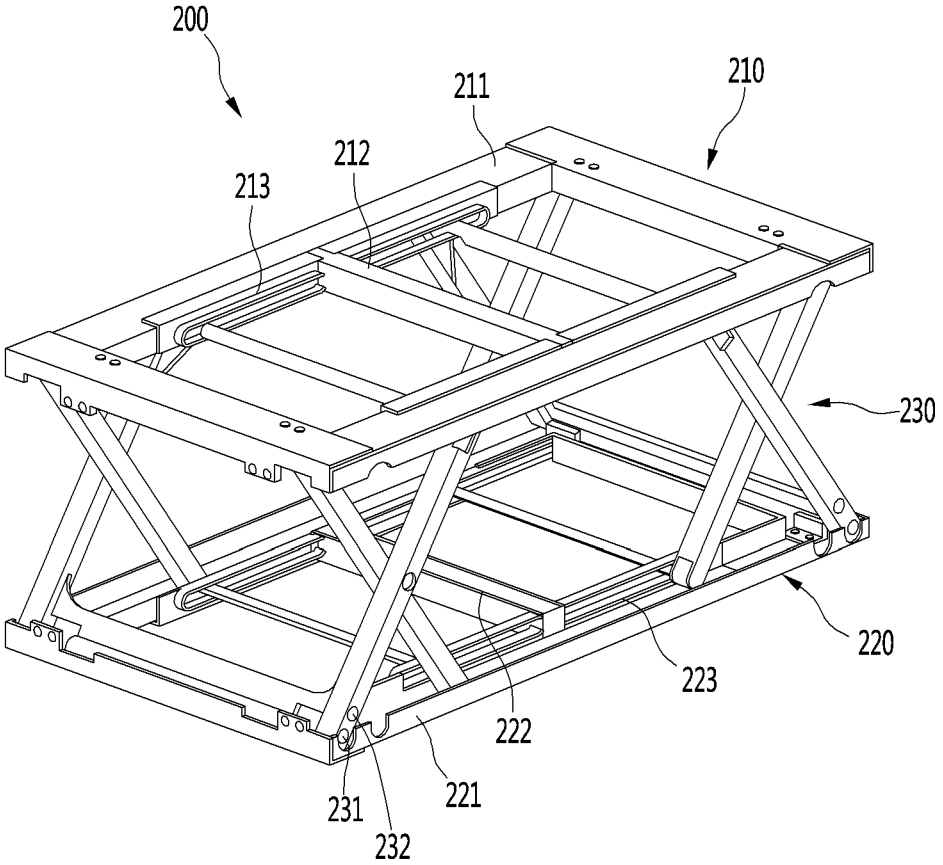
FIG. 10 is a perspective view of an elevation device according to an implementation.

Also, FIG. 9 is a detailed view illustrating a drawer opening of the drawer part according to an implementation. FIG. 10 is a perspective view of an elevation device according to an implementation.

Figure 11:
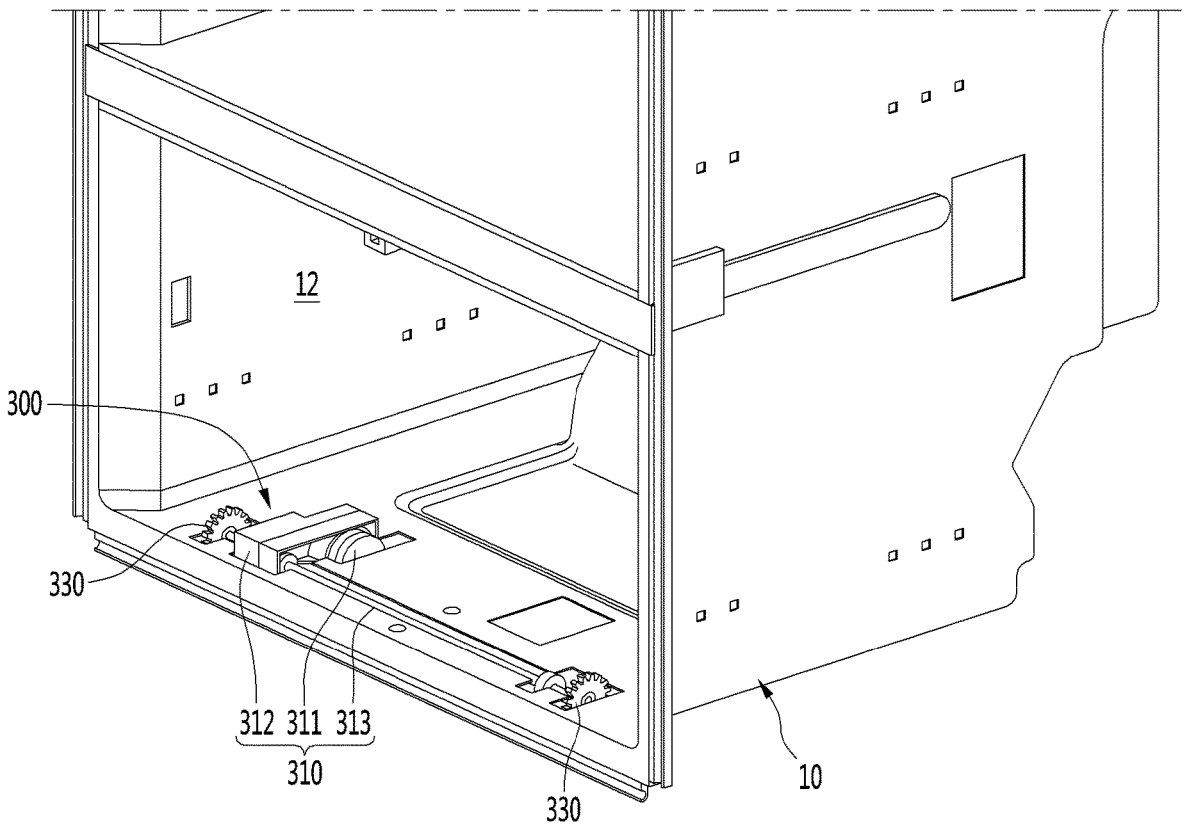
FIG. 11 is a view illustrating a lower storage chamber in a state in which the drawer door is removed according to an implementation.

Also, FIG. 11 is a view illustrating a lower storage chamber in a state in which the drawer door is removed according to an implementation.

A refrigerator 1 according to an implementation includes a cabinet 10 defining a storage space and a door opening or closing the storage space. Here, an outer appearance of the refrigerator 1 may be defined by the cabinet 10 and the door.

The storage space within the cabinet 10 may be provided as one storage chamber or may be partitioned to define a plurality of storage chambers.

For example, the storage space may be vertically partitioned to define an upper storage chamber and a lower storage chamber. Alternatively, the storage space may be partitioned to define a left storage chamber and a right storage chamber.

Here, a portion of the plurality of storage chambers may be a refrigerating compartment in which food is stored in a refrigerated state, and a portion of the plurality of storage chambers may be a freezing compartment in which food is stored in a frozen state. Of course, all of the plurality of storage chambers may be provided as the refrigerating compartment or the freezing compartment. Alternatively, a portion of the plurality of storage chambers may be a rapid cooling chamber or a temperature-variable storage chamber.

As described above, the storage space may be variously provided as necessary.

Hereinafter, the refrigerator 1 in which the storage space is vertically partitioned will be described in detail as an example.

The storage space according to an implementation may be partitioned to define an upper storage chamber 11 and a lower storage chamber 12.

The door may be provided in plurality, and a rotational door 20 that rotates to open and close the storage chambers may be applied as the door. Alternatively, a drawer door 30 that is inserted and withdrawn in a drawer manner to open and close the storage chambers may be applied as the door.

For example, the rotational door 20 may be applied to the upper storage chamber 11. Also, the drawer door 30 may be applied to the lower storage chamber 12.

According to an implementation, although the refrigerator 1 in which all of the rotational door 20 and the drawer door 30 are provided is described, the present implementation is not limited thereto. For example, the present implementation may be applied to all refrigerators including the drawer door that is inserted and withdrawn in the drawer manner.

The rotational door 20 may be hinge-coupled to the cabinet 10 so as to be rotatably mounted.

A display 21 that outputs information may be disposed on a front surface of the rotational door 20. Various information such as an operation state and a temperature of the storage chamber may be outputted through the display 21.

The display 21 may have a liquid crystal display structure or a 88 segment structure. Also, when the outer appearance of the door is made of a metal material, a plurality of fine holes may be punched in the display 21 to display information by light passing therethrough.

The drawer door 30 may be provided on the lower storage chamber 12 and have a structure like a drawer which is capable of being inserted and withdrawn forward and backward.

Here, only one drawer door 30 may be disposed on the lower storage chamber 12, or a plurality of drawer doors 30 may be vertically or horizontally disposed on the lower storage chamber 12. Also, the lower storage chamber 12 may be vertically or horizontally partitioned corresponding to the drawer doors 30 or be provided as one communicating space.

In a state in which the drawer door 30 is withdrawn, a storage space 35 that is opened upward may be exposed. Also, an elevation device 200 that is elevatable may be provided in the drawer door 30. Thus, in the state in which the drawer door 30 is withdrawn, foods or containers accommodated in the drawer door may ascend to allow a user to easily lift the foods or containers.

Also, an elevation driving device 60 providing power for elevating the elevation device 200 may be provided in the drawer door 30.

The drawer door 30 may be provided to be automatically inserted and withdrawn by user's manipulation or specific conditions.

Also, the driving device 60 provided in the drawer door 30 may be driven by the user's manipulation or specific conditions to allow the elevation device 200 to be elevated.

For this, a manipulation device that manipulates the automatic draw-out of the drawer door 30 and the elevation of the elevation device 200 may be provided in the refrigerator 1.

The manipulation device may include a plurality of manipulation parts 22, 38, and 39 that will be described later.

For example, the manipulation part 22 may be disposed on the front surface of the rotational door 20. The manipulation part 22 may be integrated with the display 21 and may operate in a touch manner or a button manner.

Another manipulation part 38 may be further provided in the drawer door 30. The manipulation part 38 may be provided in a touch or button type. The manipulation part 38 may be provided as a sensor detecting proximity or movement of the user or provided as an input unit that operates by a user's motion or voice.

Also, further another manipulation part 39 may be further provided in the drawer door 30. The manipulation part 39 may be a manipulation device configured to irradiate an image to a bottom surface so as to a to output a virtual switch and to input an operation in such a manner in which the user approaches a corresponding area.

The drawer door 30 and the elevation device 200 may be provided to be automatically inserted and withdrawn and elevated by the manipulation parts 22, 38, and 39 disposed on the door.

Here, the draw-out of the drawer door 30 and the elevation of the elevation device 200 may be configured to be separately manipulated.

For example, the manipulation device may be separately manipulated to automatically insert and withdraw the drawer door 30. In the state in which the drawer door 30 is withdrawn, the manipulation device may be separately manipulated to allow the elevation device 200 to be automatically elevated.

Here, in a state in which the drawer door 30 is not completely withdrawn, when the elevation device 200 ascends, the food or container 36 may collide with the cabinet 10 and thus be damaged. For preventing this phenomenon, a draw-out detection device that detects whether the drawer door 30 is completely withdrawn may be further provide in the refrigerator 1.

According to an implementation, although all of the plurality of manipulation parts 22, 38, and 39 are provided in the refrigerator 1, and the manipulation device includes the plurality of manipulation parts 22, 38, and 39, this structure is not limited to the present implementation.

That is, only some of the plurality of manipulation parts 22, 38, and 39 may be provided in the refrigerator 1. Also, only some of the plurality of manipulation parts 22, 38, and 39 may be applied as the manipulation device that manipulates the automatic draw-out and the elevation of the elevation device 200.

The manipulation device and the draw-out detection device may be electrically connected to a control unit that controls an operation of the refrigerator 1 to transmit an inputted signal to the control unit. Also, the control unit may control the automatic draw-out and the elevation of the elevation device 200 according to the signal inputted into the manipulation device.

Here, the control unit may control the elevation device 200 to be elevated only when the completely withdrawn state of the drawer door 30 is detected by the draw-out detection device.

The draw-out of the drawer door 30 and the elevation of the elevation device 200 may not be separately manipulated but be continuously manipulated by being interlocked when the manipulation device is manipulated.

For example, when the drawer door 30 is manipulated by the manipulation device so as to be withdrawn, if the drawer door is automatically completely withdrawn, the elevation device 200 may automatically operate.

Also, when the drawer door 30 is inserted by the manipulation device, the elevation device 200 may automatically descend, and when the descending is completely, the drawer door 30 may be automatically inserted.

In even this case, the draw-out detection device that detects whether the drawer door 30 is completely withdrawn or inserted may be further provided in the refrigerator 1.

The draw-out detection device may be applied to various devices that are capable of detecting the inserted and withdrawn state of the drawer door 30.

For example, the draw-out detection device may be provided as a switch that operates in the state in which the drawer door 30 is completely inserted and withdrawn.

Alternatively, the draw-out detection device may be provided as a device that counts the number of rotation of a motor 311 that will be described or a sensor that measures a distance between a rear surface of the door part 31, which will be described later, and a front end of the cabinet 10 to detect the inserted and withdrawn state of the drawer door 30.

The manipulation device and the draw-out detection device may be electrically connected to the control unit to transmit the inputted signal to the control unit. Also, the control unit may control the automatic draw-out operation of the drawer door 30 according to the inputted signal and control the elevation operation of the elevation device 200 by being interlocked with the automatic draw-out of the drawer door 30.

According to the present implementation, although the structure in which the elevation device 200 is provided in the drawer door 30 is disclosed, the implementation is not limited thereto. For example, the elevation device 200 and the driving device 60 may not be provided in the drawer door 30.

That is, only the structure in which the drawer door 30 is automatically inserted and withdrawn may be applied, and also, the structure in which the elevation device 200 and the driving device are not provided may be applied. In this case, the drawer door 30 may be automatically inserted and withdrawn by the manipulation of the manipulation device, and the user may directly lift the food or container 36 accommodated in the drawer door 30 in the state in which the drawer door 30 is automatically withdrawn.

Hereinafter, the structure of the drawer door 30 and the automatic draw-out of the drawer door 30 will be described in detail.

A separate machine room 13 in which a compressor and a condenser, which constitute a refrigeration cycle may be defined at a rear side of the lower storage chamber 12 in the cabinet 10. The machine room 13 and the lower storage chamber 12 may be partitioned to be insulated from each other by a partition wall 14.

At least a portion of the partition wall 14 that partitions the machine room 13 from the lower storage chamber 12 may be inclined toward the machine room 13 so that a volume of the lower storage chamber 12 is maximally secured. That is, an upper portion of the partition wall 14 may be disposed behind a lower portion thereof.

For example, the partition wall 14 may be inclined upward toward the machine room 13 as a whole. Alternatively, the upper portion of the partition wall 14 may be inclined upward toward the machine room 13.

The drawer door 30 may include a door part 31 that opens and closes the lower storage chamber 12 and a drawer part 32 coupled to a rear surface of the door part 31.

The door part 31 may be exposed to the outside of the cabinet 10 to define an outer appearance of the refrigerator 1.

The drawer part 32 may be disposed inside the lower storage chamber 12 in a state in which the door part 31 covers the lower storage chamber 12.

The door part 31 and the drawer part 32 may be coupled to each other so as to be inserted and withdrawn forward and backward together with each other.

The drawer part 32 may be disposed behind the door part 31 to define a storage space 35 in which the food and the container 36, in which the food is stored, are accommodated. For example, the drawer part 32 may have a bottom surface and a circumference surface extending upward along a circumference of the bottom surface. That is, the drawer part 32 may have a storage space 35 that is opened upward.

The drawer part 32 may have a shape corresponding to an internal shape of the lower storage chamber 12 to maximally secure capacity.

Here, the drawer part 32 may have a rear surface that is inclined upward toward the rear side to correspond to the shape of the partition wall 14. That is, a rear portion of the drawer part 32 may further protrude than an upper end thereof.

The storage space 35 may be divided into a space in which the container 36 is disposed and a space that is defined behind the space. The container 36 may be an exclusive container 36 that is provided together with the elevation device 200 in the drawer part 32.

In detail, the storage space 35 may be divided into a front storage space in which the container 36 is elevatably provided and a rear storage space that is provided behind the front storage space.

Here, the front storage space may be defined as a space that is completely exposed to the outside of the cabinet 10 when the drawer door 30 is automatically withdrawn. The front storage space may be defined as a region of the storage space 35, which is disposed at a front side of a front surface of the rotational door 20 that covers the upper storage chamber 11 in the state in which the drawer door 30 is completely withdrawn.

Also, the rear storage space may be defined as a space that is not exposed to the outside of the cabinet 10 when the drawer door 30 is completely withdrawn.

A separate drawer cover 37 may be provided in the rear storage space. The front storage space and the rear storage space may be partitioned by the drawer door 37. In a state in which the drawer cover 37 is mounted, a space in which the front and top surfaces of the rear storage space are covered so as not to used may be not be exposed to the outside.

However, when the drawer cover 37 is separated, the user may be accessible to the rear storage space to easily accommodate foods in the rear storage space. To utilize the rear storage space, a separate pocket or a separate container having a shape corresponding to that of the rear storage space may be further provided in the rear storage space.

The elevation device 200 may be disposed in the drawer part 32 and also be disposed in the front storage space.

The door part 31 and the drawer part 32 may be coupled by a pair of door frames 33 provided on both sides. Each of the door frames 33 may have one side coupled to the door part 31 and the other side coupled to the drawer part 32.

The outer appearance of the door part 31 may be defined by a door outer case 31*a* defining the front surface and the circumferential surface and a door liner 31*b* defining the rear surface. Also, an insulation material may be filled into the inside of the door part 31 between the door outer case 31*a* and the door liner 31*b*.

A door recess part 31*c* that is recessed inward may be defined in the door liner 31*b*. The door recess part 31*c* may be defined in a shape corresponding to the shape of the driving device 60 that will be described later and may be recessed inside the door part 31.

The door part 31 may further include a door cover 31*d* that covers a rear side of the door recess part 31*c*.

The door cover 31*d* may define an outer appearance of the rear surface of the door part 31 and may cover the driving device 60 mounted on the door recess part 31*c*. The door cover 31*d* may have a plate shape to cover the driving device 60 so that the driving device 60 is not exposed.

A door cover opening 31*e* that is opened to expose a connector 64*a* that will be described later may be defined in the door cover 31*d*. The door cover opening 31*e* may have a shape corresponding to that of a drawer opening 32*a* that will be described later.

The driving device 60 may include an elevation motor assembly 61, a screw assembly 62 disposed on each of both sides of the elevation motor assembly 61, a lever 63 connected to the screw assembly 62, and a connecting assembly 64.

The elevation motor assembly 61 may be disposed at a width center of the door liner 31*b* and also disposed at an upper side.

Also, each of the screw assembly 62, the lever 63, and the connecting assembly 64 may be provided in a pair that are disposed horizontally symmetrical to each other with respect to the elevation motor assembly 61.

The elevation motor assembly 61 may include an elevation motor that is rotatable in forward and reverse and a shaft 61*b* connected to a rotation shaft of the elevation motor 61*a* to rotate by driving of the elevation motor 61*a* and thus to transmit rotation power to the screw assembly 62.

A screw 62*a* having a spiral gear shape along an outer circumferential surface thereof may be rotatably disposed on the screw assembly 62.

An upper end of the screw assembly 62 may be oriented outward, and a lower end of the screw assembly 62 may be inclined inward.

Here, both the screw assemblies 62 may be symmetrical to each other with respect to the motor assembly 61, and the motor assembly 61 may be disposed between both the screw assembles 62. Both the screw assemblies 62 may be disposed to be inclined so that a distance therebetween is gradually narrowed from the upper end to the lower end.

Thus, the screw 62*a* may be disposed to be inclined so that the upper end of the door part 31 is disposed outside the lower end thereof.

The screw assembly 62 may include a screw holder 62*b* that moves along the screw 62*a* when the screw rotates. The screw 62*a* may pass through the screw holder 62*b*, and a spiral gear interlocked with the spiral gear disposed on the screw 62*a* may be disposed on an inner circumferential surface of the screw holder 62*b*.

The connecting assembly 64 may pass through the front surface of the drawer part 32 and then be coupled to the elevation device 200 provided in the drawer part 32. That is, the connecting assembly 64 may provide a function of coupling the elevation device 200 to the driving device 60.

The connecting assembly 64 may be disposed outside the screw assembly 62 in the door liner 31*b*. Also, the connecting assembly 64 may be disposed at a height corresponding to a lower portion of the screw 62*a* in the door liner 31*b*.

One end of the lever 63 may be rotatably mounted on the connecting assembly 64. Also, the other end of the lever 63 may be rotatably mounted on the screw holder 62*b*. That is, the lever 63 may be configured to connect the connecting assembly 64 to the screw holder.

The lever 63 may rotate as the screw holder 62*b* rotates by the rotation of the screw 62*a*. Here, a rotation shaft of the lever 63 may be disposed on one end of the lever 63 coupled to the connecting assembly 64.

When the connecting assembly 64 is disposed at the height corresponding to the lower portion of the screw 62*a*, if the screw holder 62*b* is disposed below the screw 62*a*, the lever 63 may be in a horizontally laid state.

Also, when the screw holder 62*b* moves to the upper portion of the screw 62*a* along the screw 62*a*, the other end of the lever 63 may ascend to be in an erect state.

The connecting assembly 64 may include a connector 64*a* passing through the front surface of the drawer part 32 and then coupled to the elevation device 200.

The connector 64*a* may be rotatable together by the rotation of the lever 63.

The connector 64*a* may include a first connector 64*b* coupled to the rotation shaft of the lever 63 and a second connector 64*c* coupled to one side of the lever 63, which is disposed to be spaced apart from the rotation shaft of the lever 63.

A drawer opening 32*a* through which a portion of the elevation device 200 is exposed may be defined in a position corresponding to the connector 64*a* in the front surface of the drawer part 32.

A scissors rotation shaft 231 and a scissors protrusion 232 of the elevation device 200, which will be described later, may be exposed through the drawer opening 32*a*.

Hereinafter, a structure of the elevation device 200 according to an implementation will be described in detail with reference to FIG. 10.

The elevation device 200 may be disposed on the inner bottom surface of the drawer part 32 and may be detachably disposed on the drawer part 32.

The elevation device 200 may have various structures that are capable of elevating the container 36 within the drawer door 30. For example, the elevation device 200 may have a scissors lift structure.

In detail, the elevation device 200 may include an upper frame 210, a lower frame 220, and a scissors assembly 230 disposed between the upper frame 210 and the lower frame 220.

The upper frame 210 may be mounted on an upper portion of the scissors assembly 230 so as to be elevated by the operation of the scissors assembly 230.

The scissors assembly 230 may include a plurality of link portions that cross each other so as to be rotatably coupled.

An upper end of the scissors assembly 230 may be elevated with respect to a lower end thereof because the link portions are laid or erected. That is, the upper end of the scissors assembly 230 may be elevated with respect to the lower end thereof because the link portions crossing each other are folded or unfolded.

The lower end of the scissors assembly 230 may be rotatably coupled to the lower frame 220. Also, the upper end of the scissors assembly 230 may be rotatably coupled to the upper frame 210.

The upper frame 210 may have a rectangular frame shape having a size corresponding to that of the front storage space of the drawer part 32. A support plate defining a seating surface of the container 36 may be further disposed on a top surface of the upper frame 210.

The upper frame 210 may be a constitute that is vertically movable and substantially supports the food or container 36.

The upper frame 210 may include a frame part 211 defining a circumferential shape of the upper frame 210 and a partition part 212 partitioning the space inside the frame portion 211 into left and right sides.

Since the frame part 211 and the partition part 212 define an outer frame and support the support plate, high strength may be required, and thus, the frame part 211 and the partition part 212 may be made of a metal and may have shape in which both ends are bent to increase the strength and prevent deformation.

Also, a scissors assembly guide 213 in which one end of an upper portion of the scissors assembly 230 is accommodated and which guides movement of the scissors assembly 230 may be disposed on an inner surface of the frame part 211.

The lower frame 220 may have the same structure as that of the upper frame 210 but only in the direction.

The lower frame 220 may include a frame part 221 and a partition part 222.

Also, a scissors assembly guide 223 in which one end of a lower portion of the scissors assembly 230 is accommodated and which guides movement of the scissors assembly 230 may be disposed on an inner surface of the frame part 221.

The upper frame 210 and the lower frame 220 may accommodate the scissors assembly 230 in a state in which the scissors assembly 230 is completely folded.

The scissors rotation shaft 231 coupled to the connector 64*a* and the scissors protrusion 232 may be disposed on a lower end of the scissors assembly 230.

The scissors rotation shaft 231 may be a rotation shaft that is provided by rotatably mounting the lower end of the scissors assembly 230 on the lower frame 220.

The scissors protrusion 232 may be disposed at a position of the lower end of the scissors assembly, which is spaced apart from the scissor rotation shaft 231.

The first connector 64*b* may be coupled to the scissors rotation shaft 231 through the drawer opening 32*a*. Also, the second connector 64*c* may be coupled to the scissors protrusion 232 through the drawer opening 32*a*.

The drawer opening 32*a* may be constituted by a drawer opening central part 32*b* and a trajectory part 32*c*.

The drawer opening central part 32*b* may be disposed at a position corresponding to the scissors rotation shaft 231 and have a size that is enough to insert the first connector 64*b* therein.

The trajectory part 32*c* may be connected to the drawer opening central part 32*b* and have a shape corresponding to a trajectory along which the second connector 64*c* moves by rotation thereof.

When the lever 63 rotates by the driving of the elevation motor 61*a*, the connector 64*a* coupled to the lever 63 may rotate.

Also, the scissors assembly 230 coupled to the connector 64*a* may operate by the rotation of the connector 64*a*. Here, as the elevation motor 61*a* rotates, the scissors assembly 230 may be folded or unfolded.

Thus, the elevation device may be elevated. Also, the food or container 36 seated on the elevation device 200 may be elevated.

The control unit may drive the elevation motor 61*a* in forward when the ascending of the elevation device 200 is required. Also, the control unit may drive the elevation motor 61*a* in reverse when the descending of the elevation device 200 is required.

A draw-out rail 40 that guides the draw-out of the drawer door 30 may be coupled to the drawer part 32.

The draw-out rail 40 may be disposed on each of both side surfaces of the lower storage chamber 12. Also, the draw-out rail 40 may have a rail structure that is extendable in multi-stage, and the extending side of the draw-out rail 40 may be coupled to a side surface of the drawer part 32.

Thus, the drawer door 30 may be withdrawably coupled to the cabinet 10 by the extension and contraction of the draw-out rail 40.

Here, the draw-out rail 40 may be coupled to a lower end of each of both surfaces of the drawer part 32. Thus, it may be understood that the draw-out rail 40 is coupled to the bottom surface of the drawer part 32. The draw-out rail 40 may be called an under rail coupled to the bottom surface of the drawer part 32.

A driving device 300 that provides power for automatically inserting and withdrawing the drawer door 30 may be provided in the lower storage chamber 12. Also, a rack gear assembly 400 interlocked with the driving device 300 may be disposed in the drawer door 30.

The rack gear assembly 400 may be disposed on the bottom surface of the drawer door 30 so as not to be exposed to the outside when the drawer door 30 is withdrawn.

Also, the driving device 300 may be disposed on the bottom surface of the lower storage chamber 12 to correspond to the position of the rack gear assembly 400. That is, the driving device 300 may be disposed on a lower wall of the lower storage chamber 12, which defines the bottom surface of the lower storage chamber 12. Here, at least a portion of the driving device 300 may be provided to be buried in the lower wall of the lower storage chamber 12.

Hereinafter, an interlocked structure between the driving device 300 provided in the lower storage chamber 12 and the rack gear assembly 400 provided in the drawer door 30 will be described in more detail with reference to the accompanying drawings.

The driving device 300 may include a motor assembly 310 and a pinion 330 rotating by driving of the motor assembly 310.

In detail, the motor assembly 310 may include a motor 311 of which a rotation shaft is rotatable in forward and reverse. The motor 311 may be electrically connected to the control unit so as to be controlled to rotate in forward and reverse.

The motor assembly 310 may include a gear box 312. One or more rotation gears may be provided in the gear box 312. The rotation gear provided in the gear box 312 may function as a reduction gear for reducing the number of rotation the motor 311 and increasing rotation force of the motor 311.

The motor 311 may be coupled to one side of the gear box 312. Also, the rotation shaft of the motor 311 may be coupled to the rotation gear provided in the gear box 312 to transmit power to the rotation gear.

The motor assembly 310 may include a transmission portion 313 that is connected to the rotation gear provided in the gear box 312 to transmit power to the pinion 330.

The transmission portion 313 may have a bar shape having a predetermined length. Also, the transmission portion 313 may pass through the gear box 312, or one end of the transmission portion 313 may be inserted into the gear box 312 and coupled to the rotation gear.

The transmission portion 313 may be coupled to the rotation gear to rotate in forward and reverse according to the forward and reverse rotation of the motor 311.

The pinion 330 may be coupled to an end of the transmission portion 313 protruding to the outside of the gear box 312.

Like the present implementation, when the pair of pinions are disposed to be horizontally spaced apart from each other, the motor assembly 310 may be disposed between the pair of pinions 330.

Also, the transmission portion 313 may pass through the gear box 312 so that both ends thereof protrude to both left and right sides of the gear box 312.

Also, the left pinion of the pair of pinions 330 may be coupled to a left end of the transmission portion 313, and the right pinion may be coupled to a right end of the transmission portion 313.

Here, since the pair of pinions 330 are coupled to one transmission portion 313, when the motor 311 rotates in forward and reverse, the pair of pinions 330 may rotate at the same rate and direction as each other.

The motor assembly 310 is not limited to an implementation. For example, the motor assembly 310 may have various structures that are capable of transmitting the rotation force of the pinion 330 by the driving of the motor 311.

For example, the motor assembly 310 may be constituted by only the motor 311 and the pinion 330. That is, the pinion 330 may be directly coupled to the rotation shaft of the motor 311 to rotate by the driving of the motor 311.

Also, the motor 311 may be provided to correspond to the number of pinions 330 so that one pinion 330 rotates.

The rack gear assembly 400 that is gear-coupled to the pinion 330 may be provided in the drawer door 30.

The rack gear assembly 400 may be coupled to the bottom surface of the drawer door 30. Also, the rack gear assembly 400 may lengthily extend in the draw-out direction of the drawer door 30.

The rack gear 401 that is gear-coupled to the pinion 330 may be disposed on the rack gear assembly 400. The rack gear 401 may be disposed on a bottom surface of the rack gear assembly 400.

The rack gear 401 may lengthily extend in the draw-out direction of the drawer door 30. For example, the rack gear 401 may be disposed on the bottom surface of the rack gear assembly 400 to lengthily extend forward and backward and also extend from the front end to the rear end of the rack gear assembly 400.

The rack gear assembly 400 may be provided in number corresponding to the number of pinions 330 and disposed corresponding to the pinion 330.

For example, the rack gear assembly 400 may be provided in a pair so that the pair of rack gear assemblies 400 are disposed on the bottom surface of the drawer door 30 so as to be spaced apart from each other in the horizontal direction. Here, the pair of rack gear assemblies 400 may be disposed on left and right ends of the bottom surface of the drawer door 30.

Also, the pair of pinions 330 may be disposed to correspond to the pair of rack gears 401 disposed on the pair of rack gear assemblies 400. Thus, the rack gear 401 disposed on the left rack gear assembly 400 may be gear-coupled to the left pinion 330. Also, the rack gear 401 disposed on the right rack gear assembly 400 may be gear-coupled to the right pinion 330.

As the automatic withdrawal distance of the drawer door 30 increases, user's convenience may be improved.

In detail, as the drawer door 30 more exposes the storage space 35 to the outside of the lower storage chamber 12, the food or container 36 may be easily inserted into or withdrawn from the storage space 35. Also, the larger food or container 36 may be accommodated in the storage space 35.

Particularly, in the structure in which the container 36 automatically ascends when the drawer door 30 is withdrawn, as the storage space 35 is more exposed, the container 36 may more increase in size. That is, when the container 36 ascends, a critical size of the container 36 that does not interfere with the cabinet 10 may increase.

Thus, as the withdrawal distance of the drawer door 30 increases, the container 36 may increases in size. Thus, the user may store a more amount of foods in the container 36 to improve use convenience.

To allow the drawer door 30 to increase in automatic withdrawal distance, the pinion 330 of the driving device 300 may be disposed closer to the front end of the lower storage chamber 12.

Also, the more the rack gear 401 interlocked with the pinion increases in length, the more the automatic withdrawal distance of the drawer door 30 may increase.

That is, as the pinion 330 is disposed closer to the front end of the lower storage chamber 12, and the forward and backward extending length of the rack gear 401 increases, the gear coupling between the pinion 330 and the rack gear 401 may be maintained. Thus, the automatic withdrawal distance of the drawer door 30 may increase due to the interlocking between the pinion 330 and the rack gear 401.

To allow the drawer door 30 to increase in automatic withdrawal distance, the pinion 330 may be disposed on the front end of the lower storage chamber 12.

In detail, the motor assembly 310 may be disposed on the front end of the bottom surface of the lower storage chamber 12. Also, the transmission portion 313 may be horizontally disposed on the front end of the lower storage chamber 12.

Also, the pair of pinions 330 disposed on both ends of the transmission portion 313 may be disposed to be spaced apart from each other in the horizontal direction on the front end of the lower storage chamber 12.

The rack gear assembly 400 may have a length corresponding to a longitudinal length of the bottom surface of the drawer part 32.

Also, the front end of the rack gear assembly 400 may be disposed on the front end of the bottom surface of the drawer part 32 in the state of being mounted on the bottom surface of the drawer part 32. Also, the rear end of the rack gear assembly 400 may be disposed on the rear end of the bottom surface of the drawer part 32.

Also, the rack gear 401 may be disposed from the front end to the rear end of the bottom surface of the rack gear assembly 400.

Thus, in the state in which the drawer door 30 is completely inserted, the pinion 330 may be gear-coupled to the front end of the rack gear 401.

Also, when an automatic withdrawal command of the drawer door 30 is inputted, the pinion 330 may rotate forward to allow the rack gear 401 to move forward. Thus, the drawer door 30 may be automatically withdrawn.

Also, when the pinion 330 is disposed at the rear end of the rack gear 401, the completion of the withdrawal of the drawer door 30 may be detected by the draw-out detection device. Also, the rotation of the pinion 330 may be stopped, and the automatic withdrawal of the drawer door 30 may be completed by the control of the control unit.

Also, when the automatic withdrawal command of the drawer door 30 is inputted, the pinion 330 may rotate reversely to allow the rack gear 401 to move backward. Thus, the drawer door 30 may be automatically inserted.

Also, when the pinion 330 is disposed at the front end of the rack gear 401, the completion of the insertion of the drawer door 30 may be detected by the draw-out detection device. Also, the rotation of the pinion 330 may be stopped, and the automatic insertion of the drawer door 30 may be completed by the control of the control unit.

To allow the drawer door to increase in automatic withdrawal distance, the rack gear assembly 400 may extend backward to increase in length when the drawer door 30 is withdrawn. Also, the rack gear assembly 400 may decrease in extension length when the drawer door 30 is inserted.

Also, the rack gear 401 may increase and decrease in length as the rack gear assembly 400 increase and decrease in length.

As the rack gear 401 increases in length when the drawer door 30 is withdrawn, the withdrawal distance of the drawer door 30 may increase. Also, when the drawer door 30 is inserted, as the rack gear 401 decreases in length, an interference between the rack gear assembly 400 and the partition wall 14 may be prevented.

In detail, to secure maximum storage capacity of the drawer part 32, the drawer part 32 may have a shape and size corresponding to the internal shape of the lower storage chamber 12. Thus, in the state in which the drawer door 30 is inserted, the rear surface of the drawer part 32 may contact or be adjacent to the partition wall 14 defining the rear wall of the lower storage chamber 12.

Here, as the rear surface of the drawer part 32 contacts or be adjacent to the partition wall 14, a space, in which the rack gear assembly 400 is further extendable backward than the rear surface of the drawer part 32, may be secured.

That is, when the rear end of the rack gear assembly 400 further extends backward than the rear surface of the drawer part 32, the rear end of the rack gear assembly 400 and the partition wall 14 may interfere with each other so that the drawer door 30 does not closed.

Thus, in consideration of the insertion of the drawer door 30, the rear end of the rack gear assembly 400 may be limited in length that is extendable up to the rear surface of the drawer part 32.

Here, when it is impossible to adjust the length of the rack gear assembly 400, the rack gear assembly 400 may be limited in length, and thus, the automatic withdrawal distance of the drawer door 30 may not be sufficiently secured.

In detail, when it is impossible to adjust the length of the rack gear assembly 400, a rear space of the drawer part 32 may be disposed inside the lower storage chamber 12 in the state in which the pinion 330 is disposed on the rear end of the rack gear 401. That is, the rear space of the lower storage chamber 12 may not be sufficiently withdrawn to the outside of the lower storage chamber 12 to deteriorate the use convenience.

Particularly, according to the present implementation, when a power portion of the partition wall 14 further protrudes forward from an upper portion thereof, a longitudinal length H1 of the upper space of the lower storage chamber 12 may be less than that H2 of the lower space of the lower storage chamber 12. Thus, the longitudinal length of the upper portion of the drawer part 32 may be less than that of the lower portion of the drawer part 32.

In this case, a longitudinal length of the bottom surface of the drawer part 32 may more decrease. Also, when considering the insertion of the drawer door 30, the rack gear assembly 400 may be limited to more decrease in length.

Here, when it is impossible to adjust the length of the rack gear assembly 400, the automatic withdrawal distance of the drawer door 30 may more decrease. Also, more wide rear space of the lower storage chamber may not be withdrawn to the outside of the lower storage chamber 12. Thus, the use convenience may be more significantly deteriorated.

The rack gear assembly 400 according to an implementation may allow the rack gear assembly 400 to extend and be contracted, thereby preventing the rack gear assembly 400 and the partition wall 14 from interfering with each other and also allowing the drawer door 30 to significantly increase in automatic withdrawal distance.

In detail, when the drawer door 30 is withdrawn, the rack gear assembly 400 may extend in length. Here, the rear end of the rack gear assembly 400 may further move backward than the rear surface of the drawer part 32.

Also, as the rack gear assembly 400 extends in length, the rack gear 401 may also extend in length.

Thus, the automatic withdrawal distance of the drawer door 30 may significantly increase to improve the use convenience. Also, even in the structure in which the bottom surface of the drawer part 32 has a relatively short length, the automatic withdrawal distance of the drawer door 30 may be sufficiently secured to significantly secure the use convenience.

Also, when the drawer door 30 is inserted, the rack gear assembly 400 may decrease in length. Here, the rear end of the rack gear assembly 400 may move forward up to a position at which the rack gear assembly 400 does not interfere with the partition wall 14.

For example, the rear end of the rack gear assembly 400 may gradually move forward when the drawer door 30 is inserted. Also, when the drawer door 30 is completely inserted, the rear end of the rack gear assembly 400 may be disposed adjacent to or in the same line as the rear end of the bottom surface of the drawer door 30.

Thus, when the drawer door 30 is inserted, the rack gear assembly 400 and the partition wall 14 may interfere with each other to prevent the drawer door 30 from being completely closed.

A guide 50 that is selectively restricted to the rack gear assembly 400 so that the rack gear assembly 400 increases and decreases in length when the drawer door 30 is inserted and withdrawn may be disposed at one side of the lower storage chamber 12.

The guide 50 may be disposed on the side surface or the bottom surface of the lower storage chamber 12. Alternatively, the guide 50 may be disposed on one side of the draw-out rail 40.

Also, the guide 50 may protrude toward one side of the rack gear assembly 400.

The guide 50 may be coupled to one side of the rack gear assembly 400 when the drawer door 30 is withdrawn so that the rack gear assembly 400 operate to extend in length. The guide 50 may be coupled to one side of the rack gear assembly 400 when the drawer door 30 is withdrawn so that the rack gear assembly 400 operates to decrease in length.

The selective coupling structure between the guide 50 and the rack gear assembly 400 may be will be described below in more detail.

Hereinafter, a structure and operation of the rack gear assembly 400 according to an implementation will be described in more detail with reference to the accompanying drawings.

Figure 12:
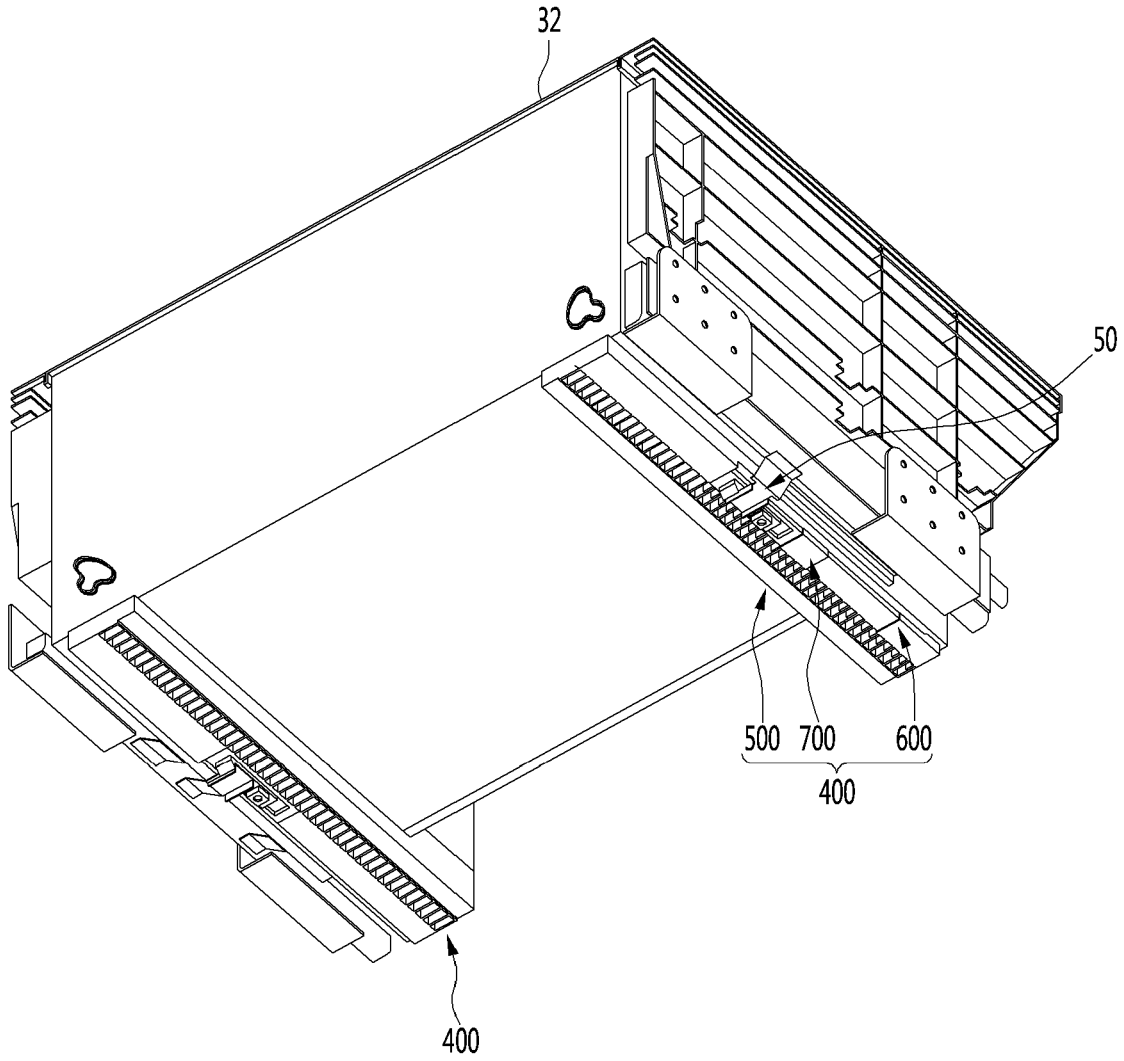
FIG. 12 is a perspective view of the drawer part on which a rack gear assembly is mounted according to an implementation.
Figure 13:
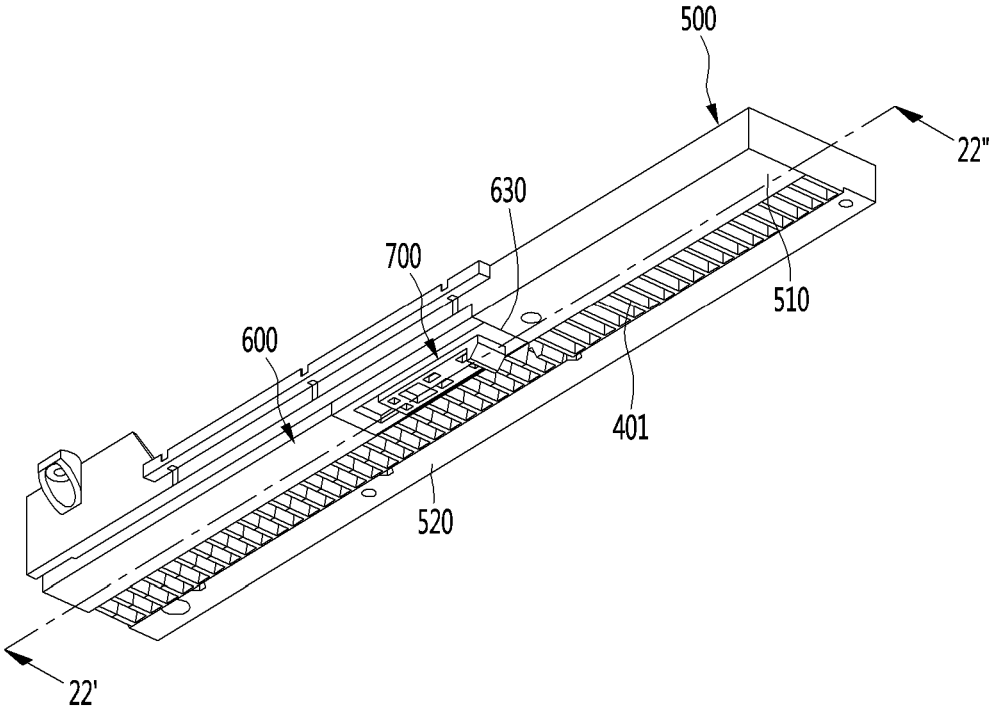
FIG. 13 is a view illustrating the rack gear assembly in a state of maximally decreasing in length according to an implementation.
Figure 14:
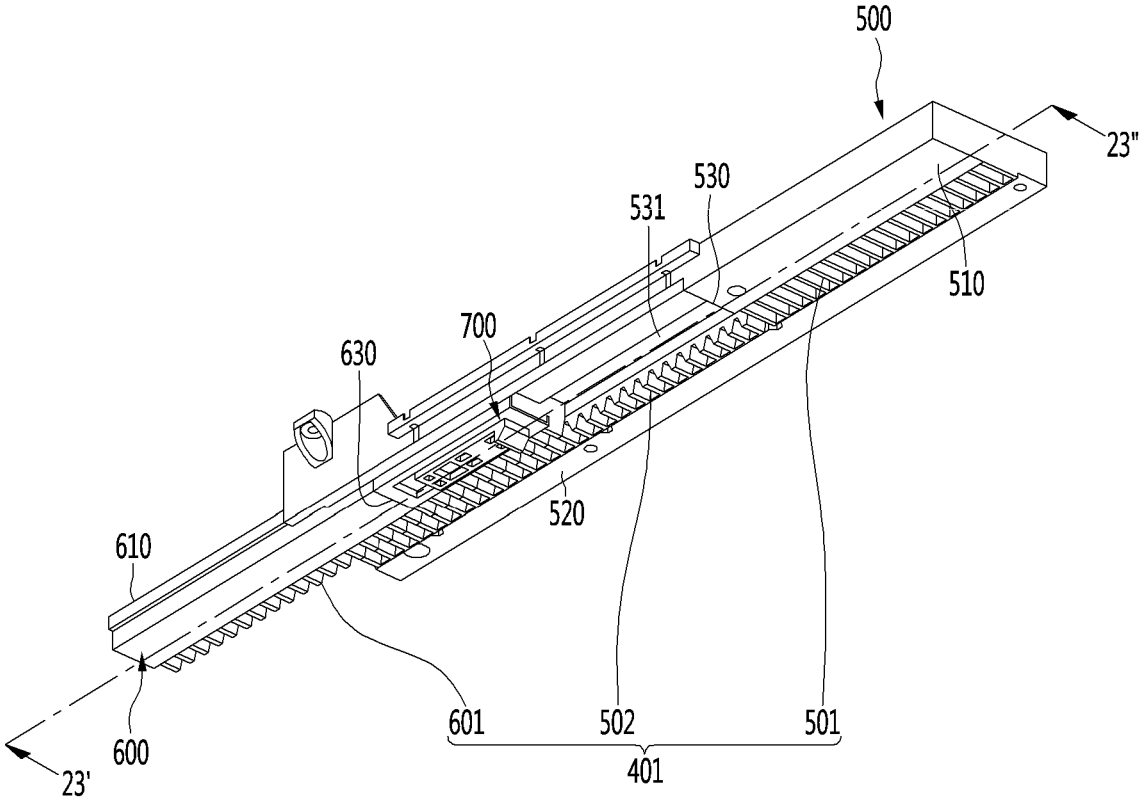
FIG. 14 is a view of the rack gear assembly in a state of maximally extending in length according to an implementation.

FIG. 12 is a perspective view of the drawer part on which the rack gear assembly is mounted according to an implementation. FIG. 13 is a view illustrating the rack gear assembly in a state of maximally decreasing in length according to an implementation. FIG. 14 is a view of the rack gear assembly in a state of maximally increasing in length according to an implementation.

The rack gear assembly 400 may include a fixed rack portion 500, a moving rack portion 600, and a fixing assembly 700.

The fixed rack portion 500 may be mounted and fixed to the bottom surface of the drawer part 32.

The moving rack portion 600 may be provided to be slidable in the draw-out direction of the drawer door 30 on the fixed rack portion 500.

The moving rack portion 600 may move to be slidable backward from the fixed rack portion 500 when the drawer door 30 is withdrawn so that the total length of the rack gear assembly 400 increases. That is, the moving rack portion 600 may be withdrawn backward from the fixed rack portion 500 when the drawer door 30 is withdrawn so that the rear end of the moving rack portion 600 further protrudes backward than the rear end of the fixed rack portion 500.

The rack gear 401 may be provided together with the fixed rack portion 500 and the moving rack portion 600. Thus, the moving rack portion 600 may slidably move to increase and decrease in length.

The fixing assembly 700 may be disposed on one side of the moving rack portion 600. Also, the fixing assembly 700 may provide a function of selectively fixing the fixed rack portion and the moving rack portion 600.

The fixing assembly 700 may fix the moving rack portion 600 to the fixed rack portion 500 when the length of the rack gear assembly 400 maximally extends. Thus, the state in which the length of the rack gear assembly 400 maximally extends may be maintained.

Also, the fixing assembly 700 may release the fixed state between the moving rack portion 600 and the fixed rack portion 500 so that the moving rack portion 600 slidably moves when the drawer door 30 is inserted. That is, the length of the rack gear assembly 400 may decrease.

The fixing assembly 700 may be coupled to the guide 50 when the drawer door 30 is withdrawn. Thus, when the drawer door 30 is withdrawn, the moving rack portion 600 on which the guide 50 is disposed may be restricted to the guide 50.

Since the moving rack portion 600 is restricted to the guide 50, when the drawer door 30 is withdrawn, the fixed rack portion 500 may be withdrawn together with the drawer door 30, and the moving rack portion 600 may be restricted to the guide 50 and thus may not be withdrawn. That is, the moving rack portion 600 may move backward with respect to the fixed rack portion 500.

Also, the fixing assembly 700 may be coupled to the guide 50 when the drawer door 30 is inserted. Thus, when the drawer door 30 is inserted, the moving rack portion 600 on which the guide 50 is disposed may be restricted to the guide 50.

Since the moving rack portion 600 is restricted to the guide 50, when the drawer door 30 is inserted, the fixed rack portion 500 may be inserted together with the drawer door 30, and the moving rack portion 600 may be restricted to the guide 50 and thus may not be inserted. That is, the moving rack portion 600 may move forward with respect to the fixed rack portion 500.

Thus, when the drawer door 30 is inserted and withdrawn, the length of the rack gear assembly 400 may extend, and the thus, the withdrawal distance of the drawer door 30 may increase.

Also, when the drawer door 30 is inserted, the rack gear assembly 400 may decrease in length, and the interference between the rack gear assembly 400 and the partition wall 14 may be prevented.

Hereinafter, structures of the fixed rack portion 500, the moving rack portion 600, and the fixing assembly 700 will be described in more detail with reference to the accompanying drawings.

The fixed rack portion 500 may lengthily extend in the draw-out direction of the drawer door 30.

The fixed rack portion 500 may have a longitudinal length corresponding to that of the bottom surface of the drawer part 32. Also, the fixed rack portion 500 may have a predetermined horizontal width. Here, the fixed rack portion 500 may have a horizontal width greater than that of the pinion 330.

The moving rack coupling part 530 to which the moving rack portion 600 is coupled may be disposed on one side of the fixed rack portion 500. The moving rack coupling part 530 may accommodate the moving rack portion 600.

The moving rack coupling part 530 may be recessed by a size corresponding to the moving rack portion 600 in the bottom surface of the fixed rack portion 500. Also, the moving rack portion 530 may be opened backward so that the moving rack portion 600 is capable of being withdrawn backward.

The moving rack portion 600 may lengthily extend in the draw-out direction of the drawer door 30. That is, the moving rack portion 600 may lengthily extend forward and backward. Also, the moving rack portion 600 may have a predetermined horizontal width.

Here, the moving rack portion 600 may have a longitudinal length less than that of the fixed rack portion 500. Also, the moving rack portion 600 may have a horizontal width less than that of the fixed rack portion 500. Thus, the moving rack coupling part 530 may be disposed on a portion of the bottom surface of the fixed rack portion 500.

In more detail, the moving rack coupling part 530 may have a longitudinal length greater than that of the fixed rack portion 500. Also, the moving rack coupling portion 530 may have a horizontal width less than that of the fixed rack portion 500.

Also, the moving rack coupling part 530 may be disposed from the rear end of the bottom surface of the fixed rack portion 500. Thus, the moving rack coupling portion 530 may be opened backward so that the moving rack portion 600 is capable of being withdrawn backward.

The moving rack portion 600 may have a thickness corresponding to a recessed depth of the moving rack coupling part 530. Thus, the bottom surface of the moving rack portion 600 and the bottom surface of the fixed rack portion 500 may be disposed on the same plane.

That is, the moving rack portion 600 may be disposed on a portion of the bottom surface of the rack gear assembly 400 in a state of being mounted on the moving rack coupling part 530. Alternatively, the bottom of the rack gear assembly 400 may be defined by the bottom surfaces of the fixed rack portion 500 and the moving rack portion 600.

The rack gear 401 may be lengthily disposed forward and backward along the bottom surface of the rack gear assembly 400. Here, the rack gear 401 may extend from the front end to the rear end of the bottom surface of the rack gear assembly 400. That is, the rack gear 401 may be provided as a plurality of gear teeth arranged in a line. The plurality of gear teeth may be disposed from the front end to the rear end of the bottom surface of the rack gear assembly 400.

The rack gear 401 may be provided together on the fixed rack portion 500 and the moving rack portion 600.

In detail, the rack gear 401 may extend from the front end to the rear end of the bottom surface of the rack gear assembly 400. Here, the rack gear 401 may be horizontally divided to form two columns at a position at which the fixed rack portion 500 and the moving rack portion 600 are disposed parallel to each other. Also, one column of the two columns may be disposed on the moving rack portion 600, and the other column may be disposed on the fixed rack portion 500.

The bottom surface of the fixed rack portion 500 may be divided into front and rear surfaces with respect to the front end of the moving rack coupling part 530, i.e., be divided into a first fixed rack formation surface 510 and a second fixed rack formation surface 520.

The first fixed rack formation surface 510 may be defined as a bottom area of the fixed rack portion 500, which is disposed at a front side with respect to a front end of the moving rack coupling part 530.

The second fixed rack formation surface 520 may be defined as a bottom area of the fixed rack portion 500, which is disposed at a rear side of the first fixed rack formation surface 510. That is, the second fixed rack formation surface 520 may be a bottom area of the fixed rack portion 500, which is disposed at a rear side with respect to a front end of the moving rack coupling part 530.

For example, the first fixed rack formation surface 510 may be a front area of the bottom surface of the fixed rack portion 500. Also, the second fixed rack formation surface 520 may be a rear area of the bottom surface of the fixed rack portion 500.

Also, the moving rack coupling part 530 may be disposed on a portion of the second fixed rack formation surface 520. Here, the moving rack coupling part 530 may have a horizontal width less than that of the second fixed rack formation surface 520. Thus, an area on which the rack gear 401 is disposed at a side of the moving rack coupling part 530 may be secured on the second fixed rack formation surface 520.

The rack gear 401 may include a first fixed rack 501 disposed on the first fixed rack formation surface 510, a second fixed rack 502 disposed on the second fixed rack formation surface 520, and a moving rack 603 disposed on the moving rack portion 600.

The first fixed rack 501 may extend from a front end to a rear end of the first fixed formation surface 510.

The second fixed rack 502 may extend from a front end to a rear end of the second fixed formation surface 520. Here, the second fixed rack 502 may be disposed at a side of the moving rack coupling part 530 on the second fixed rack formation surface 520. Also, the second fixed rack 502 may be disposed to contact a side end of the moving rack coupling part 530.

The moving rack 601 may be disposed on the bottom surface of the moving rack portion 600. The moving rack 601 may extend from the front end to the rear end of the bottom surface of the moving rack portion 600.

The bottom surface of the moving rack portion 600 may be called a moving rack formation surface.

The moving rack portion 600 and the second fixed rack formation surface 520 may have the same longitudinal length. Also, the second fixed rack 502 and the moving rack 601 may have the same longitudinal length.

When the moving rack portion 600 is disposed at a maximally moving initial position, the second fixed rack 502 and the moving rack 601 may be disposed parallel to each other.

Here, in the initial position of the moving rack portion 600, the moving rack portion 600 may maximally move forward along the moving rack coupling part 530. Here, the length of the rack gear assembly 400 may be defined as the shortest state.

When the moving rack portion 600 is disposed at the initial position, the second fixed rack 502 and the moving rack 601 may be horizontally disposed, and side surfaces thereof may contact each other or be adjacent to each other. Also, the gear teeth of the second fixed rack 502 and the teeth of the moving rack 601 may be horizontally arranged parallel to each other. That is, the gear teeth of the second fixed rack 502 and the gear teeth of the moving rack 601 may be aligned symmetrical to each other.

The first fixed rack 501 may have a horizontal width corresponding to that of the pinion 330.

Also, the first fixed rack 501 may have a horizontal width that is equal to the sum of horizontal widths of the second fixed rack 502 and the moving rack 601. Here, each of the horizontal widths of the second fixed rack 502 and the moving rack 601 may be a half of the horizontal width of the first fixed rack 501.

Also, the second fixed rack 502 and the moving rack 601 may be disposed in an extension line of the first fixed rack 501. For example, when the second fixed rack 502 is disposed at a left side of the moving rack 601, the second fixed rack 502 may be disposed in a line with a left half portion of the first fixed rack 501. Also, the moving rack 601 may be disposed in a line with a right half portion of the first fixed rack 501.

Thus, when the moving rack portion 600 is disposed at the initial position, the first fixed rack 501, the second fixed rack 502, and the moving rack 601 may constitute the rack gear 401 having a shape that extends forward and backward from the bottom surface of the rack gear assembly 400 by a predetermined width.

Also, when the moving rack portion 600 slidably moves backward, the moving rack 601 may move backward. Thus, the total length of the rack gear assembly 400 may increase, and also, the total length of the rack gear 401 may increase.

A moving guide 610 may be disposed on each of both side surfaces of the moving rack portion 600. The moving guide 610 may protrude from each of both the side surfaces of the moving rack portion 600. Also, the moving guide 610 may extend from a front end to a rear end of the side surface of the moving rack portion 600.

Also, a moving guide mounting part 531 that guide the movement of the moving guide 610 may be disposed on the moving rack coupling part 530.

The moving guide mounting part 531 may be recessed from each of both side surfaces of the inside of the moving rack coupling part 530 to accommodate the moving guide 610. The moving guide mounting part 531 may extend from a front end to a lower end of each of both the side surfaces of the inside of the moving rack coupling part 530.

Thus, the moving guide 610 may be inserted into the moving guide mounting part 531 so as to be guided along the guide groove 531 forward and backward. Thus, the moving rack portion 600 may be mounted slidable forward and backward on the moving rack coupling part 530.

Alternatively, the moving guide mounting part 531 may protrude, and the moving guide 610 may be recessed to accommodate the moving guide mounting part 531.

The moving rack portion 600 may have a horizontal width greater than that of the moving rack 601.

Also, a fixing assembly mounting part 630 on which the fixing assembly 700 is mounted may be disposed on a side of the moving rack 601 on the bottom surface of the moving rack portion 600.

The fixing assembly mounting part 630 may be disposed on a front end of the bottom surface of the moving rack portion 600.

The fixing assembly mounting part 630 may be recessed from the bottom surface of the moving rack portion 600 to accommodate at least a portion of the fixing assembly 700.

Hereinafter, a configuration of the rack gear assembly 400 will be described in more detail with reference to the accommodating drawings.

Figure 15:
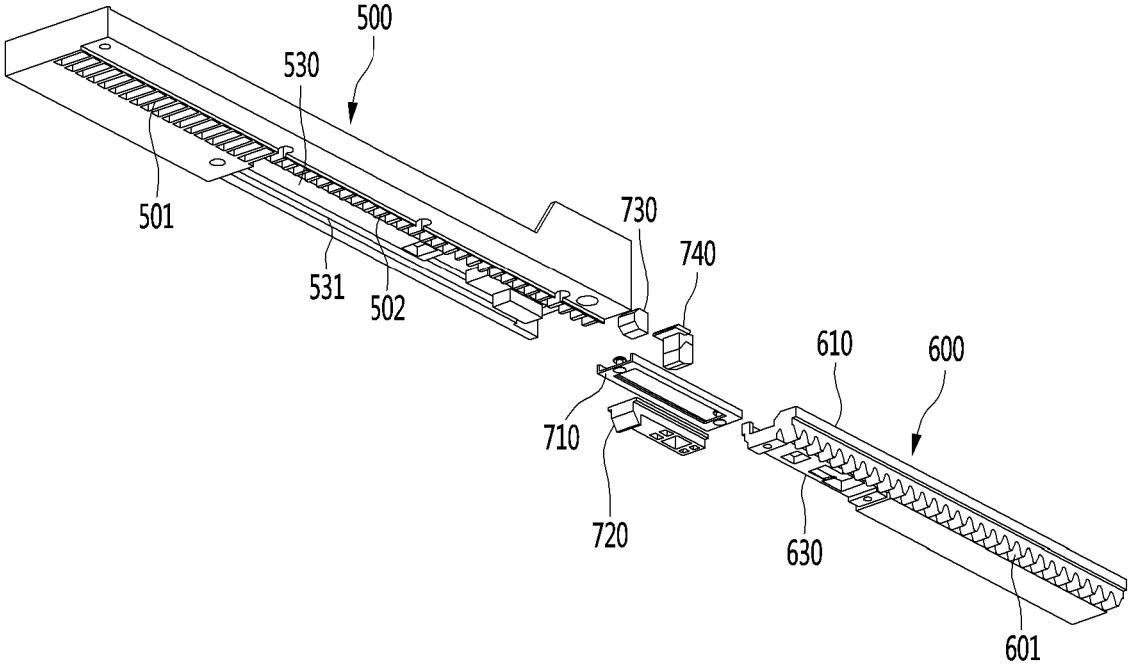
FIG. 15 is an exploded perspective view of the rack gear assembly according to an implementation.
Figure 16:
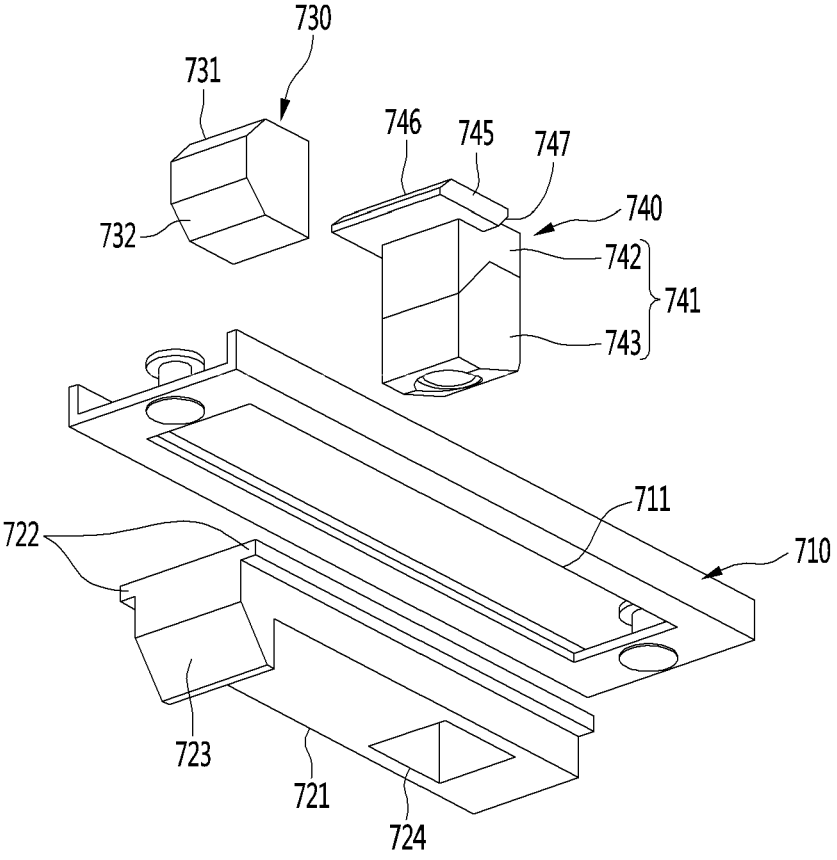
FIG. 16 is an exploded perspective view of a fixing assembly according to an implementation.
Figure 17:
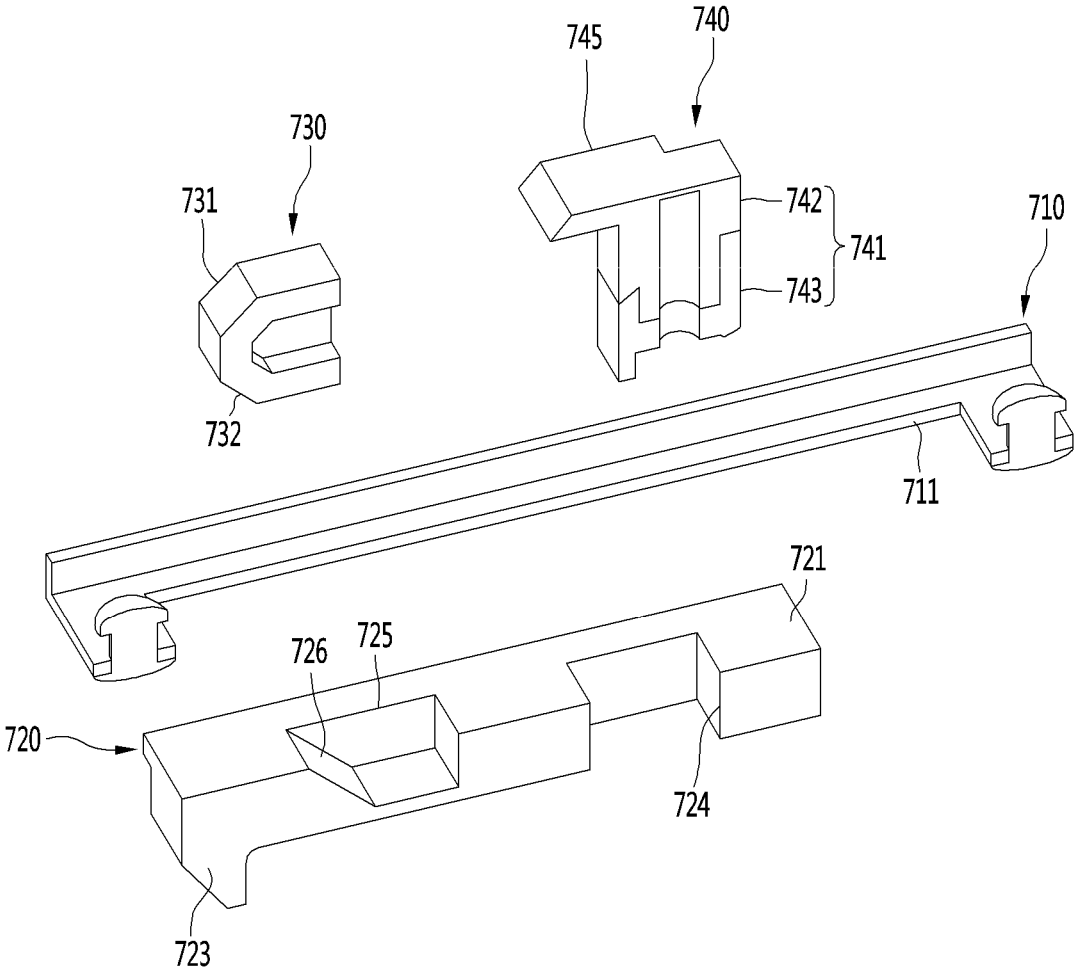
FIG. 17 is a cross-sectional view illustrating constituents of the fixing assembly according to an implementation.

FIG. 15 is an exploded perspective view of the rack gear assembly according to an implementation. FIG. 16 is an exploded perspective view of the fixing assembly according to an implementation. FIG. 17 is a cross-sectional view illustrating constituents of the fixing assembly according to an implementation.

The fixing assembly may include a slider 720 disposed to be slidable forward and backward on the fixing assembly mounting part 630 and a case 710 slidably fixing the slider 720 to the fixing assembly mounting part 630.

The fixing assembly 700 may include a holder 730 that selectively restricts the forward and backward movement of the slider 720.

The fixing assembly 700 may include a locking portion 740.

The locking portion 740 may selectively restrict the guide 50 to selectively fix the slider 720 to the fixed rack portion 500, thereby fixing the moving rack portion 600 and the fixed rack portion 500.

In detail, the case 710 may have a plate shape with a size corresponding to that of the fixing assembly mounting part 630.

A portion of a circumferential surface of the case 710 may be bent to define a predetermined space therein.

For example, both left and right ends of the case 710 may be bent upward. That is, the case 710 may have a bottom surface and both side surfaces that extend upward from both left and right surfaces of the bottom surface.

A case hole 711 may be defined in the case 710. The case hole 711 may be provided by cutting the bottom surface of the case 710, i.e., by cutting an inner area except for an edge area of the bottom surface of the case 710.

The case hole 711 may have a size that is enough to allow a slider body 721 that will be described later to pass therethrough so that the slider body 721 is movable forward and backward.

For example, the case hole 711 may have a horizontal width corresponding to that of the slider body 721. Also, the case hole 711 may have a horizontal length greater than that of the slider body.

The case 710 may be coupled to the moving rack portion 600 by a coupling portion such as a screw.

For example, the coupling member may pass through front and rear ends of the bottom surface of the case 710 and then be fixed to the fixing assembly mounting part 630.

The slider 720 may include the slider body 721 having a substantially rectangular parallelepiped shape.

The slider body 721 may pass through the case hole 711 so that a bottom surface or a lower surface thereof is exposed to the outside.

A slider guide protrusion 722 may be disposed on each of both side surfaces of the slider body 721.

The slider guide protrusion 722 may protrude from each of both side surfaces of the slider body 721. Also, the slider body 721 may be disposed from a front end to a rear end of the side surface of the slider body 721.

The slider guide protrusion 722 may be restricted in the case 710 so as to be movable forward and backward so that the slider 720 is mounted on the case 710 so as to be movable forward and backward.

For example, since the case hole 711 has a horizontal width corresponding to that of the slider body 721, the slider guide protrusion 722 may not pass through the case hole 711.

That is, the slider guide protrusion 722 may be seated on a bottom surface of the case 710 disposed on each of both left and right sides of the case hole 711. That is, the slider guide protrusion 722 may be restricted in an internal space of the case 710.

The slider guide protrusion 722 may be restricted within the case 710 to move forward and backward along the bottom surface of the case 710, thereby guiding the forward and backward movement of the slider 720.

A locking protrusion 723 protruding downward may be disposed on a front end of the slider body 721. The locking protrusion 723 may protrude downward from the front end of the bottom surface of the slider body 721.

As second locking portion through-hole 724 through which the locking portion 740 passes may be defined in the slider body 721.

The second locking portion through-hole 724 may vertically pass through the slider body 721.

The second locking portion through-hole 724 may be defined in a position that is spaced apart from the locking protrusion 723. Thus, a spaced space may be defined between the locking protrusion 723 and the locking portion 740.

The guide 50 may be inserted and restricted in the spaced space between the locking protrusion 723 and the locking portion 740. The spaced space between the locking protrusion 723 and the locking portion 740 may be called a guide restriction space.

The locking portion 740 may have a vertical length greater than that of the second locking portion through-hole 724.

The locking portion 740 may be elevatably disposed on the second locking portion through-hole 724. Also, when the drawer door 30 is withdrawn, the lower end of the locking portion 740 may protrude to a lower side of the slider body 721 to restrict the guide 50 in the space between the locking protrusion 723 and the locking portion 740. That is, the locking portion 740 may restrict the guide 50 in the guide restriction space.

Also, the locking portion 740 may move upward in a state in which the moving rack portion 600 is maximally withdrawn backward from the fixed rack portion 500. Also, the upper end of the locking portion 740 may protrude to an upper side of the slider body 721.

The upper portion of the locking portion 740, which protrudes to the upper side of the slider body 721, may be inserted into one side of the fixed rack portion 500 to fix the moving rack portion 600 to the fixed rack portion 500 so that the moving rack portion 600 does not move.

Here, the elevation operation of the locking portion 740 may be realized by the forward and backward movement of the slider 720.

A second holder insertion groove 725 into which the holder 730 is inserted may be defined in the top surface of the slider body 721.

The second holder insertion groove 725 may be defined in front of the second locking portion through-hole 724. Also, the second holder insertion groove 725 may be spaced a predetermined distance from the second locking portion through-hole 724.

For example, the second holder insertion groove 725 may be defined in a front portion of the slider body 721, and the second locking portion through-hole 724 may be defined in a rear portion of the slider body 721.

The second holder insertion groove 725 may be recessed with a size less than that of the holder 730 to accommodate a portion of the holder 730.

The holder 730 may fix the slider 720 to the moving rack portion 600 when the moving rack portion 600 is not sufficiently withdrawn backward from the fixed rack portion 500.

That is, the slider 720 may be fixed in the state of maximally moving forward. Here, the lower portion of the holder 730 may be inserted into the second holder insertion groove 725, and the upper portion of the holder 730 may be inserted into one side of the moving rack portion 600 to fix the slider 720 to the moving rack portion 600.

The holder 730 may release the state in which the slider 720 is fixed to the moving rack portion 600 when the moving rack portion 600 is maximally withdrawn backward from the fixed rack portion 500.

That is, the fixing of the slider 720 may be released so that the slider 720 is movable backward. Here, the holder 730 may move upward to be completely separated from the second holder insertion groove 725. Thus, the state in which the slider is fixed to the moving rack portion 600 so as not to move may be released.

When the fixing of the slider 720 is released, the slider 720 may move backward by the guide 50 that is restricted to slider 720. That is, when the drawer door 30 is being withdrawn, the slider 720 may be subjected to force, which is pulled backward by the restricted guide 50, to move backward.

When the slider 720 moves, the locking portion 740 may move upward to fix the moving rack portion 600 to the fixed rack portion 500.

Also, the restriction of the guide 50 may be released by the upward movement of the locking portion 740, and the rack gear assembly 400 that maximally extends in length may be further withdrawn forward.

In more detail, the locking portion 740 may include a locking portion body 741.

A circumference of the locking portion body 741 may have a shape and size corresponding to those of the second locking portion through-hole 724. Also, the locking portion body 741 may have a vertical length greater than that of the second locking portion through-hole 724. Thus, the locking portion body 741 may vertically move through the second locking portion through-hole 724.

A hook protrusion 745 may be disposed on an upper portion of the locking portion body 741.

The hook protrusion 745 may protrude outward from the upper portion of the locking portion body 741. The hook protrusion 745 may restrict a downward movement distance of the locking portion 740.

The locking portion 740 may be restricted in downward movement distance because the hook protrusion 745 contacts one side of the moving rack portion 600.

The locking portion 740 may be injection-molded by using a plastic material and be provided as a combination of a plurality of injection-molded objects.

For example, the locking portion body 741 may include a first locking portion body 742 and a second locking portion body 743.

The first locking portion body 742 may be disposed on an upper portion of the locking portion body 741, and the second locking portion body 743 may be disposed on a lower portion of the locking portion body 741.

The hook protrusion 745 may protrude outward from an upper end of the first locking portion body 742. Here, the hook protrusion 745 may protrude forward from an upper end of a front surface of the first locking portion body 742.

The first locking portion body 742 and the second locking portion body 743 may be coupled to each other by a screw portion such as a screw.

Since the first locking portion body 742 and the second locking portion body 743 are coupled to each other by the screw, the locking portion 740 may have more strength by strength of the screw.

A descending guide surface 746 for a descending operation of the locking portion 740 may be disposed on one side of the locking portion 740.

The descending guide surface 746 may be disposed on the front surface of the hook protrusion 745.

For example, the protruding front surface of the hook protrusion 745 may be inclined downward. Also, the descending guide surface 746 may be defined as an inclined front surface of the hook protrusion 745.

A ascending guide surface 747 for an ascending operation of the locking portion 740 may be disposed on one side of the locking portion 740.

The ascending guide surface 747 may be disposed on one side of the hook protrusion 745.

The hook protrusion 745 may protrude to one side of the locking portion body 741. Also, the ascending guide surface 747 may be disposed on a rear surface of the hook protrusion 745 that protrudes to one side of the locking portion body 741.

The rear surface of the hook protrusion 745 may be inclined backward. Also, the ascending guide surface 747 may be defined as an inclined rear surface of the hook protrusion 745.

Alternatively, the ascending guide surface 747 may not be disposed on the hook protrusion 745 but be disposed on the other side of the locking portion 740. For example, a separate protrusion that protrudes laterally may be further disposed on a side surface of the locking portion 740, and the ascending guide surface 746 may be disposed on a rear surface of the separate protrusion.

The holder 730 may have a solid shape having a predetermined thickness and width. An inclined surface may be disposed on the front surface of the holder 730.

The inclined surface of the holder 730 may include an upper inclined surface 731 and a lower inclined surface 732.

The upper inclined surface 731 may be disposed on an upper portion of the front surface of the holder 730 and be inclined downward in the front direction.

The lower inclined surface 732 may be disposed on a lower portion of the front surface of the holder 730 and be inclined upward in the front direction.

A holder ascending guide surface 726 for allowing the holder 730 to ascend may be disposed on the second holder insertion groove 725.

The holder ascending guide surface 726 may be defined by allowing the front surface of the second holder insertion groove 725 to be inclined. The holder ascending guide surface 726 may be inclined upward in the front direction.

For example, the front surface of the second holder insertion groove 725 may be inclined upward in the front direction. Also, the holder ascending guide surface 726 may be defined as an inclined front surface of the second holder insertion groove 725.

The holder 730 may ascend as the lower inclined surface 732 moves along the holder ascending guide surface 726 when the slider 720 moves backward.

Figure 18:
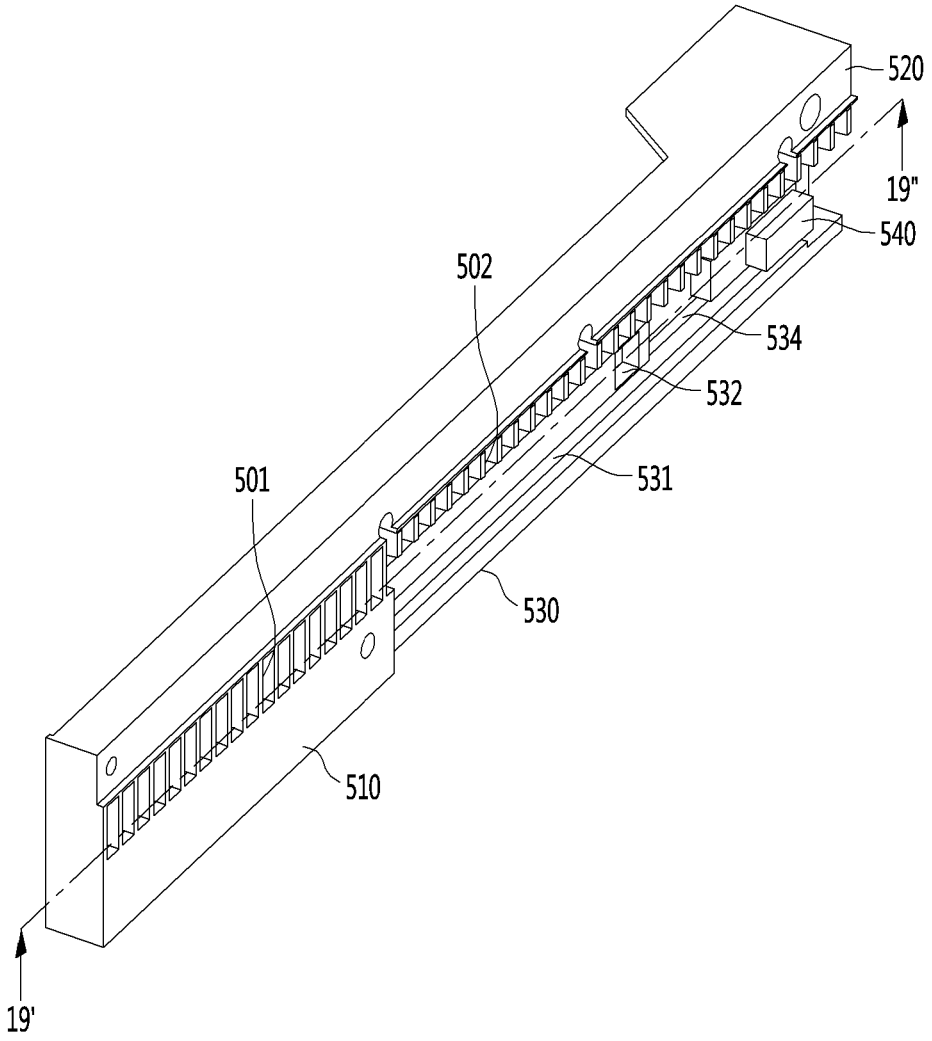
FIG. 18 is a perspective view of a fixed rack portion according to an implementation.
Figure 19:
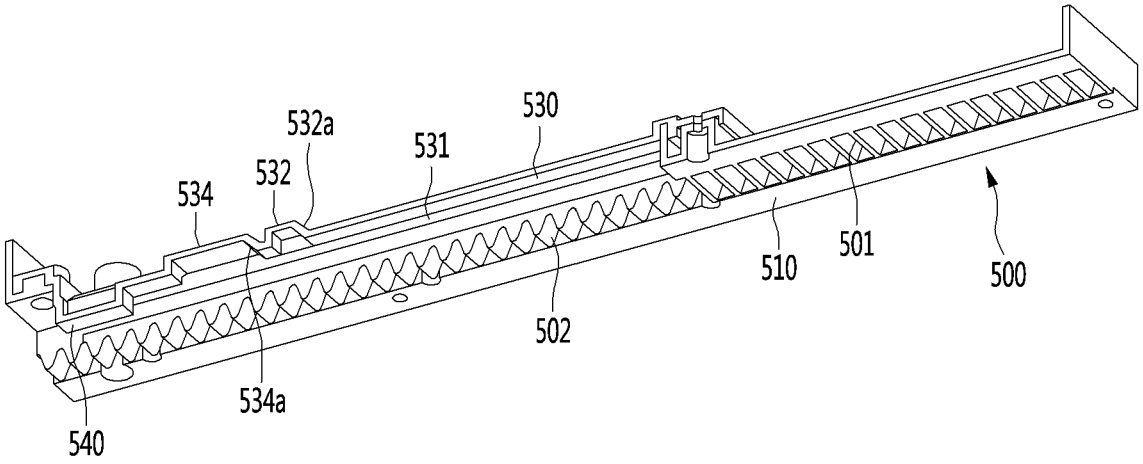
FIG. 19 is a cutaway perspective view of the fixed rack portion, taken along line 19'-19" of FIG. 18.

FIG. 18 is a perspective view of the fixed rack portion according to an implementation. FIG. 19 is a cutaway perspective view of the fixed rack portion, taken along line 19'-19" of FIG. 18.

The moving rack coupling part 530 may be recessed by a size corresponding to the moving rack portion 600 in the bottom surface of the fixed rack portion 500. Also, the moving rack portion 530 may be opened backward so that the moving rack portion 600 is capable of being withdrawn backward.

The moving rack coupling part 530 may be recessed upward from the bottom surface of the fixed rack portion 500 and be defined in an inner area spaced apart from left and right ends of the fixed rack portion 500. Thus, the moving rack coupling part 530 may define a space that is recessed upward from the bottom surface of the fixed rack portion 500 to define both side surfaces therein.

Also, a moving guide mounting part 531 that guide the movement of the moving guide 610 may be disposed on the moving rack coupling part 530. The moving guide mounting part 531 may be recessed from each of both side surfaces of the inside of the moving rack coupling part 530 to accommodate the moving guide 610.

Alternatively, the moving guide 619 may be disposed on only one side surface of the moving rack portion 600, and the moving guide mounting part 531 may be disposed on only one of the inside of the moving rack coupling part 530.

A first holder insertion groove 532 may be defined in a top surface of the inside of the moving rack coupling part 630.

The first holder insertion groove 532 may be recessed upward from the top surface of the inside of the moving rack coupling part 630.

When the holder 730 moves upward, the first holder insertion groove 532 may define a space into which a portion of the holder 730 is inserted. The first holder insertion groove 532 may have a size that is enough to accommodate an upper portion of the holder 730 that moves upward.

A holder descending guide surface 532*a* may be disposed on the first holder insertion groove 532. The holder descending guide surface 532*a* may be provided by allowing a front surface of the first holder insertion groove 532 to be inclined.

For example, the front surface of the first holder insertion groove 532 may be inclined downward. Also, the holder descending guide surface 532*a* may be defined as an inclined front surface of the first holder insertion groove 532.

When the moving rack portion 600 is maximally withdrawn, the first holder insertion groove 532 may be defined in a position corresponding to that of the holder 730. That is, when the moving rack portion 600 is maximally withdrawn, the first holder insertion groove 532 may be disposed vertically above the holder 730.

For example, the first holder insertion groove 532 may be defined in a rear portion of the moving rack coupling part 530.

A locking portion insertion groove 534 may be defined in a top surface of the inside of the moving rack coupling part 630.

The locking portion insertion groove 534 may be recessed upward from the top surface of the inside of the moving rack coupling part 630.

When the locking portion 740 moves upward, the locking portion insertion groove 534 may define a space into which a portion of the locking portion 740 is inserted. The locking portion insertion groove 534 may have a size that is enough to accommodate an upper portion of the locking portion 740 that moves upward.

A locking portion descending guide surface 534*a* may be disposed on the locking portion insertion groove 534. The locking portion descending guide surface 534*a* may be provided by allowing a front surface of the locking portion insertion groove 534 to be inclined.

For example, the front surface of the locking portion insertion groove 534 may be inclined downward in the front direction. Also, the locking portion descending guide surface 534*a* may be defined as an inclined front surface of the locking portion insertion groove 534.

When the moving rack portion 600 is maximally withdrawn, the locking portion insertion groove 534 may be defined in a position corresponding to that of the locking portion 740. That is, when the moving rack portion 600 is maximally withdrawn, the locking portion insertion groove 534 may be disposed vertically above the locking portion 740.

For example, the locking portion insertion groove 534 may be defined in a rear portion of the moving rack coupling part 530. Also, the locking portion insertion groove 534 may be disposed behind the first holder insertion groove 532 in the top surface of the inside of the moving rack coupling part 530.

A stopper 540 for restricting the withdrawal distance of the moving rack portion 600 may be disposed on one side of the fixed rack portion 500.

The stopper 540 may protrude downward from the bottom surface of the moving rack portion 500. Here, the stopper 540 may protrude downward from the top surface of the inside of the moving rack coupling part 530.

Also, the stopper 540 may be disposed behind the locking portion insertion groove 534. For example, the stopper 540 may be disposed on a rear portion of the top surface of the inside of the moving rack coupling part 530.

Figure 20:
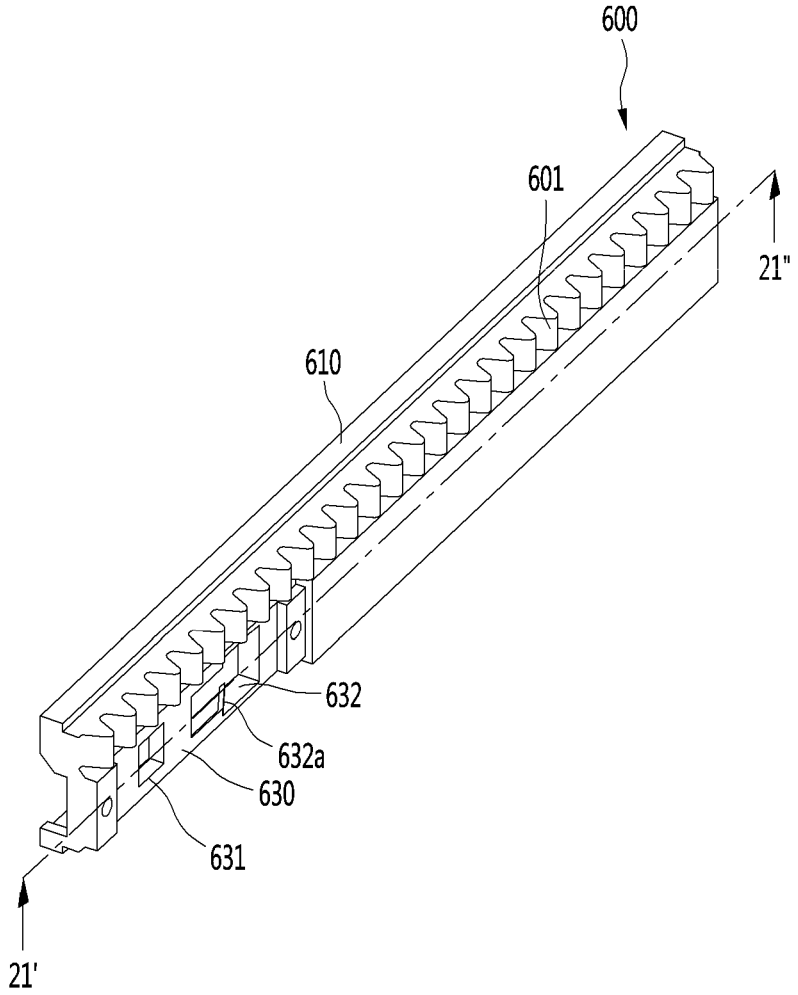
FIG. 20 is a perspective view of a moving rack portion according to an implementation.
Figure 21:
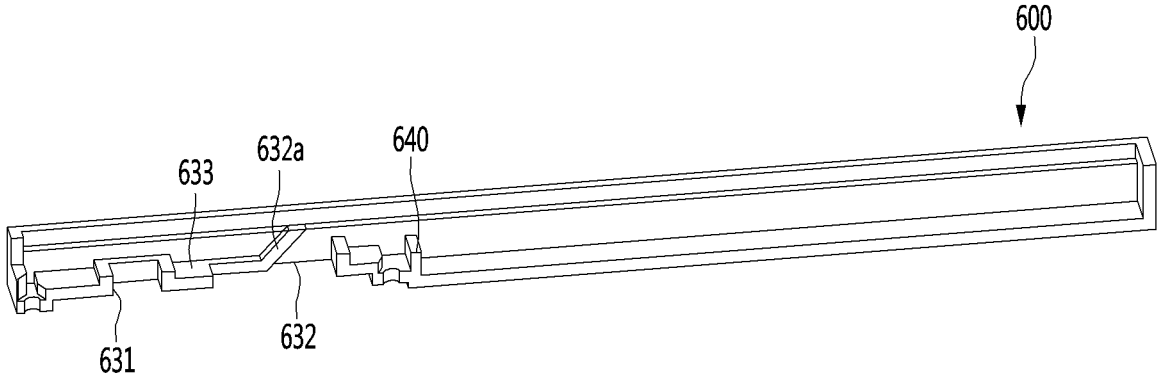
FIG. 21 is a cutaway perspective view of the moving rack portion, taken along line 21'-21" of FIG. 20.

FIG. 20 is a perspective view of the moving rack portion according to an implementation. FIG. 21 is a cutaway perspective view of the moving rack portion, taken along line 21'-21" of FIG. 20.

The fixing assembly mounting part 630 may be recessed with a size corresponding to that of the fixing assembly 700 on the bottom surface of the moving rack 600.

A holder through-hole 631 may be defined in the fixing assembly mounting part 630.

The holder through-hole 631 may vertically pass through a top surface of the inside of the fixing assembly mounting part 630. Also, the holder through-hole 631 may have a size corresponding to a circumference of the holder 730 so that the holder 730 is vertically movable.

When the moving rack portion 600 is maximally withdrawn, the holder through-hole 631 may be disposed vertically below the first holder insertion groove 532.

A first locking portion through-hole 632 may be defined in the fixing assembly mounting part 630.

The first locking portion through-hole 632 may vertically pass through the top surface of the inside of the fixing assembly mounting part 630.

The first locking portion through-hole 632 may have a size that is enough so that the locking portion body 741 is movable vertically and forward and backward.

For example, the first locking portion through-hole 632 may have a horizontal width corresponding to that of the locking portion body 741 and have a longitudinal width greater than that of the locking portion body 741.

That is, when the moving rack portion 600 is maximally withdrawn, the first locking portion through-hole 632 may be disposed vertically above the locking portion insertion groove 534.

A locking portion ascending guide 632*a* for allowing the locking portion 740 to ascend when the slider 720 moves backward may be disposed on a side surface of the first locking portion through-hole 632.

The locking portion ascending guide 632*a* may protrude from the side surface of the first locking portion through-hole 632. Also, the locking portion ascending guide 632*a* may be inclined downward.

Since the ascending guide surface 747 moves along the locking portion ascending guide 632*a* when the slider 720 moves backward, the locking portion 740 may ascend.

The holder through-hole 631 and the first locking portion through-hole 632 may be spaced a predetermined distance from each other in the front and rear direction.

Also, a hook protrusion contact surface 633 contacting the hook protrusion 745 of the locking portion 740 may be disposed between the holder through-hole 631 and the first locking portion through-hole 632.

The hook protrusion contact surface 633 may be disposed on the top surface of the moving rack portion 600 disposed between the holder through-hole 631 and the first locking portion through-hole 632.

When the locking portion 740 maximally moves downward, the hook protrusion 745 may be seated on the hook protrusion contact surface 633 and thus be restricted in downward movement.

A stopper contact part 640 for restricting the maximum withdrawal distance of the moving rack portion 600 may be disposed on the moving rack portion 600.

The stopper contact part 640 may protrude upward from the top surface of the moving rack portion 600.

The stopper contact part 640 may be disposed behind the fixing assembly mounting part 630 on the top surface of the moving rack portion 600 and be disposed adjacent to the fixing assembly mounting part 630.

When the moving rack portion 600 is disposed at the initial position, the stopper contact part 640 may be disposed in front of the stopper 640 so as to be maximally spaced apart from the stopper 650 forward and backward.

Also, when the moving rack portion 600 is maximally withdrawn, the stopper contact part 640 may contact the stopper 540. Thus, the withdrawal distance of the moving rack portion 600 may be restricted.

Hereinafter, an operation of the rack gear assembly when the drawer door is withdrawn will be described in more detail with reference to the accompanying drawings.

Figure 22:
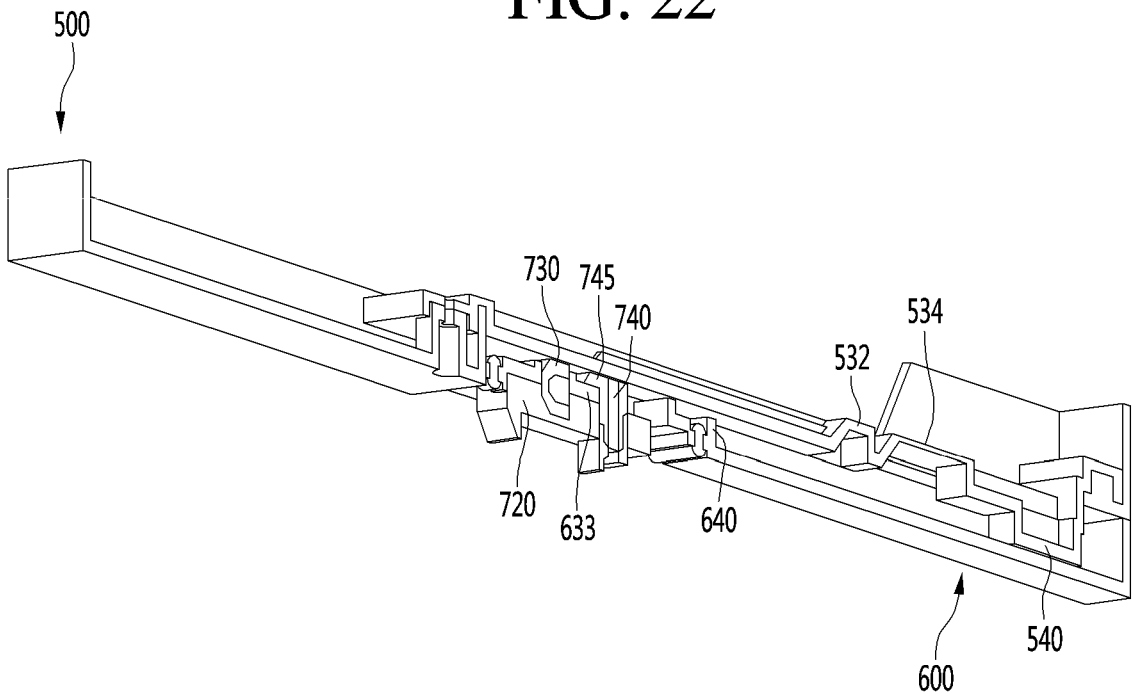
FIG. 22 is a cutaway perspective view of a rack gear assembly, taken along line 22'-22" of FIG. 13.
Figure 23:
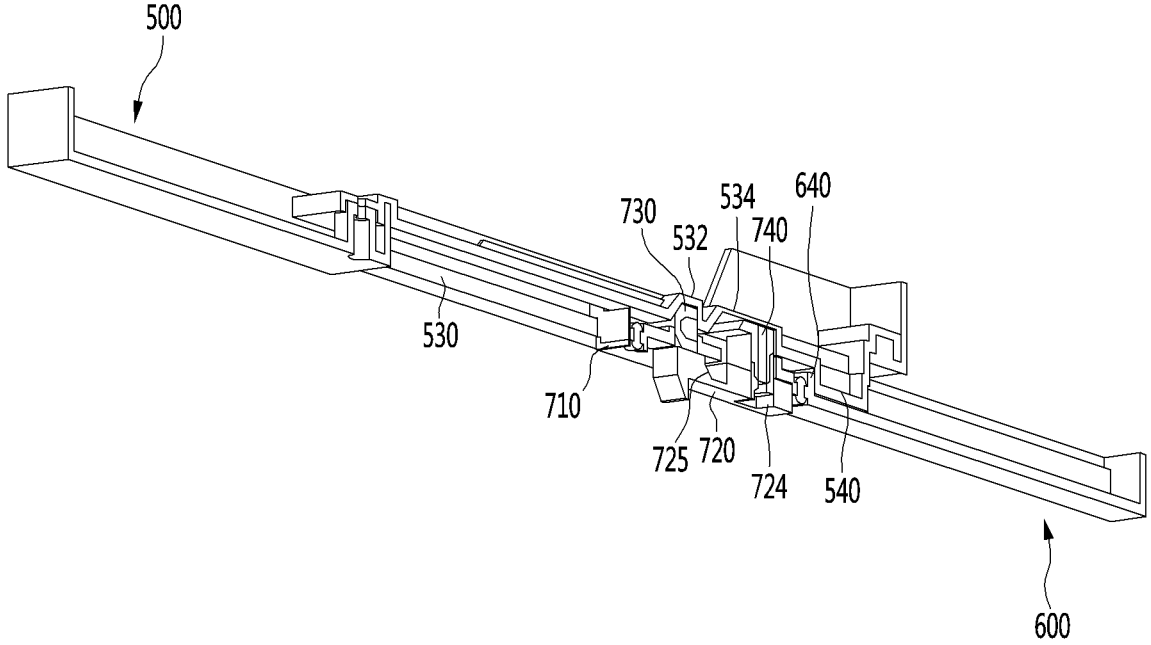
FIG. 23 is a cutaway perspective view of the rack gear assembly, taken along line 23'-23" of FIG. 14.

FIG. 22 is a cutaway perspective view of the rack gear assembly, taken along line 22'-22" of FIG. 13. FIG. 23 is a cutaway perspective view of the rack gear assembly, taken along line 23'-23" of FIG. 14.

Hereinafter, a state in which the length of the rack gear assembly 400 maximally decreases will be described in detail with reference to the accommodating drawings.

When the drawer door 30 is completely inserted, the rack gear assembly 400 may be in an initial state in which the length of the rack gear assembly 400 maximally decreases.

The initial state of the rack gear assembly 400 may be a state in which the moving rack portion 600 maximally moves forward along the moving rack coupling part 530. Also, the initial state may be a state in which the slider 720 of the fixing assembly 700 maximally moves forward along the case hole 711.

The state in which the moving rack portion 600 maximally moves forward along the moving rack coupling part 530 may be defined as an initial state of the moving rack portion 600.

Also, the state in which the slider 720 of the fixing assembly 700 maximally moves forward along the case hole 711 may be defined as an initial state of the fixing assembly 700.

When the fixing assembly 700 is in the initial state, the holder 730 may be in a state in which a lower portion of the holder 730 is inserted into the second holder insertion groove 725.

The holder 730 may have a vertical length greater than a depth of the second holder insertion groove 725. Also, the upper portion of the holder 730 may be disposed in the holder through-hole 631. Here, the top surface of the holder 730 may contact the top surface of the inside of the moving rack coupling part 530 or be adjacent to the top surface.

Also, since the holder 730 is disposed in the second holder insertion groove 725 and the holder through-hole 631 at the same time, the slider 720 may be in the state fixed to the moving rack portion 600 so as not to move forward and backward.

When the fixing assembly 700 is in the initial state, the locking portion 740 may maximally move downward so that the lower end thereof protrudes downward from the second locking portion through-hole 724.

Here, the hook protrusion 745 may contact the hook protrusion contact surface 633 to restrict the downward movement of the locking portion 740.

Also, the top surface of the locking portion 740 may contact the top surface of the inside of the moving rack coupling part 530 or be adjacent to the top surface.

The top surface of the inside of the moving rack coupling part 530 may have a flat section backward from the front end thereof. That is, a planar section may be disposed backward from the front end on the top surface of the inside of the moving rack coupling part 530. Here, the planar section may be a section from the front end of the top surface of the inside of the moving rack coupling part 530 to the front end of the first holder insertion groove 532.

Thus, the holder 730 and the locking portion 740 may be restricted in upward movement in a predetermined section when the moving rack portion 600 is withdrawn backward. That is, the holder 730 and the locking portion 740 may be restricted in upward movement in the planar section of the moving rack coupling part 530.

Also, when the fixing assembly 700 is in the initial state, the stopper 540 and the stopper contact part 640 may be maximally spaced apart from each other forward and backward.

Hereinafter, the state in which the rack gear assembly 400 maximally extends in length will be described in more detail with reference to the accommodating drawings.

When the drawer door 30 is withdrawn, the rack gear assembly 400 may extend in length.

The maximally extending state of the rack gear assembly 400 may be defined as a state in which the moving rack portion 600 maximally moves backward along the moving rack coupling part 530.

In the maximally extending state of the rack gear assembly 400, the stopper 540 and the stopper contact part 640 may be in a state of contacting each other. That is, when the moving rack portion 600 moves backward along the moving rack coupling part 530, the moving rack portion 600 may be restricted in backward movement by the contact between the stopper 540 and the stopper contact part 640.

The maximally extending state of the rack gear assembly 400 may be an initial state in which the slider 720 maximally moves forward.

The maximally extending state of the rack gear assembly 400 may be a state in which the rack gear assembly 400 maximally extends or is fixed by the backward movement of the slider 720.

The maximally extending and fixed state of the rack gear assembly 400 may be defined as a state in which the slider 720 maximally moves backward in the state in which the rack gear assembly 400 maximally extends in length. In the maximally extending and fixed state, the rack gear assembly 400 may be fixed in length in the maximally extending state.

In the maximally extending and fixed state of the rack gear assembly 400, the holder 730 may move upward to be completely withdrawn from the second holder insertion groove 725.

Also, the lower portion of the holder 730 may be disposed in the holder through-hole 631, and the upper portion of the holder 730 may be inserted into the first holder insertion groove 532. Since the holder 730 is disposed in the holder through-hole 631 and the first holder insertion groove 532 at the same time, the moving rack portion 600 may be in the state fixed to the moving rack portion 500 so as not to move.

In the maximally extending and fixed state of the rack gear assembly 400, the locking portion 740 may move upward and then be inserted into the locking portion insertion groove 534.

Also, since the locking portion 740 moves upward, the lower end of the locking portion 740 may be disposed in the second locking portion through-hole 724. That is, the lower end of the locking portion 740 may not protrude to the bottom surface of the slider 720.

Hereinafter, interlocked operations of the rack gear assembly 400, the guide 50, and the pinion 330 when the drawer door 30 is withdrawn will be described in detail with reference to the accompanying drawings.

Figure 24:
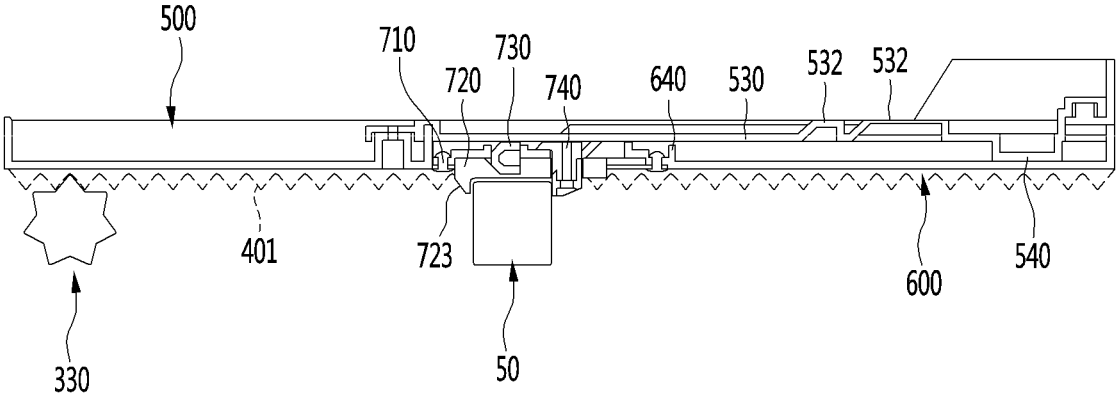
FIG. 24 is a view illustrating a state in which the rack gear assembly, a guide, and a pinion are coupled to each other when the rack gear assembly is in an initial state according to an implementation.
Figure 25:
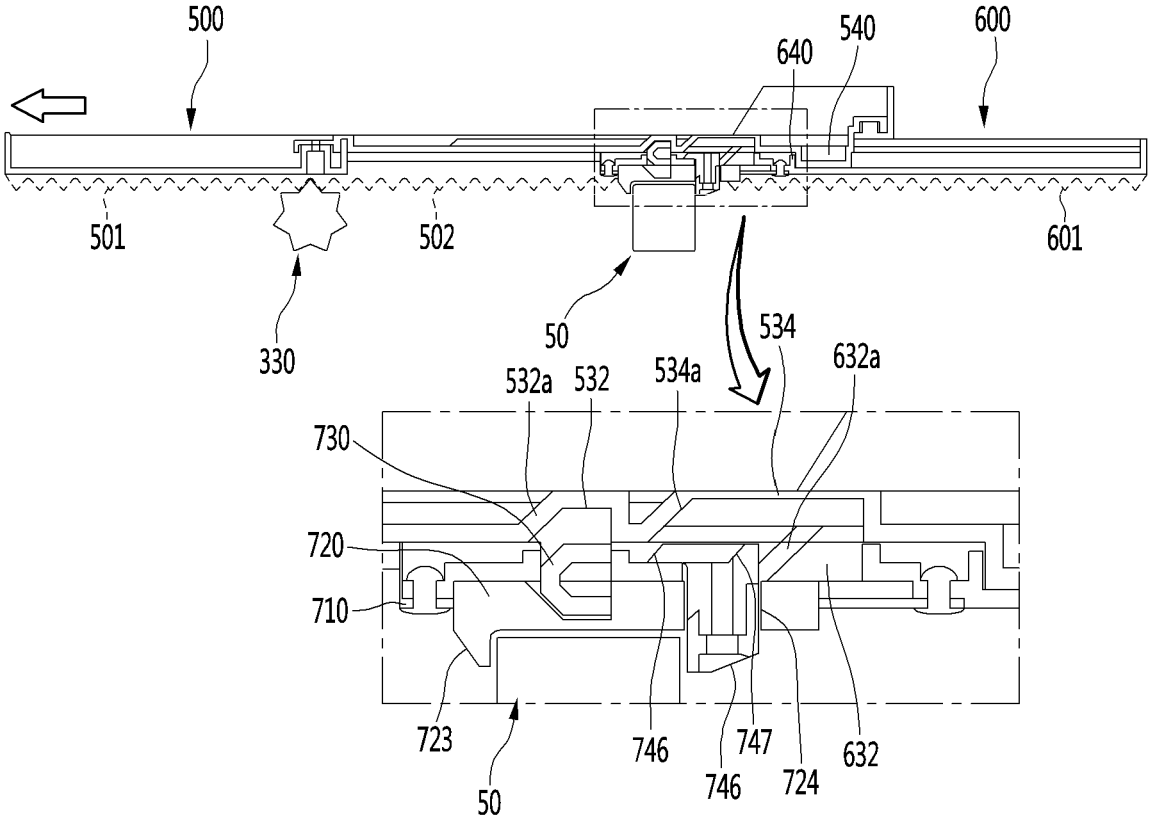
FIG. 25 is a view illustrating a state in which the rack gear assembly, the guide, and the pinion are coupled to each other when the rack gear assembly is in a maximally extending state.
Figure 26:
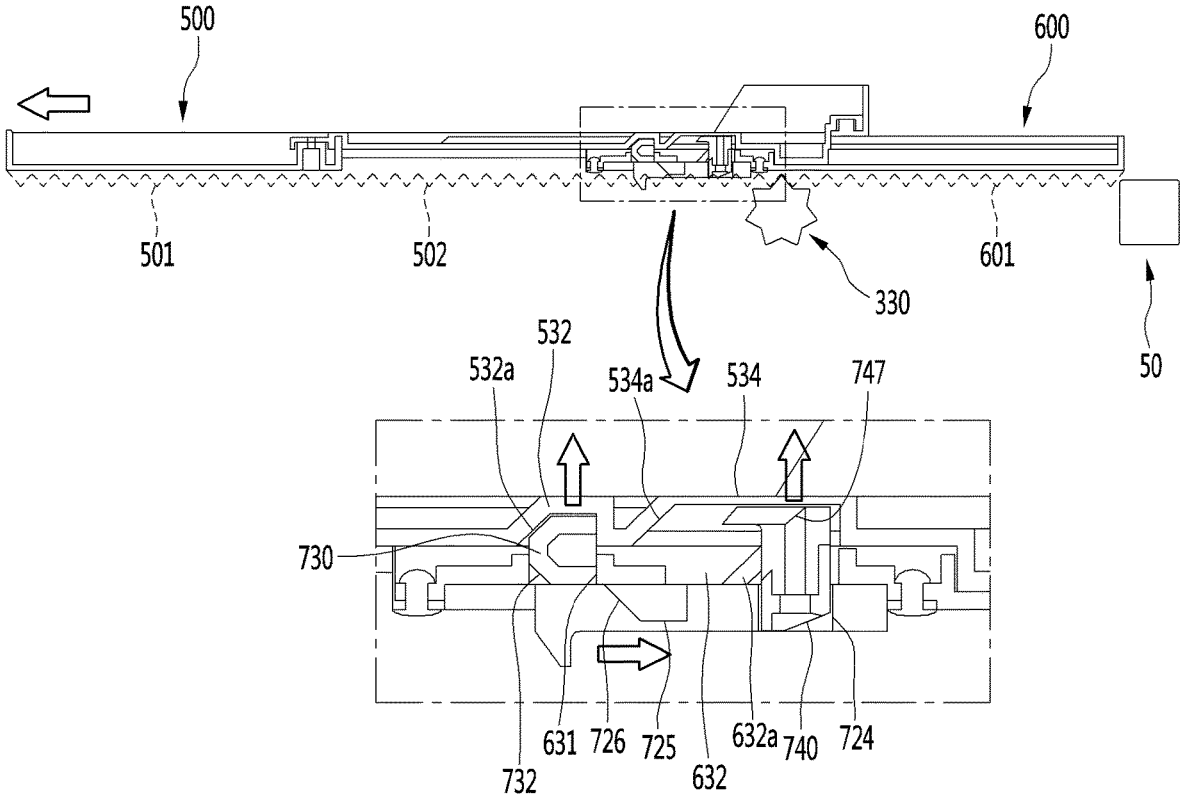
FIG. 26 is a view illustrating a state in which the rack gear assembly, the guide, and the pinion are coupled to each other when the rack gear assembly is in the maximally extending and fixed state.

FIG. 24 is a view illustrating a state in which the rack gear assembly, the guide, and the pinion are coupled to each other when the rack gear assembly is in the initial state according to an implementation. FIG. 25 is a view illustrating a state in which the rack gear assembly, the guide, and the pinion are coupled to each other when the rack gear assembly is in the maximally extending state. FIG. 26 is a view illustrating a state in which the rack gear assembly, the guide, and the pinion are coupled to each other when the rack gear assembly is in the maximally extending and fixed state.

When the drawer door 30 is completely inserted, the rack gear assembly 400 may be in the initial state.

Also, the pinion 330 may be disposed on the front end of the rack gear 401. That is, the pinion 330 may be gear-coupled to the front end of the first fixed rack 501.

Also, the pinion 330 may be in a state restricted between the locking protrusion 723 and the locking portion 740.

When the pinion rotates in one direction, the rack gear assembly 400 on which the rack gear 401 is disposed may move forward. Also, the drawer door 30 coupled to the rack gear assembly 400 may be withdrawn.

In the initial withdrawal of the drawer door 30, the fixed rack portion 500 may be withdrawn forward by the rotation of the pinion 330. Also, the moving rack portion 600 may not be withdrawn forward because the guide 50 and the fixing assembly 700 are restricted with respect to each other.

That is, in the initial withdrawal of the drawer door 30, the fixed rack portion 500 may move forward, and the moving rack portion 600 may be fixed to the cabinet 10.

Thus, since the fixed rack portion 500 moves forward, the moving rack portion 600 may be withdrawn to a relatively rear side of the fixed rack portion 500. That is, the moving rack portion 600 may be withdrawn backward along the moving rack coupling part 530, and also, the rack gear assembly 400 may extend in length.

When the stopper 540 and the stopper contact part 640 contact each other, the rack gear assembly 400 may be in the maximally extending state.

When the rack gear assembly 400 is in the maximally extending state, the fixed rack portion 500 and the moving rack portion 600 may move forward together with each other. That is, when the rack gear assembly 400 in the maximally extending state, the moving rack portion 600 may not be further withdrawn any more. Thus, the fixed rack portion 500 and the moving rack portion 600 may move forward together with each other.

Here, when the moving rack portion 600 moves forward, the guide 50 may pull the slider 720 backward.

In detail, when the moving rack portion 600 is maximally withdrawn backward, the guide 50 may be still be restricted to the slider 720. That is, the pinion 330 may be in a state restricted between the locking protrusion 723 and locking portion 740.

Thus, even though the moving rack portion 600 moves forward, the slider 720 may not move forward together with the moving rack portion 600. Also, the slider 720 may be pulled by the guide 50.

That is, when the moving rack portion 600 moves forward together with the fixed rack portion 600, the slider 720 may move backward along the case hole 711.

When the moving rack portion 600 moves along the case hole 711, the holder 730 and the locking portion 740 may move upward.

In detail, when the moving rack portion 600 is maximally withdrawn backward, the first holder insertion groove 532 may be vertically aligned with the holder through-hole 631. That is, the first holder insertion groove 532 may be disposed vertically above the holder 730.

Also, when the moving rack portion 600 is maximally withdrawn backward, the locking portion insertion groove 534 may be vertically aligned with the first locking portion through-hole 632. That is, the locking portion insertion groove 534 may be disposed vertically above the locking portion 740.

Here, when the slider 720 moves backward along the case hole 711, the lower inclined surface 732 of the holder 730 and the holder ascending guide surface 726 may be interlocked with each other. That is, the holder ascending guide surface 726 may push and lift the lower inclined surface 732.

Thus, the holder 730 may ascend to be inserted into the first holder insertion groove 532. Also, the holder 730 may be completely separated from the second holder insertion groove 725.

Also, when the slider 720 moves backward along the case 711, the ascending guide surface 747 of the locking portion 740 and the locking portion ascending guide 632*a* may be interlocked with each other. That is, the ascending guide surface 747 may move along the locking portion ascending guide 632*a*.

Here, the second locking portion through-hole 724 defined in the slider 720 may have a size corresponding to a circumference of the locking portion 740 disposed in the second locking portion through-hole 724. Also, the first locking portion through-hole 632 defined in the moving rack portion 660 may have a size that is enough to allow the locking portion 740 to be movable forward and backward.

Thus, the locking portion 740 may move backward together with the slider 720 when the slider 720 moves backward. Also, the locking portion 740 may move upward along the locking portion ascending guide 632*a* disposed in the first locking portion through-hole 632.

Also, since the locking portion 740 ascends, the locking portion 740 may be inserted into the locking portion insertion groove 534. Also, since the locking portion 740 moves upward, the lower end of the locking portion 740 may not be exposed to the bottom surface of the slider 720. That is, the lower end of the locking portion 740 may be disposed in the second locking portion through-hole 724.

In the state in which the holder 730 ascends, the holder 730 may be disposed in the first holder insertion groove 532 defined in the fixed rack portion 500 and the holder through-hole 631 defined in the moving rack portion 600 at the same time. That is, the holder 730 may fix the fixed rack portion 500 and the moving rack portion 600.

Thus, the moving rack portion 600 may be fixed to the fixed rack portion 500 so as not to be movable forward and backward, thereby maintaining the state in which the rack gear assembly 400 maximally extends. That is, the rack gear assembly 400 may be in the maximally extending and fixed state.

As the locking portion 740 ascends, the restricted state of the guide 50 and the slider 720 may be released.

When the lower end of the locking portion 740 is inserted into the second locking portion through-hole 724, the guide 50 may relatively move to the rear side of the slider 720.

That is, when the rack gear assembly 400 is in the maximally extending and fixed state, the fixing assembly 700 may be released in restriction with the guide 50 to move forward together with the moving rack portion 600.

The pinion 330 may continuously rotate in one direction even after he state in which the rack gear assembly 400 maximally extends and is fixed.

Also, the rack gear 400 may continuously move forward in the maximally extending state by the rotation of the pinion 330. Here, the pinion 330 may sequentially pass through the first fixed rack 501, the second fixed rack 502, and the moving rack 601.

When the pinion 330 is disposed on the rear end of the moving rack 601, the drawer door 30 may be in the state of being automatically and maximally withdrawn.

The control unit may stop the driving of the motor 311 when the state in which the drawer door 30 is maximally withdrawn is confirmed through the draw-out detection device.

When the drawer door 30 is inserted, the rack gear assembly 400 may operate in opposite to the operation when the drawer door 30 is withdrawn.

Hereinafter, an operation of the rack gear assembly 400 when the drawer door 30 is inserted will be described in detail.

The control unit may allow the motor 311 to operate in reverse so as to automatically insert the drawer door 30.

When the motor 311 rotates reversely, the pinion 330 may rotate reversely.

Also, when the pinion 330 rotates reversely, the rack gear assembly 400 that is in the maximally extending and fixed state may move backward. Also, the drawer door 30 coupled to the rack gear assembly 400 may be inserted into the lower storage chamber 12.

Here, the pinion 330 may sequentially pass through the moving rack 601, the second fixed rack 502, and the first fixed rack 501.

When the rack gear assembly 400 moves backward, the guide 50 may contact the locking protrusion 723.

When the guide 50 contacts the locking protrusion 723, the slider 720 may be pushed forward by the guide 50. That is, the slider 720 may move forward along the case hole 711 by the guide 50.

When the slider 720 moves forward in the case hole 711, the holder 730 and the locking portion 740 may descend again.

In detail, when the slider 720 maximally moves forward along the case hole 711, the descending guide surface 746 of the locking portion 740 may contact the locking portion descending guide surface 534*a*.

Also, the holder 730 may be vertically aligned with the second holder insertion groove 725. Here, the upper inclined surface 731 of the holder 730 may contact the holder descending guide surface 532*a*.

Also, when the slider 720 maximally moves forward along the case hole 711, the slider 720 may contact the front end of the case hole 711. Also, the slider 720 and the moving rack portion 600 may be pushed forward together by the guide 50.

Thus, the moving rack portion 600 may be restricted in backward restriction by the guide 50, and thus, only the fixed rack portion 500 may move backward.

It may be seen that the moving rack portion 600 moves forward with respect to the fixed rack portion 500. Thus, the moving rack portion 600 may be inserted into the moving rack coupling part 530 to reduce the length of the rack gear assembly 400.

Here, since the moving rack portion 600 is inserted into the moving rack coupling part 530, the descending guide surface 746 of the locking portion 740 may move downward along the locking portion descending guide surface 534*a*. Thus, the locking portion 740 may move downward.

Also, the lower end of the locking portion 740 may protrude downward from the second locking portion through-hole 724. Also, the pinion 330 may be in the state restricted between the locking protrusion 723 and locking portion 740.

Also, since the moving rack portion 600 is inserted into the moving rack coupling part 530, the upper inclined surface 731 of the holder 730 may move downward along the holder descending guide surface 532*a*.

Also, the lower portion of the holder 730 may be inserted again into the second holder insertion groove 725. That is, the holder 730 may be disposed in the holder through-hole 631 and the second holder insertion groove 725 at the same time to fix the slider 720 to the moving rack portion 600.

When the pinion 330 is disposed on the front end of the first fixed rack 501, the drawer door 30 may be in the maximally inserted state.

The control unit may stop the driving of the motor 311 when the state in which the drawer door 30 is maximally withdrawn is confirmed through the draw-out detection device.

According to the refrigerator according to the foregoing implementation, to mount the drawer door 30 on the cabinet 10, it may be necessary to mount the cabinet 10 so that the rack gear assembly 400 maximally extends and is fixed.

In detail, to mount the drawer door 30 on the cabinet 10, the draw-out rail 40 mounted on the lower storage chamber 12 may extend so that one side of the draw-out rail 40 protrudes to the outside of the lower storage chamber 12. Also, the drawer door 30 may be coupled to one extension side of the draw-out rail 40.

Also, since the drawer door 30 is inserted into the lower storage chamber 12, the rack gear 401 of the rack gear assembly 400 and the pinion 330 may be coupled to each other to complete the mounting of the drawer door 30.

However, when the drawer door 30 is inserted in the initial mounting of the drawer door 30, if the rack gear assembly 400 is in the initial state or maximally extending state, the drawer door 30 may not be inserted by the interference of the guide 50.

In detail, in the refrigerator according to the foregoing implementation, the guide 50 may be configured to protrude toward the rack gear assembly 400.

To normally interlock the rack gear assembly 400 with the guide 50, when the drawer door 30 is inserted, the locking portion 740 has to be in the upwardly moving state when the guide 50 contacts the locking protrusion 723.

Also, after the guide 50 contacts the locking protrusion 723, since the slider 720 moves forward in the case hole 711, the locking portion 740 may move downward to restrict the guide 50 between the locking portion 740 and the locking protrusion 723.

However, when the rack gear assembly 400 is in the initial state or maximally extending state, the locking portion 740 may move downward to protrude downward from the slider body 720. That is, the locking portion 740 may be in the downwardly moving state. However, the guide 50 may not be in the state in which the guide is disposed between the locking protrusion 723 and the locking portion 740. That is, the guide may be in the state of being disposed behind the locking portion 740.

In this case, when the drawer door 30 is inserted, the drawer door 30 may not be completely inserted by the interference between the guide 50 and the locking portion 740.

Thus, the rack gear assembly 400 has to be manually aligned in the maximally extending or fixed state so that the locking portion 740 is in the ascending state when the drawer door 30 is mounted. Also, the maximally extending and fixed state of the rack gear assembly 400 has to be maintained until the guide 50 is disposed between the locking protrusion 723 and the locking portion 740, and the drawer door 30 has to be inserted.

When the rack gear assembly 400 is provided in a pair on left and right sides of the drawer door 30, since all of the pair of rack gear assembles 400 have to be equally aligned, assemblability of the drawer door may be more deteriorated.

Hereinafter, the guide 50 which is capable of being easily aligned with the rack gear assembly 400 in the initial mounting of the drawer door 30 regardless of the state of the rack gear assembly 400 according to another implementation will be described.

Since the constituents of the guide and all the constituents of the lower storage chamber 12 except for the portion on which the guide is mounted are the same as those of the refrigerator according to the foregoing implementation, the same reference numerals and the names of the components are used with respect to the same constituent, and a detailed description thereof will be omitted.

Figure 27:
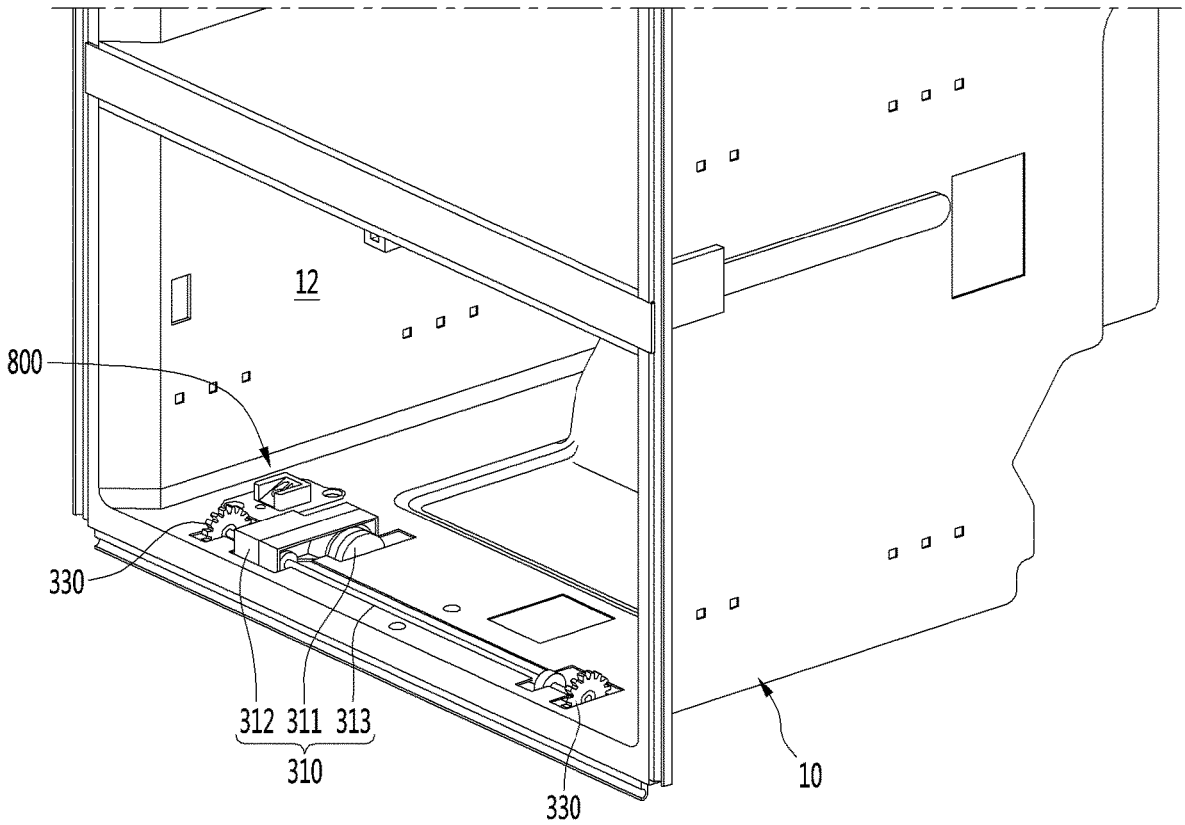
FIG. 27 is a view of a lower storage chamber in which a guide is provided according to another implementation.
Figure 28:
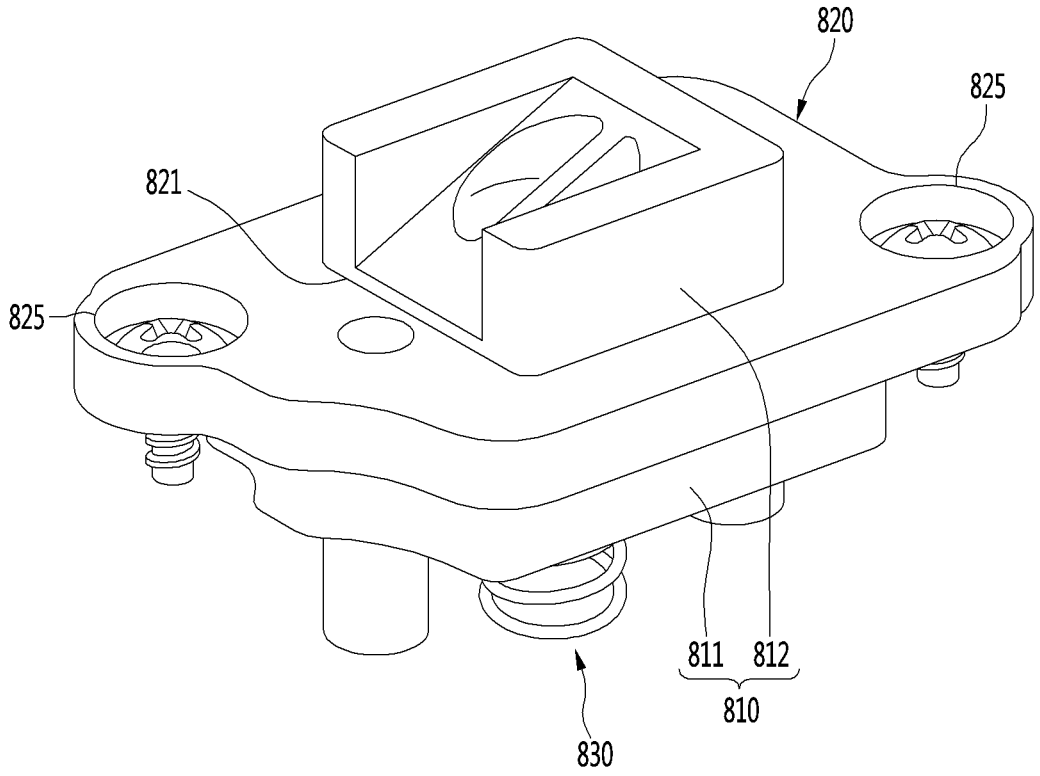
FIG. 28 is a perspective view of the guide according to another implementation.

FIG. 27 is a view of a lower storage chamber in which a guide is provided according to another implementation. FIG. 28 is a perspective view of the guide according to another implementation.

A guide 800 according to another implementation may be provided to descend due to contact with a locking portion 740 when the locking portion 740 is disposed at a rear side.

An initial mounting of the drawer door 30 may be a state in which the locking portion 740 moves downward. Here, the guide 800 may be disposed behind the locking portion 740. Here, the locking portion 740 may descend by contact with the locking portion 740 when the drawer door 30 is inserted.

Also, the guide 800 may ascend in a state of being disposed between the locking protrusion 723 and the locking portion 740 so as to be aligned in proper position within a space between the locking protrusion 723 and the locking portion 740.

The guide 800 may be disposed on a side surface or a bottom surface of a lower storage chamber 12. Hereinafter, an example in which the guide 800 is disposed on the bottom surface of the lower storage chamber 12 will be described in detail.

The guide 800 may be disposed on the bottom surface of the lower storage chamber 12. That is, the guide 800 may be disposed on a lower wall of the lower storage chamber 12.

The guide 800 may be provided in a pair that are horizontally spaced apart from each other on the bottom surface of the lower storage chamber 12.

The left guide 800 may be disposed to correspond to a left rack gear assembly 400. Also, the right guide 800 may be disposed to correspond to a right rack gear assembly 400. In the state in which the drawer door 30 is inserted, the pair of guides 800 may be respectively disposed in a space between the locking protrusions 723 and the locking portions 740 of the pair of rack gear assemblies 400.

For example, the guide 800 may be disposed on a front end of the bottom surface of the lower storage chamber 12, be disposed behind a pinion 330, or be disposed on a side of the pinion 330.

The guide 800 may include a guide body 810 that is elevated and a guide fixing portion 820 mounting the guide body 810 in the lower storage chamber 12.

The guide 800 may include an elastic portion 830. The elastic portion 830 may be a compression spring.

The elastic portion 830 may be compressed in a state in which the guide body 810 descends to provide elastic restoring force so that the guide body 810 is elevated.

The guide fixing portion 820 may have a plate shape having a predetermined thickness.

A guide body through-hole 821 through which a portion of the guide body 810 passes may be defined in the guide fixing portion 820.

The guide body through-hole 821 may pass through a central portion of the guide fixing portion 820.

The guide fixing portion 820 may be fixed to the bottom surface of the lower storage chamber 12 by a coupling portion such as a screw.

For this, a first coupling portion coupling part 825 to which the coupling portion is coupled may be disposed on the guide fixing portion 820.

The first coupling portion coupling part 825 may be disposed on an edge area of the guide fixing portion 820. Also, a hole through which one end of the coupling portion passes may be defined in the first coupling portion coupling part 825.

The first coupling portion coupling part 825 may be provided in plurality. The plurality of first coupling portion coupling parts 825 may be spaced apart from each other along the edge area of the guide fixing portion 820.

The guide body 810 may be mounted on the guide fixing portion 820 so as to be elevated.

The guide body 810 may include a guide body base 811 and a guide body protrusion 812.

The guide body base 811 may have a plate shape having a predetermined thickness. Here, the guide body base 811 may have a size greater than that of the guide body through-hole so as not to pass through the guide body through-hole 821.

That is, an outer circumference of the guide body base 811 may be greater than an inner circumference of the guide body through-hole 821.

The guide body protrusion 821 may protrude from the guide body base 811.

The guide body protrusion 812 may protrude upward from an inner area except for the an edge of the guide body base 811. That is, the guide body protrusion 821 may protrude to be stepped with respect to the guide body base 811.

The guide body protrusion 812 may have a shape and size corresponding to those of the guide body through-hole 812 to pass through the guide body through-hole 812.

That is, the outer circumference of the guide body protrusion 812 may correspond to the inner circumference of the guide body through-hole 812. Here, the guide body protrusion 812 may have a vertical height greater than that of the guide fixing portion 820.

Thus, when the guide body 810 ascends, the guide body protrusion 812 may pass through the guide body through-hole 821 upward to protrude upward from a top surface of the guide fixing portion 820.

In the state in which the guide body 810 maximally ascends, the guide body base 811 may contact a bottom surface of the guide fixing portion outside the guide body through-hole 821. That is, since the guide body base 811 contacts the guide fixing portion 820, the ascending of the guide body 810 may be restricted.

The guide body protrusion 812 may be selectively restricted between the locking protrusion 723 and the locking portion 740 so that the rack gear assembly 400 extends or is contracted by interlocking with the fixing assembly 700 when the drawer door 30 is inserted and withdrawn.

A locking portion through-groove 813 through which the locking portion body 741 passes may be defined in the guide body 810 when the drawer door 30 is initially mounted.

The locking portion through-groove 813 may be recessed from a top surface of the guide body protrusion 812, i.e., be recessed downward in the front direction.

Also, the locking portion through-groove 813 may be opened to a front surface of the guide body protrusion 812.

In more detail, the guide body protrusion 812 may have an approximately rectangular pillar shape. Here, the guide body protrusion 812 may have a horizontal width corresponding to that of the locking protrusion 723.

The locking portion through-groove 813 may be opened to the front surface of the guide body protrusion 812 so that the locking portion protruding downward from the slider body 721 is insertable from a front side.

Here, the locking portion through-hole 813 may have a horizontal width less than that of the guide body protrusion 812. The locking portion through-groove 813 may be disposed within an inner area except for left and right edges of the guide body protrusion 812.

Also, the bottom surface of the locking portion through-groove 813 may be gradually inclined upward in the rear direction. That is, an upwardly inclined guide body inclined surface 814 that is inclined upward in the rear direction may be disposed on the bottom surface of the locking portion through-groove 813.

That is, the locking portion through-groove 813 may be opened to front and top surfaces of the guide body protrusion 812 to define a space that is inclined upward in the rear direction.

The locking portion body 741 may have a horizontal width less than that of the locking protrusion 723. For example, the locking portion body 741 may have a horizontal width corresponding to that of the locking portion through-groove 813.

Thus, the locking portion body 741 may be inserted into the locking portion through-groove 813 from the front side. On the other hand, the locking protrusion 723 may not be inserted into the locking portion through-groove 813 and may contact the front surface of the guide body protrusion 812 outside the locking portion through-groove 813.

When the drawer door 30 is inserted in the initial mounting of the drawer door 30, if the locking portion 740 is in the downwardly moving state, the locking portion body 741 may be inserted into the locking portion through-groove 813 from the front side.

Also, the locking portion body 741 may move along the guide body inclined surface 814 to push the guide body 810 downward. That is, the guide body 810 may be pushed by the locking portion 740 to move downward.

Thus, when the drawer door 30 is initially mounted, the guide body 810 may operate by being interlocked with the locking portion 740 to pass through the locking portion 740.

Also, when the guide body 810 is disposed in the space between the locking protrusion 724 and the locking portion 740, the guide body 810 may move upward by the elastic restoring force. Thus, the guide body protrusion 812 may be inserted into the space between the locking protrusion 724 and the locking portion 740.

Also, since the locking protrusion 724 has the horizontal width greater than that of the locking portion through-groove 813, the guide body protrusion 812 may allow a front surface of the outside of the locking portion through-groove 813 to contact the locking protrusion 724. That is, the locking protrusion 724 may not be inserted into the locking portion through-groove 813 but restrict the guide body protrusion 812 at the front side.

Figure 29:
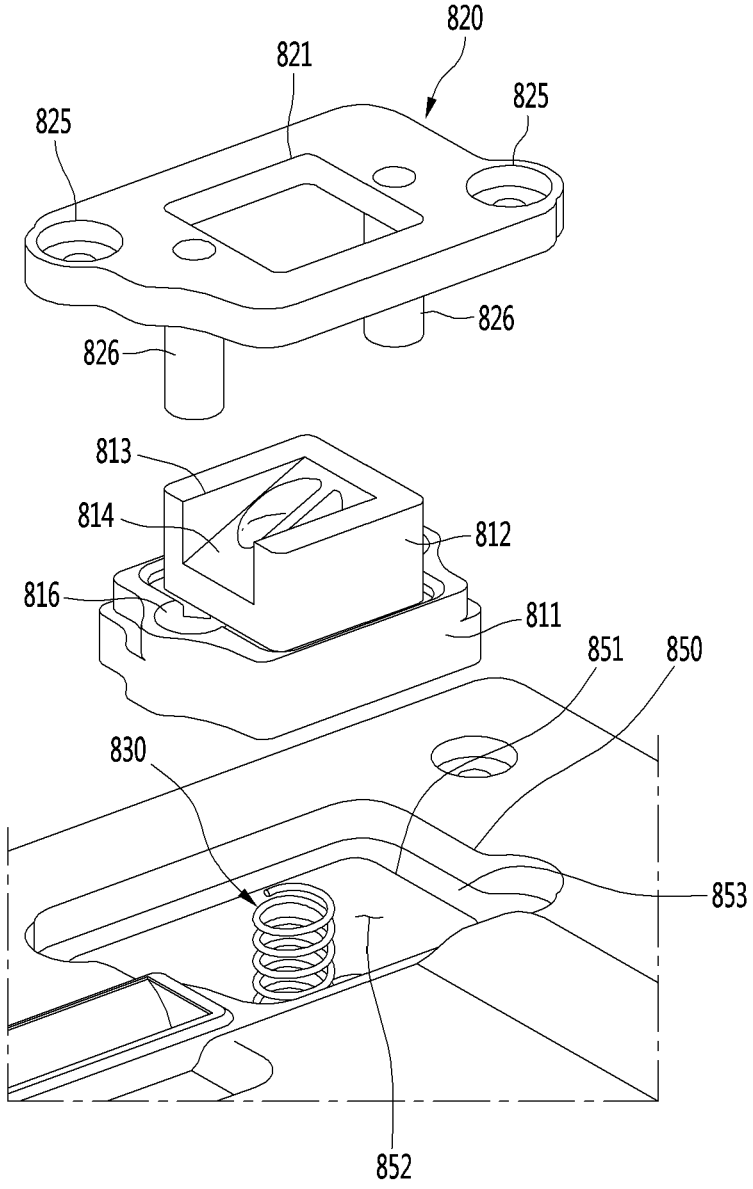
FIG. 29 is an exploded perspective view of the guide according to another implementation.
Figure 30:
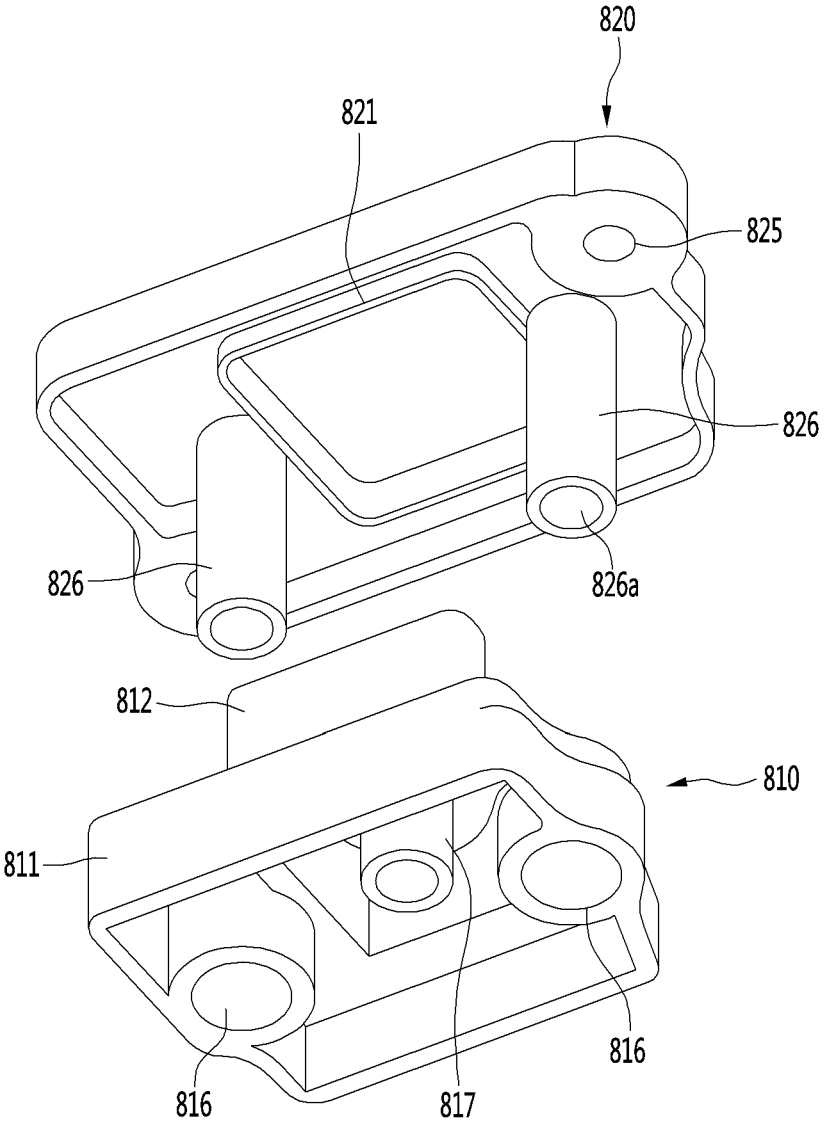
FIG. 30 is a perspective view illustrating a configuration of the guide when viewed from a lower side according to another implementation.
Figure 31:
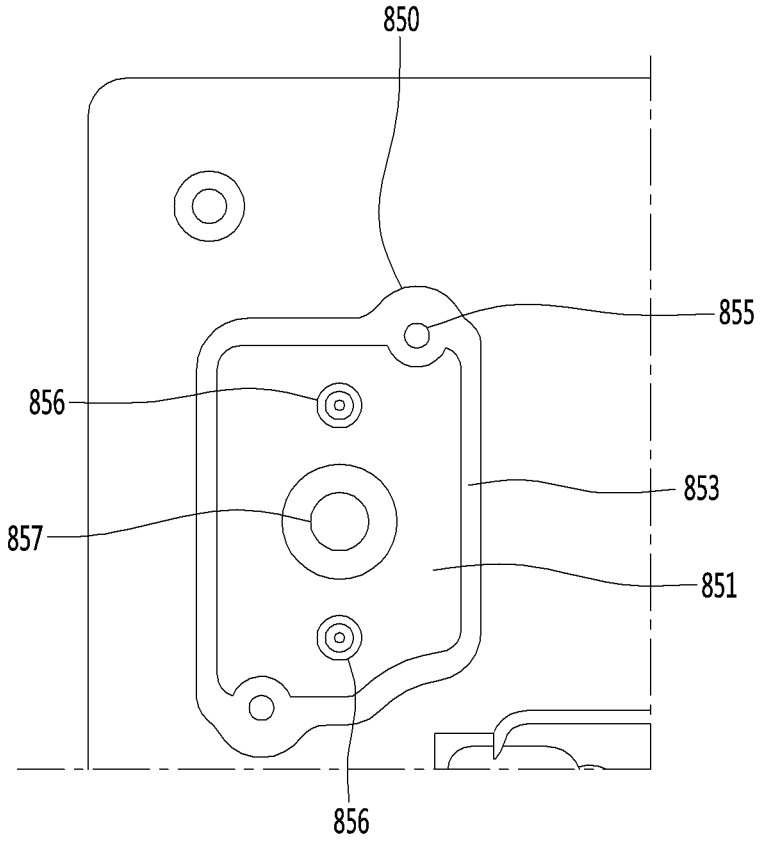
FIG. 31 is a plan view illustrating a guide mounting part when viewed from an upper side according to an implementation.

FIG. 29 is an exploded perspective view of the guide according to another implementation. FIG. 30 is a perspective view illustrating a configuration of the guide when viewed from a lower side according to another implementation. FIG. 31 is a plan view illustrating a guide mounting part when viewed from an upper side according to an implementation.

An elevation guide 826 protruding downward may be disposed on the guide fixing portion 820. The elevation guide 826 may protrude downward from a bottom surface of the guide fixing portion 820.

The elevation guide 826 may be provided in plurality. The plurality of elevation guides 826 may be radially disposed with respect to the guide body through-hole 821.

An elevation guide insertion hole 816 may be defined in the guide body 810. The elevation guide insertion hole 816 may vertically pass through the guide body base 811.

Here, the number of guide insertion holes 816 may correspond to that of elevation guides 826. Also, the guide insertion holes 816 may be radially disposed with respect to the guide body protrusion 812 to correspond to positions of the elevation guides 826.

The guide body 810 may be guided to be elevated by the elevation guide 826 passing through the guide insertion hole 816. Thus, the elevation operation of the guide body 810 may be more stably performed.

A guide mounting part 850 on which the guide fixing portion 820 is mounted may be disposed on the bottom surface of the lower storage chamber 12.

The guide mounting part 850 may include a recess part 851 that is recessed downward from the bottom surface of the lower storage chamber 12.

The recess part 851 may have a shape corresponding to that of the guide body base 811 and be recessed by a depth corresponding a vertical height of the guide body 810.

A guide elevation space 850 in which the guide body 810 is elevated may be defined in the recess part 851.

The guide mounting part 850 may include a stepped part 853 disposed around the recess part 851 on the bottom surface of the lower storage chamber 12. The stepped part 853 may be recessed along a circumference of the recess part 851 in the bottom surface of the lower storage chamber 12.

An edge portion of the guide fixing portion 820 may be seated on the stepped part 853.

Here, the stepped part 853 may be recessed lower than the depth of the recess part 851, i.e., be recessed by a depth corresponding to a thickness of the guide fixing portion 820. Thus, when the guide fixing portion 820 is mounted on the guide mounting part 850, the guide fixing portion 820 may not protrude upward from the bottom surface of the lower storage chamber 12.

A second coupling portion coupling part 855 on which one end of the coupling portion passing through the first coupling portion coupling part 825 is mounted may be disposed on the stepped part 853. The second coupling portion coupling part 855 may be recessed so that one end of the coupling portion is inserted.

An elevation guide coupling protrusion 856 protruding upward may be disposed at a position corresponding to the elevation guide 826 on the bottom surface of the recessed part 851.

An elevation guide groove 826*a* into which the elevation guide coupling protrusion 856 is inserted may be defined in the bottom surface of the elevation guide 826.

In the state in which the guide fixing portion 820 is mounted on the guide mounting part 850, the elevation guide coupling protrusion 856 may be inserted into the elevation guide groove 826*a*. Thus, since the elevation guide 826 is fixed to the recess part 851, the elevation guide 826 may be reinforced in strength and be prevented from being shaken.

The elastic portion 830 may be disposed between the guide body 810 and the bottom surface of the recess part 851 to elastically support the guide body 810.

A second elastic portion fixing protrusion 857 for fixing a lower portion of the elastic portion 830 may be disposed on the bottom surface of the recess part 851.

The second elastic portion fixing protrusion 857 may be defined at a center of the bottom surface of the recess part 851. Also, the second elastic portion fixing protrusion 857 may protrude upward.

The second elastic portion fixing protrusion 857 may have various structures that are capable of fixing the lower portion of the elastic portion 830.

For example, the second elastic portion fixing protrusion 857 may be inserted into a center of a lower portion of the elastic portion 830. Alternatively, the second elastic portion fixing protrusion 857 may define a groove into which the lower portion of the elastic portion 830 is accommodated.

A first elastic portion fixing protrusion 817 for fixing an upper portion of the elastic portion 830 may be disposed on the bottom surface of the guide body 810.

The first elastic portion fixing protrusion 817 may be disposed at a center of the bottom surface of the guide body 810. Also, the first elastic portion fixing protrusion 817 may protrude downward.

The first elastic portion fixing protrusion 817 may have various structures that are capable of fixing the upper portion of the elastic portion 830.

For example, the first elastic portion fixing protrusion 817 may be inserted into a center of the upper portion of the elastic portion 830. Alternatively, the first elastic portion fixing protrusion 817 may define a groove into which the upper portion of the elastic portion 830 is accommodated.

In the present implementation, although the guide mounting part 850 is disposed on the lower wall of the lower storage chamber 12, this is not limited to implementations of the present disclosure.

For example, a separate case portion on which the guide mounting part 850 is disposed may be further provided. Also, the case portion on which the guide mounting part 850 is disposed may have a structure that is mounted on the lower wall of the lower storage chamber 12.

Hereinafter, a process in which the guide 800 is aligned in proper position with the rack gear assembly 400 by inserting the drawer door 30 in the initial mounting of the drawer door 30 will be described in detail with reference to the accompanying drawings.

Figure 32:
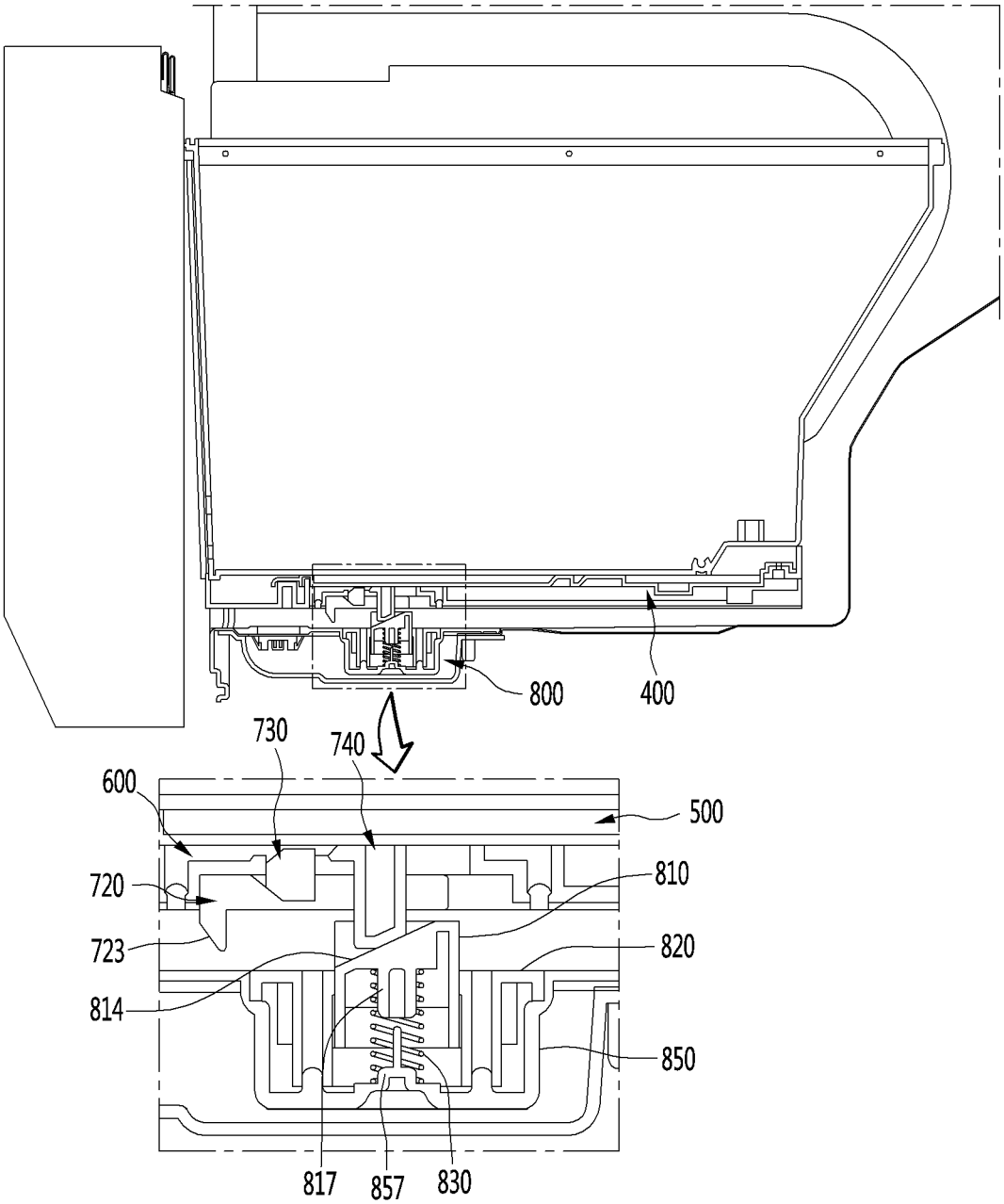
FIG. 32 is a cross-sectional view of the lower storage chamber and the drawer door when the guide operates when the drawer door is inserted in an initial mounting of the drawer door according to an implementation.
Figure 33:
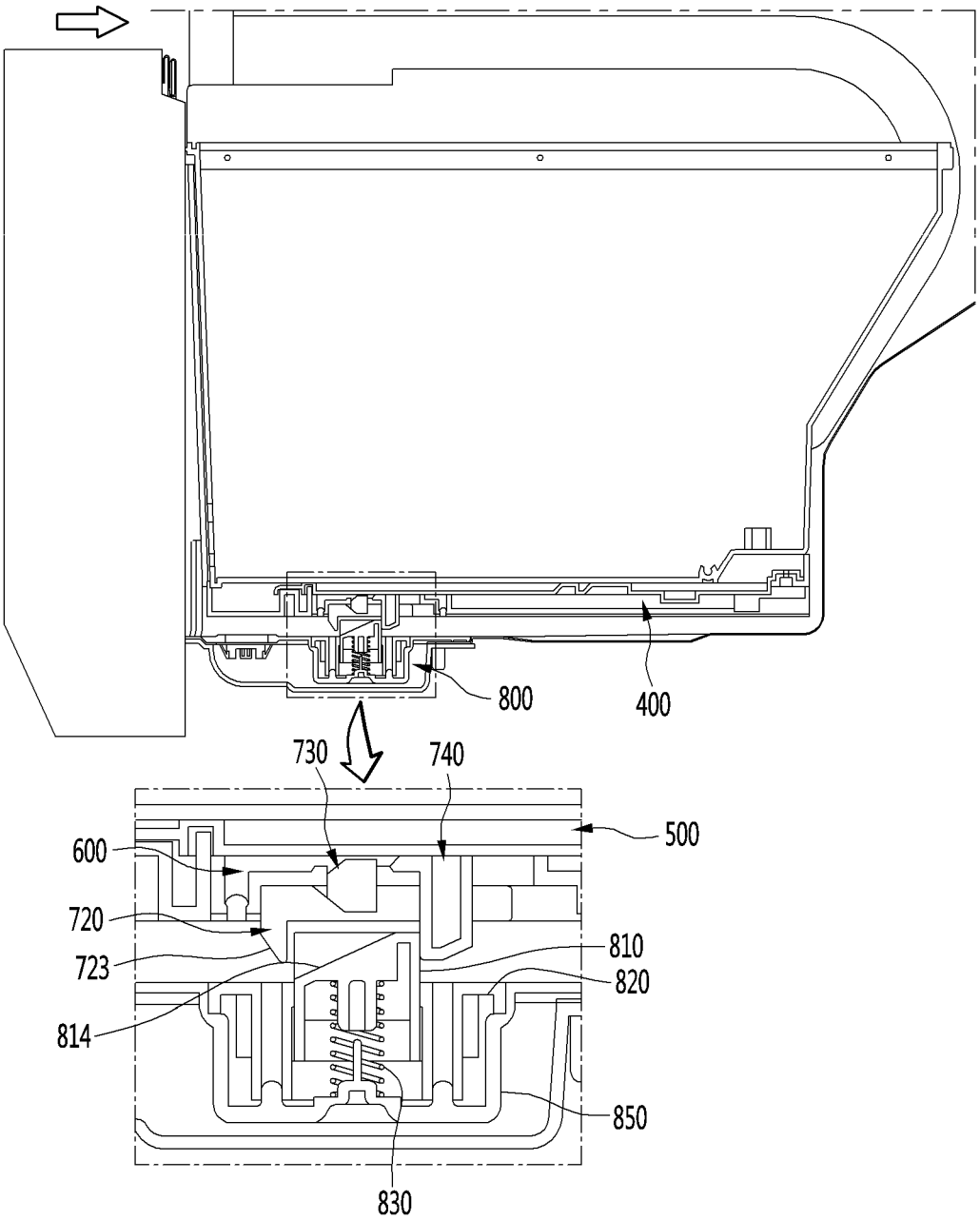
FIG. 33 is a cross-sectional view of the lower storage chamber and the drawer door in a state in which the drawer door is completely inserted according to an implementation.

FIG. 32 is a cross-sectional view of the lower storage chamber and the drawer door when the guide operates when the drawer door is inserted in the initial mounting of the drawer door according to an implementation. FIG. 33 is a cross-sectional view of the lower storage chamber and the drawer door in a state in which the drawer door is completely inserted according to an implementation.

The drawer door 30 may be mounted on the extending draw-out rail 40 so that the drawer door 30 is initially mounted on the cabinet 10.

Here, when the rack gear assembly 400 disposed on the bottom surface of the drawer part 32 maximally extends and is fixed, since the locking portion 740 is in the ascending state, the space between the locking portion 740 and the locking protrusion 723 may be in a state that is opened backward.

Thus, when the drawer door 30 is inserted, the guide body protrusion 812 protruding upward from the guide fixing portion 820 may be inserted into the space between the locking portion 740 and the locking protrusion 723 without performing a separate operation.

Also, the slider 720 may be pressed forward to move forward by the guide body protrusion 812, and the locking portion 740 may move downward so that the guide body protrusion 812 is restricted between the locking portion 740 and the locking protrusion 723.

Also, since the slider 720 moves forward, the holder 730 may descends to release the fixed state of the moving rack portion 600 to the fixed rack portion 600. Also, since the slider 720 is pressed forward by the guide body protrusion 812, the moving rack portion 600 may be inserted into the fixed rack portion 500 to reduce the length of the rack gear assembly 400.

Also, when the drawer door 30 is completely inserted, the rack gear assembly 400 may be in the initial state, and the rack gear 401 may be coupled to a proper position of the pinion 330.

When the drawer door 30 is initially mounted, if the rack gear assembly 400 does not maximally extend or is not fixed, the locking portion 740 may be in the downward moving state. That is, a rear side of the space between the locking portion 740 and the locking protrusion 723 may be in a closed state.

In this case, when the drawer door 30 is inserted, the locking portion 740 may contact the guide body protrusion 812 in front of the guide body protrusion 812.

Also, since the locking portion 740 is pressed forward by the guide body protrusion 812, the moving rack portion 600 may be inserted into the fixed rack portion 500 to reduce the length of the rack gear assembly 400.

Here, since the guide body protrusion 812 is not disposed at the proper position between the locking portion 740 and the locking protrusion 723 but is disposed at the rear side, the guide body protrusion 812 may be in the initial state in which the length of the rack gear assembly 400 is maximally reduced in the state in which the drawer door 30 is not completely inserted.

Here, when the drawer door 30 is continuously inserted, the locking portion 740 may be inserted into the locking portion through-groove 813 from the front side. Also, the locking portion 740 may move along the guide body inclined surface 814 to press the guide body 810 downward.

Also, since the guide body 810 is pressed downward, the elastic portion 830 may be compressed, and thus, the guide body 810 may move downward.

Also, when the drawer door 30 is completely inserted, the guide body protrusion 812 may pass through the locking portion 740 and then be disposed to correspond to the space between the locking portion 740 and the locking protrusion 723.

Also, the guide body 812 may ascend by the elastic force of the elastic portion 830, and the guide body protrusion 812 may be inserted to be restricted between the locking protrusion 740 and the locking protrusion 723. That is, the guide 800 may be in the state of being coupled to the proper position of the rack gear assembly 400.

Here, the rack gear assembly 400 may be in the initial state, and the rack gear 401 may be in the state of being coupled to the proper position of the pinion 330.

As described above, when the guide 800 is provided according to another implementation, the rack gear assembly 400, the guide 800, and the pinion 330 may be aligned in proper position by performing only the operation in which the drawer door 30 is inserted regardless of the state of the rack gear assembly 400 when the drawer door 30 is initially mounted. Therefore, the assemblability of the drawer door 30 may be improved.

The refrigerator according to the implementations may have the following effects.

First, since the drawer door is provided to be automatically insertable and withdrawable by the interlocking of the rack gear assembly and the pinion rotating by the motor, when the drawer door is withdrawn, the rack gear assembly provided in the drawer door may extend so that the rack gear provided in the rack gear assembly increases in length. Thus, the withdrawal distance of the drawer door may increase to allow the storage space of the drawer door to be more exposed to the outside, thereby significantly improve the storage convenience of the food.

Second, when the drawer door is inserted and withdrawn, the rack gear assembly may decrease in length to prevent the rear end of the rack gear assembly and the rear wall of the storage chamber from interfering with each other. That is, while the withdrawal distance of the drawer door increases, the interference between the rack gear assembly and the inner wall of the storage chamber may be prevented.

Third, since the moving rack portion is fixed to one side of the storage chamber by the fixing assembly during the initial withdrawal of the drawer door, the moving rack portion may not be withdrawn together with the drawer door but be withdrawn backward from the fixed rack portion. Also, in the state in which the moving rack portion is maximally withdrawn from the fixed rack portion, the state in which the moving rack portion is fixed to one side of the storage chamber by the fixing assembly may be released, and thus, the moving rack portion may be withdrawn to the front side of the storage chamber together with the fixed rack portion and the drawer door.

Therefore, the rack gear assembly may be withdrawn from the storage chamber in the state in which the rack gear assembly maximally extends in length by the rotation of the pinion.

Fourth, in the state in which the moving rack portion is maximally withdrawn from the fixed rack portion, the moving rack portion may be fixed to the fixed rack portion by the fixing assembly. Thus, even though the pinion is disposed on the rack gear disposed on the moving rack portion to rotate so as to push the moving rack portion forward, the moving rack portion may be prevented from being inserted into the fixed rack portion.

Therefore, the rack gear assembly may be fixed in the state of maximally extending in length. Thus, the rack gear assembly may be withdrawn from the storage chamber by the rotation of the pinion so that the withdrawal distance of the drawer door increases.

Fifth, the driving device including the pinion and the motor for the rotation of the pinion may be disposed on the bottom surface of the storage chamber, and the rack gear assembly may be disposed on the bottom surface of the drawer door. Thus, when the drawer door is withdrawn, the rack gear assembly and the driving device may be prevented from being exposed. Therefore, when the drawer door is withdrawn, since the rack gear assembly and the driving device are not exposed, the outer appearance may be neat to provide the elegant appearance.

Sixth, since the pinion is disposed on the front end of the bottom surface of the storage chamber, when the drawer door is withdrawn, the coupled state between the pinion and the rack gear assembly may be maintained longer. Therefore, the withdrawal distance of the drawer door may more effectively increase.

Although implementations have been described with reference to a number of illustrative implementations thereof, it should be understood that numerous other modifications and implementations can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet that defines a storage chamber;

a drawer door configured to be inserted into and withdrawn out of the storage chamber, the drawer door comprising a drawer part that defines an upwardly open storage space, and a door part that is configured to, based on the drawer door being inserted into the storage chamber, close the storage chamber;

a motor assembly provided at the storage chamber and comprising a motor and a pinion gear that is rotated by the motor, the motor assembly being configured to provide a driving force that moves the drawer door relative to the storage chamber; and a rack gear assembly provided at the drawer door and having an extendable rack gear that is configured to be coupled to the pinion gear, wherein the rack gear comprises:

a fixed rack that is fixed to the drawer door, and a moving rack that is slidably coupled to the fixed rack and configured to extend from the fixed rack, wherein the rack gear assembly further comprises a fixing assembly configured to fix the moving rack to the storage chamber during an initial withdrawal of the drawer door from the storage chamber such that the moving rack is withdrawn from the fixed rack, wherein the moving rack is configured, based on the drawer door and the fixed rack moving relative to the storage chamber in a forward direction, to extend away from the fixed rack in a rearward direction, and wherein a length of the rack gear is configured to change according to a withdrawal position of the drawer door.

2. The refrigerator according to claim 1, wherein each of the fixed rack and the moving rack defines a surface portion of the rack gear that couples to the pinion gear, and wherein a portion of the rack gear is divided into left and right portions that slide relative to each other based on the sliding of the moving rack relative to the fixed rack, one of the left and right portions being part of the moving rack and the other of the left and right portions being part of the fixed rack.

3. The refrigerator according to claim 1, wherein the fixed rack comprises:

a first fixed rack portion that is configured to be coupled to the pinion during the initial withdrawal of the drawer door from the storage chamber; and a second fixed rack portion positioned rearward of the first fixed rack portion, and wherein at least a portion of the moving rack overlaps with the second fixed rack portion along the forward and rearward directions.

4. The refrigerator according to claim 3, wherein the fixed rack comprises:

a first fixed rack formation surface on which the first fixed rack portion is disposed;

a second fixed rack formation surface on which the second fixed rack portion is disposed, the second fixed rack formation surface being on the same plane as the first fixed rack formation surface; and a moving rack coupling part that is disposed at one side of the second fixed rack portion, the moving rack coupling part being recessed from the second fixed rack formation surface and configured to accommodate and be coupled to the moving rack.

5. The refrigerator according to claim 4, wherein the moving rack comprises a moving rack formation surface that is, based on the moving rack being coupled to the moving rack coupling part, on the same plane as the second fixed rack formation surface.

6. The refrigerator according to claim 4, wherein a length of the moving rack corresponds to a length of the moving rack coupling part.

7. The refrigerator according to claim 1, wherein the fixing assembly is configured to selectively fix the moving rack to one side of the storage chamber based on the drawer door being inserted and withdrawn such that the moving rack is, respectively, inserted into and withdrawn from the fixed rack.

8. The refrigerator according to claim 1, wherein based on the moving rack being maximally withdrawn from the fixed rack, the fixing assembly is configured to release the fixation between the moving rack and the storage chamber such that the moving rack is withdrawn from the storage chamber together with the fixed rack.

9. The refrigerator according to claim 8, wherein based on the moving rack being maximally withdrawn from the fixed rack and the drawer door being inserted into the storage chamber, the fixing assembly is configured to fix the moving rack to the storage chamber such that the moving rack is inserted into the fixed rack.

10. The refrigerator according to claim 8, wherein the fixing assembly is configured to fix the moving rack to the fixed rack based on the moving rack being maximally withdrawn from the fixed rack during a withdrawal of the drawer door, and wherein the fixing assembly is configured to release the fixation between the moving rack and the fixed rack based on the drawer door being inserted.

11. The refrigerator according to claim 7, further comprising a protruding guide disposed on one side of the storage chamber, wherein the fixing assembly is configured to selectively restrict the protruding guide.

12. The refrigerator according to claim 11, wherein the fixing assembly comprises:

a slider disposed on the moving rack and configured to move in the forward-rearward direction;

a locking protrusion protruding from one side of the slider and configured to contact the protruding guide based on the drawer door being inserted to thereby move the slider forward; and a locking portion disposed on the slider and configured to move in a direction that crosses a moving direction of the slider, the locking portion being configured to protrude away from the slider based on the forward movement of the slider to thereby restrict the protruding guide between the locking portion and the locking protrusion.

13. The refrigerator according to claim 12, wherein based on the moving rack being maximally withdrawn from the fixed rack during a withdrawal of the drawer door, the slider is configured to be pulled by the protruding guide restricted between the locking protrusion and the locking portion to thereby move rearward, and wherein the locking portion is inserted into the slider by the rearward movement of the slider to release the restriction of the protruding guide.

14. The refrigerator according to claim 13, wherein the locking portion is configured to pass through the slider and the moving rack, and wherein the rack gear assembly comprises:

a moving rack mounting part that is recessed from one side of the fixed rack and on which the moving rack is mounted to be movable forward and rearward, a locking portion insertion groove disposed on a rear portion of the moving rack mounting part, the locking portion insertion groove being configured to accommodate an upper portion of the locking portion based on the locking portion being inserted into the slider, a locking portion descending guide surface disposed in the locking portion insertion groove, the locking portion descending guide surface being upwardly inclined toward the rearward direction, a fixing assembly mounting part that is disposed on a front portion of the moving rack and on which the slider is disposed to be movable forward and rearward, a first locking portion through-hole defined in the fixing assembly mounting part at a position corresponding to the locking portion insertion groove, and a locking portion ascending guide disposed in the first locking portion through-hole, the locking portion ascending guide being upwardly inclined toward the rearward direction.

15. The refrigerator according to claim 14, wherein the locking portion is configured to move rearward together with the slider as the slider moves rearward and to be guided to ascend by the locking portion ascending guide, and wherein the locking portion is configured, based on the slider moving forward and the moving rack being inserted into the fixed rack, to be guided to descend by the locking portion descending guide surface.

16. The refrigerator according to claim 12, wherein the fixing assembly comprises a holder configured to selectively pass through the moving rack so as to be inserted into one side of the fixed rack as the slider moves forward and rearward, wherein the holder is disposed together with the moving rack and the fixed rack to fix the fixed rack based on the slider moving rearward, and wherein the holder is configured to be separated from the fixed rack based on the slider moving forward.

17. The refrigerator according to claim 16, wherein the rack gear assembly comprises:

a moving rack mounting part that is recessed from one side of the fixed rack and on which the moving rack is mounted to be movable forward and rearward;

a first holder insertion groove defined in a rear portion of the moving rack mounting part;

a holder descending guide surface disposed in the first holder insertion groove, the holder descending guide surface being upwardly inclined toward the rearward direction;

a fixing assembly mounting part that is disposed on a front portion of the moving rack and on which the slider is disposed to be movable forward and rearward;

a holder through-hole defined in the fixing assembly mounting part at a position corresponding to the first holder insertion groove in a state in which the moving rack is maximally withdrawn from the fixed rack;

a second holder insertion groove defined in one surface of the slider facing the fixing assembly mounting part at a position corresponding to the holder through-hole in a state in which the slider moves forward; and a holder ascending guide surface disposed in the second holder insertion groove, the holder ascending guide surface being downwardly inclined toward the rearward direction.

18. The refrigerator according to claim 17, wherein the holder is configured to be guided to ascend by the holder ascending guide surface as the slider moves rearward in the state in which the moving rack is maximally withdrawn from the fixed rack, and wherein the holder is configured, based on the slider moving forward and the moving rack being inserted into the fixed rack, to be guided to descend by the holder descending guide surface.

19. The refrigerator according to claim 1, wherein the rack gear assembly comprises:

a stopper protruding from one side of the fixed rack; and a stopper contact part protruding from one side of the moving rack, the stopper contact part being configured to contact the stopper based on the moving rack being maximally withdrawn from the fixed rack.

20. The refrigerator according to claim 1, wherein the motor assembly is disposed on a bottom surface of the storage chamber, and wherein the rack gear assembly is disposed on a bottom surface of the drawer door.

21. The refrigerator according to claim 20, wherein the pinion gear of the motor assembly is disposed on a front end of the bottom surface of the storage chamber.

22. A refrigerator comprising:

a cabinet that defines a storage chamber;

a drawer door configured to be inserted into and withdrawn out of the storage chamber, the drawer door comprising a drawer part that defines an upwardly open storage space, and a door part that is configured to, based on the drawer door being inserted into the storage chamber, close the storage chamber;

a motor assembly provided at the storage chamber and comprising a motor and a pinion gear that is rotated by the motor, the motor assembly being configured to provide a driving force that moves the drawer door relative to the storage chamber; and a rack gear assembly provided at the drawer door and having an extendable rack gear that is configured to be coupled to the pinion gear, wherein the rack gear comprises:

a fixed rack that is fixed to the drawer door, and a moving rack that is slidably coupled to the fixed rack and configured to extend from the fixed rack, wherein the moving rack is configured, based on the drawer door and the fixed rack moving relative to the storage chamber in a forward direction, to extend away from the fixed rack in a rearward direction, wherein a length of the rack gear is configured to change according to a withdrawal position of the drawer door, wherein the fixed rack comprises:

a first fixed rack portion that is configured to be coupled to the pinion during the initial withdrawal of the drawer door from the storage chamber, and a second fixed rack portion positioned rearward of the first fixed rack portion, wherein at least a portion of the moving rack overlaps with the second fixed rack portion along the forward and rearward directions, wherein the first fixed rack portion has a first width equal to a width of the pinion, and wherein a combined width of the second fixed rack portion and the moving rack equals to the first width of the first fixed rack.

* * * * *